US006956326B2

(12) United States Patent
Kawai et al.

(10) Patent No.: US 6,956,326 B2
(45) Date of Patent: Oct. 18, 2005

(54) GAS DISCHARGE TUBE HAVING INSULATOR BETWEEN APERTURE MEMBERS

(75) Inventors: Koji Kawai, Hamamatsu (JP); Yoshinobu Ito, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/416,656

(22) PCT Filed: Nov. 15, 2001

(86) PCT No.: PCT/JP01/09991

§ 371 (c)(1),
(2), (4) Date: May 14, 2003

(87) PCT Pub. No.: WO02/41359

PCT Pub. Date: May 23, 2002

(65) Prior Publication Data

US 2004/0041523 A1 Mar. 4, 2004

(30) Foreign Application Priority Data

Nov. 15, 2000 (JP) ..... 2000-348391
Aug. 24, 2001 (JP) ..... 2001-255234

(51) Int. Cl.[7] ..... H01J 17/02

(52) U.S. Cl. ..... 313/609; 313/610; 313/611; 313/612

(58) Field of Search ..... 313/609–612

(56) References Cited

U.S. PATENT DOCUMENTS 3,501,665 A * 3/1970 Haas et al. ..... 313/146
3,508,106 A * 4/1970 Vecsernyes ..... 313/231.61
5,552,669 A 9/1996 Ikedo et al. ..... 313/613
5,587,625 A 12/1996 Ikedo et al. ..... 313/613
5,619,101 A 4/1997 Ikedo et al. ..... 313/581
5,633,563 A 5/1997 Ikedo et al. ..... 313/292
5,646,487 A 7/1997 Ikedo et al. ..... 315/94
5,684,363 A 11/1997 Ikedo et al. ..... 313/631
5,698,945 A 12/1997 Ikedo et al. ..... 313/613
5,886,470 A 3/1999 Smolka ..... 313/637

FOREIGN PATENT DOCUMENTS

| | | |
|---|---|---|
| JP | 54-141780 | 10/1979 |
| JP | 06-310101 | 11/1994 |
| JP | 07-326324 | 12/1995 |
| JP | 08-077965 | 3/1996 |
| JP | 08-077969 | 3/1996 |
| JP | 08-077979 | 3/1996 |
| JP | 08-222185 | 8/1996 |
| JP | 08-222186 | 8/1996 |
| JP | 08-236081 | 9/1996 |

* cited by examiner

*Primary Examiner*—Nimeshkumar D. Patel
*Assistant Examiner*—Anthony Perry
(74) *Attorney, Agent, or Firm*—Drinker Biddle & Reath LLP

(57) ABSTRACT

The gas discharge tube in accordance with the present invention comprises at least two electrically conductive aperture members disposed within a thermoelectron transmission path between a cathode and an anode, and an insulator for electrically insulating the electrically conductive aperture members from each other, thereby being able to emit light with a high luminance. Its startability at the time of emitting light can be enhanced in particular when the aperture area of the electrically conductive aperture member on the downstream side in the thermoelectron transmission path is set favorably.

21 Claims, 71 Drawing Sheets

GAS DISCHARGE TUBE HAVING INSULATOR BETWEEN APERTURE MEMBERS

TECHNICAL FIELD

The present invention relates to a gas discharge tube for use as alight source for a spectrometer and chromatography in particular.

BACKGROUND ART

Japanese Patent Application Laid-Open No. HEI 6-310101 has conventionally been known as a technique in such a field. In the gas (deuterium) discharge tube disclosed in the publication mentioned above, two metal barriers are disposed on a discharge path between an anode and a cathode, whereas each metal barrier is formed with a small hole which narrows the discharge path. As a result, light having a high luminance can be obtained through the small holes on the discharge path. If three or more metal barriers are provided, a higher luminance is obtained. Light having a higher luminance is obtained as the small holes are made smaller.

DISCLOSURE OF THE INVENTION

The gas discharge tube in accordance with the present invention comprises at least two electrically conductive aperture members disposed within a thermoelectron transmission path between an anode and a cathode, and an insulator for electrically insulating the electrically conductive aperture members from each other. Namely, these electrically conductive aperture members can be provided with potentials independent from each other, whereby the use of such a configuration can enhance the startability of light emission and enables light emission with a high luminance. That is, these characteristics are remarkably improved in particular when the aperture area of the electrically conductive aperture member on the downstream side of the thermoelectron transmission path is set favorably.

BEST MODES FOR CARRYING OUT THE INVENTION

In the following, preferred embodiments of the gas discharge tube in accordance with the present invention will be explained in detail with reference to the drawings. Here, constituents-identical to each other will be referred to with numerals identical to each other without repeating their overlapping explanations.

(First Embodiment)

Figure 1:
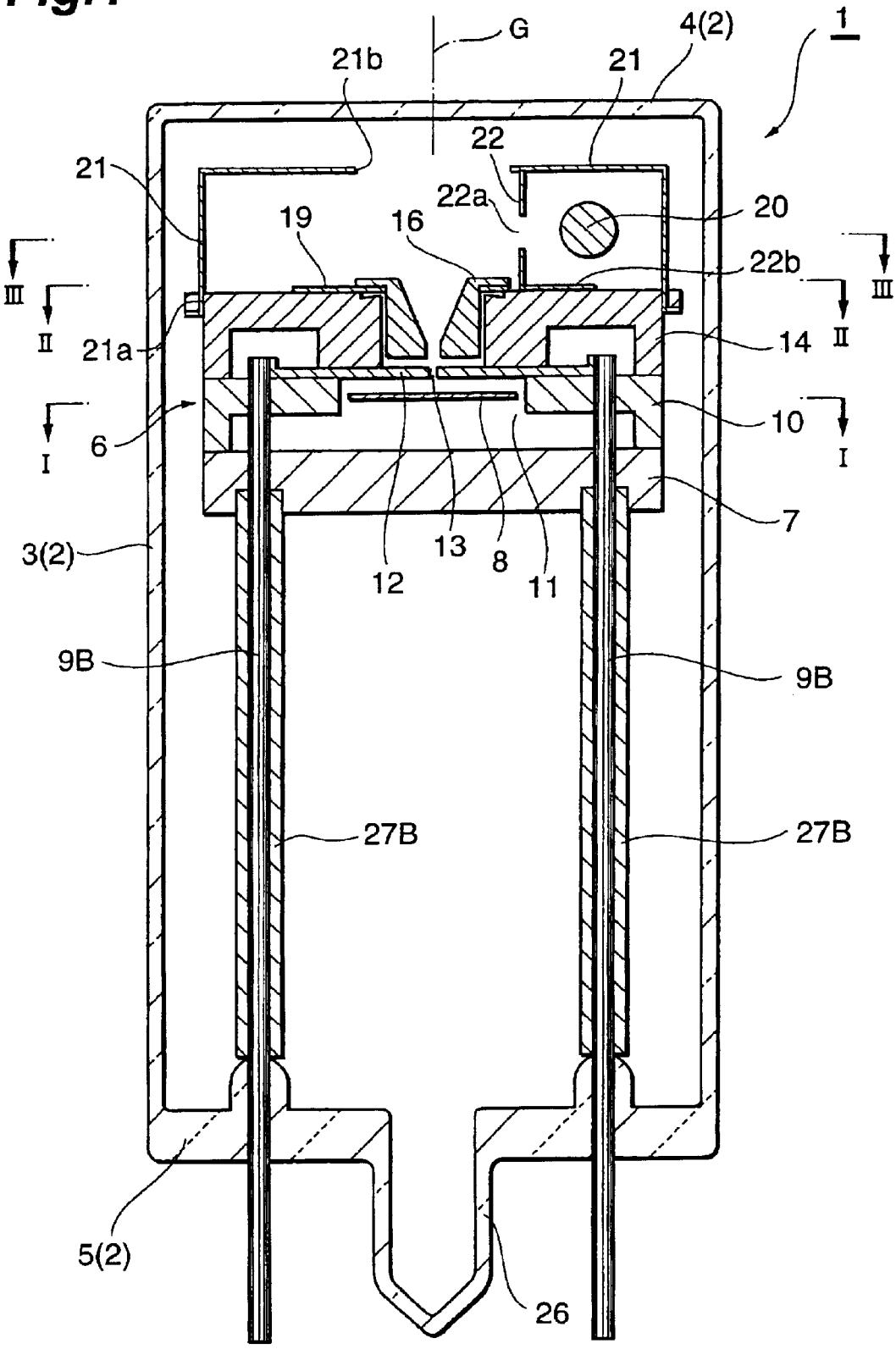
FIG. 1 is a sectional view showing a first embodiment of the gas discharge tube in accordance with the present invention.
Figure 2:
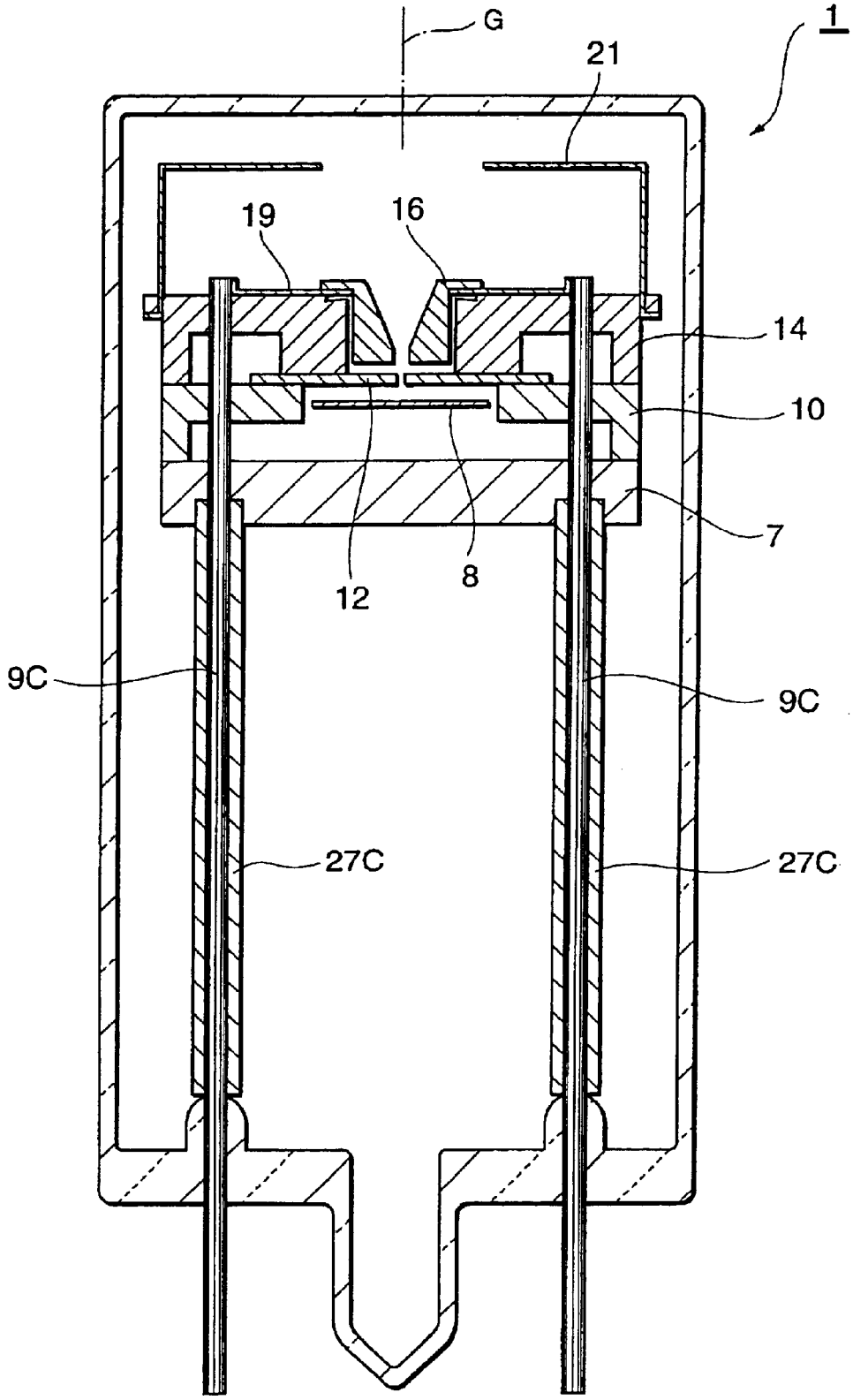
FIG. 2 is a sectional view of the gas discharge tube shown in FIG. 1.

As shown in FIGS. 1 and 2, a gas discharge tube 1 is a head-on type deuterium lamp having a hermetic envelope 2 made of glass in which a deuterium gas is encapsulated at about several hundred Pa; whereas the hermetic envelope 2 comprises a cylindrical side tube 3, a light exit window 4 sealing one side of the side tube 3, and a stem 5 sealing the other side of the side tube 3. Accommodated within the hermetic envelope 2 is a light emitter assembly 6.

Figure 3:
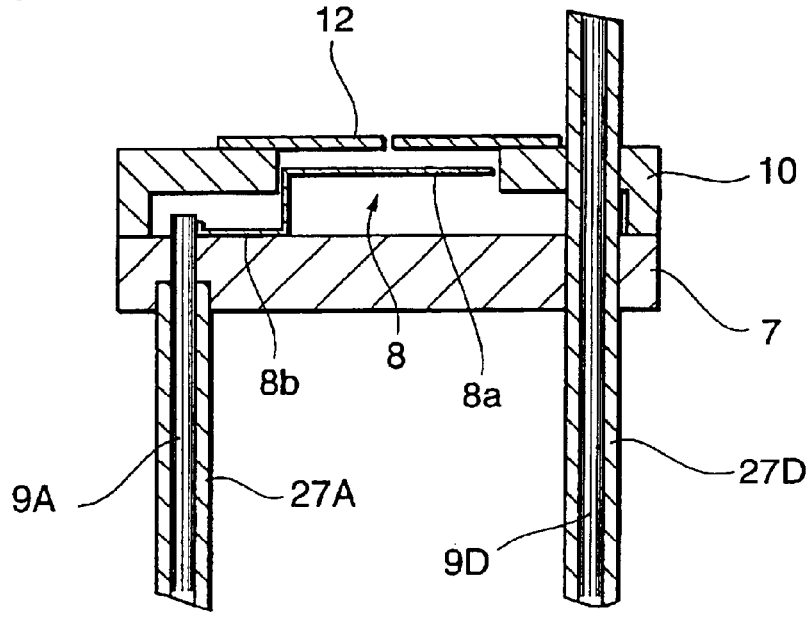
FIG. 3 is a partly enlarged sectional view of an anode part.
Figure 4:
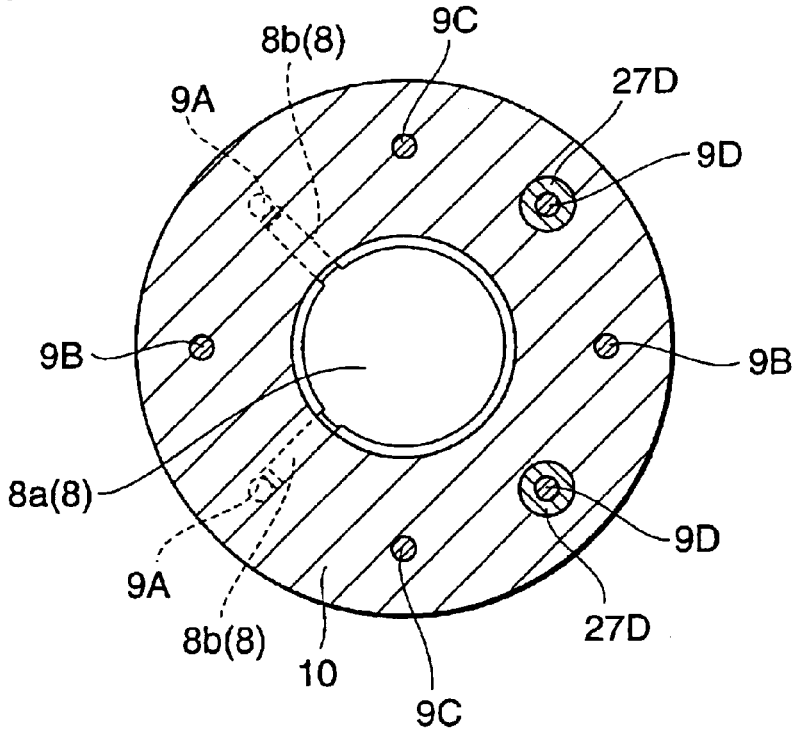
FIG. 4 is a sectional view taken along the line I—I of FIG. 1.
Figure 9:
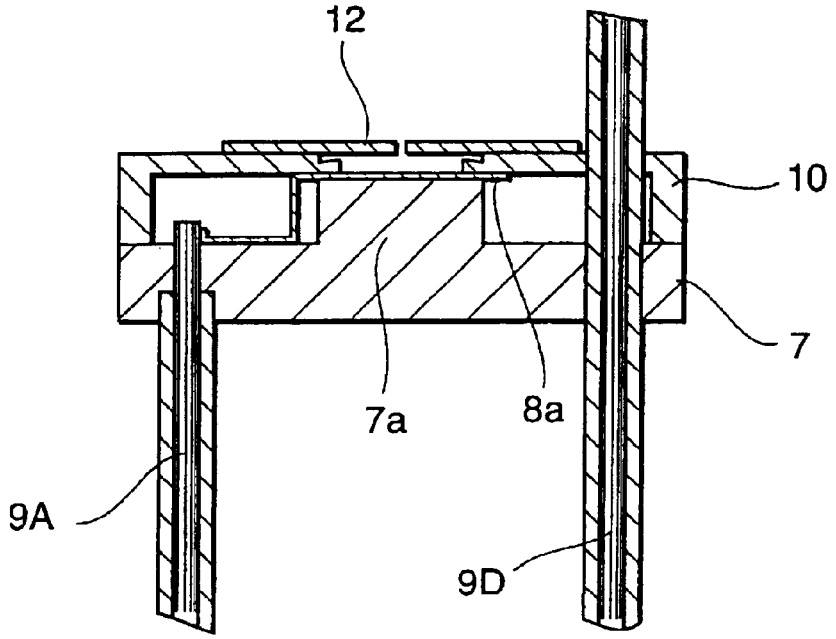
FIG. 9 is a sectional view showing another method of securing the anode part.

The light emitter assembly 6 has a disk-shaped electrically insulating part (first support part) 7. As shown in FIGS. 3 and 4, an anode plate (anode part) 8 is disposed on the electrically insulating part 7. A circular main part 8*a* of the anode plate 8 is separated from the electrically insulating part 7, whereas two lead parts 8*b* extending from the main part 8*a* are electrically connected to respective leading end parts of anode stem pins (first stem pins) 9A raised from the stem 5 so as to extend along the tube axis G. Here, the main part 8*a* maybe held and secured between the upper face of a projection 7*a* formed in the electrically insulating part 7 and the rear face of a second support part 10 which will be explained later (see FIG. 9).

As shown in FIGS. 1 and 2, the light emitter assembly 6 has a disk-shaped electrically insulating part (second support part) 10 made of electrically insulating ceramics. This second support 10 is mounted so as to be overlaid on the first support part 7, and is formed with the same diameter as that of the first support part 7. A circular discharge aperture 11 is formed at the center of the second support part 10 such that the main part 8*a* of the anode plate 8 is seen there through (see FIG. 4). A disk-shaped discharge path restricting plate (second discharge path restricting part) 12 made of a metal is brought into contact with the upper face of the second support part 10, so that the main part 8*a* of the anode plate 8 and the discharge path restricting plate 12 face each other.

Figure 5:
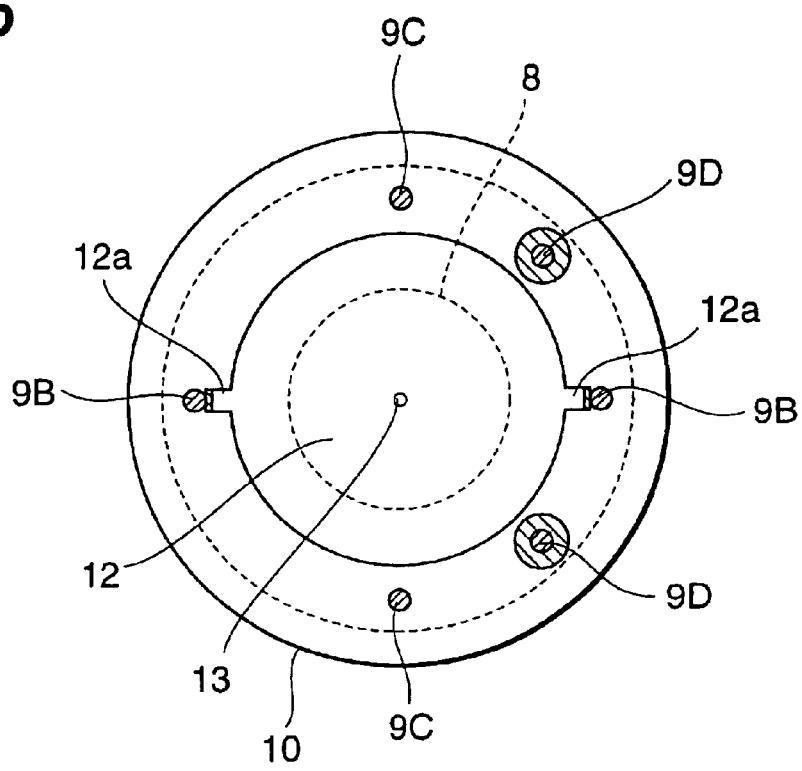
FIG. 5 is a plan view showing a second discharge path restricting part.

As shown in FIG. 5, a small hole (second aperture) 13 having a diameter of 0.2 mm for narrowing the discharge path is formed at the center of the discharge path restricting plate 12. The discharge path restricting plate 12 is provided with two lead parts 12*a*, which are electrically connected to respective leading end parts of discharge path restricting plate stem pins (fourth stem pins) 9B raised from the stem 5.

Figure 6:
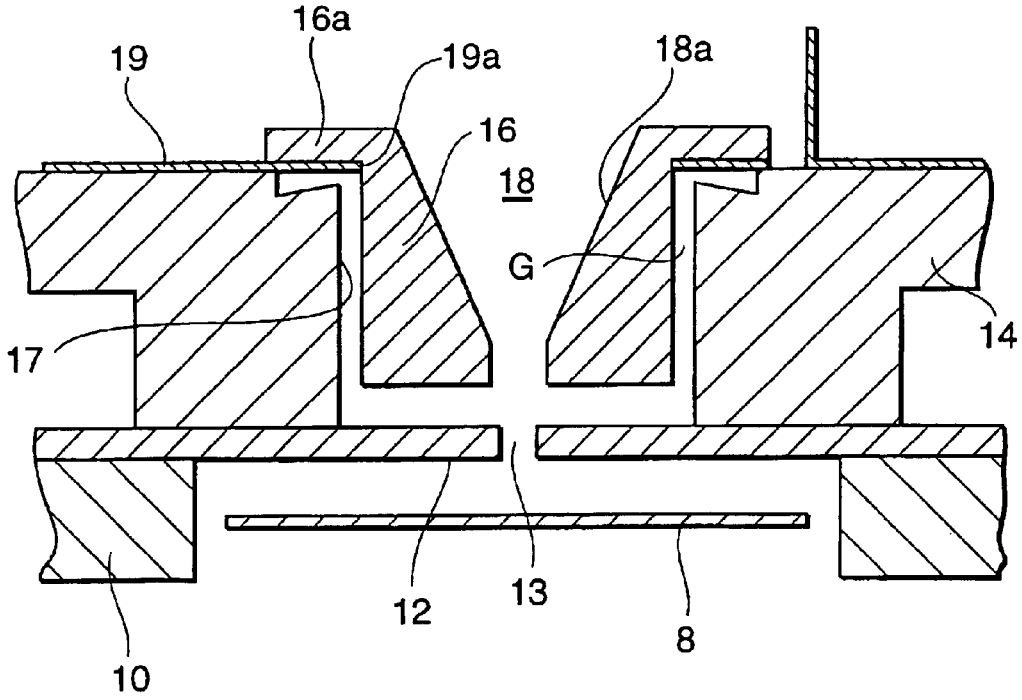
FIG. 6 is a partly enlarged sectional view of discharge path restricting parts.
Figure 10:
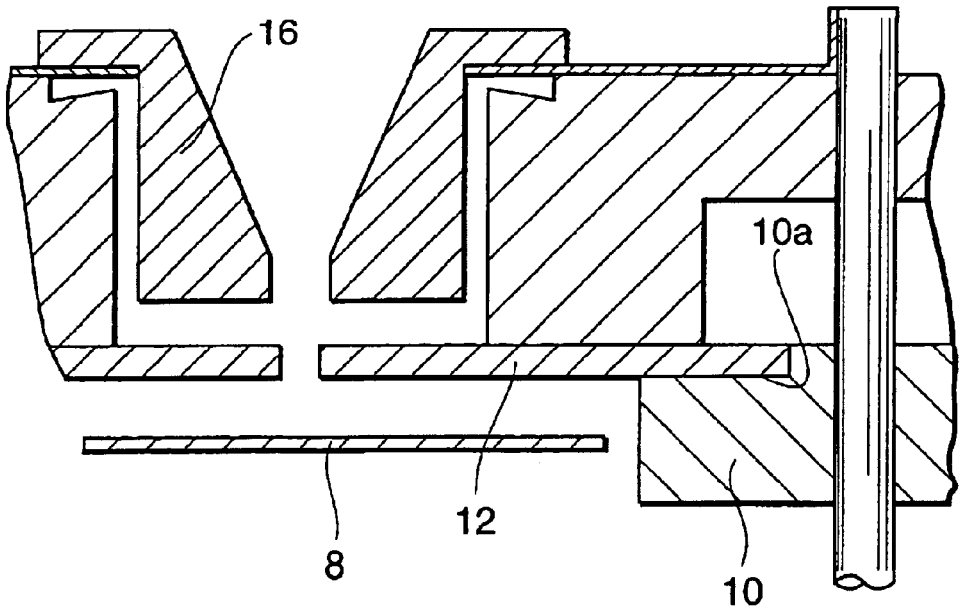
FIG. 10 is a sectional view showing another method of securing the second discharge path restricting part.

As shown in FIGS. 1, 2, and 6, the light emitter assembly 6 has a disk-shaped electrically insulating part (third support part) 14 made of electrically insulating ceramics. This third support part 14 is mounted so as to be overlaid on the second support part 10, and is formed with the same diameter as that of the second support part 10. The second discharge path restricting plate 12 is held and secured between the lower face of the third support part 14 and the upper face of the second support part 10. The second discharge path restricting plate 12 may be accommodated within a depression 10*a* formed in the upper face of the second support part 10, so as to improve the seatability of the second discharge path restricting plate 12 (see FIG. 10). Such a configuration takes account of the workability of assembling the gas discharge tube 1, so as to secure the second discharge path restricting plate 12 within the hermetic envelope 2 reliably. Also, it can prevent the second discharge path restricting plate 12 from moving due to thermal expansion at a high temperature when the lamp is in operation.

A loading port 17 for loading a first discharge path restricting part 16 made of an electrically conductive metal (e.g., molybdenum, tungsten, or their alloys) is formed at the center of the third support part 14. For narrowing the discharge path, the discharge path restricting part 16 is formed with a first aperture 18 having a diameter greater than that of the second aperture 13, whereas the first aperture 18 is positioned on the same tube axis G as the second aperture 13.

The first aperture 18 has a funnel part 18*a*, extending along the tube axis G, for producing a favorable arc ball, whereas the funnel part 18*a* tapers down its diameter from the light exit window 4 toward the anode part 8. Specifically, it is formed with a diameter of 3.2 mm on the light exit window 4 side and with a diameter of about 1 mm on the anode part 8 side so as to attain an aperture area greater than that of the second aperture 13. Thus, the discharge path is narrowed by the first aperture 18 and second aperture 13 in cooperation.

Figure 7:
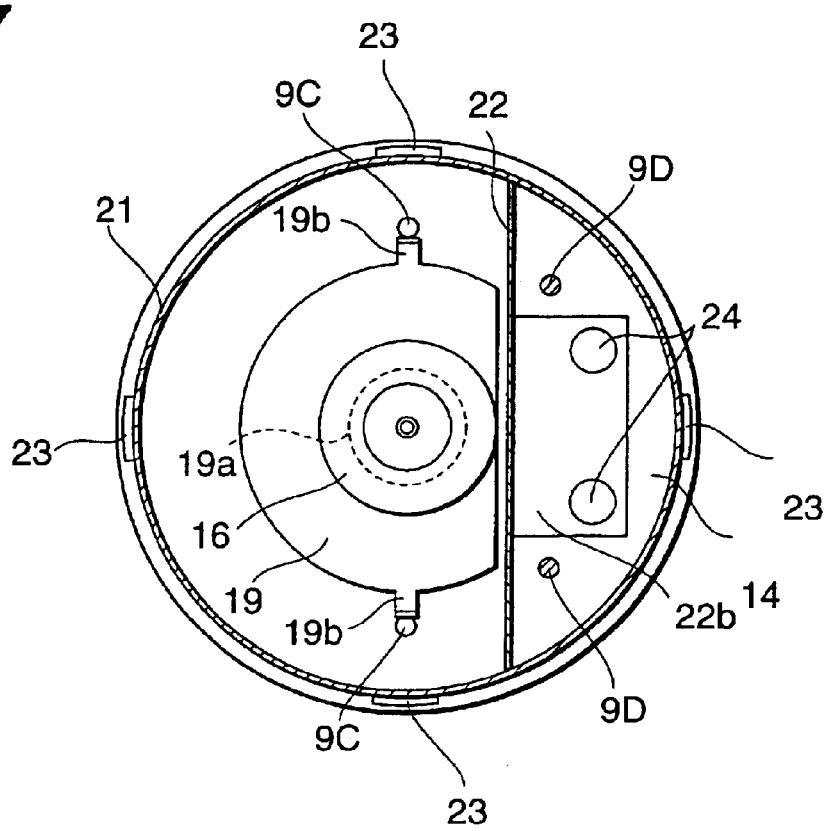
FIG. 7 is a sectional view taken along the line II—II of FIG. 1.

An electrically conductive plate 19 is arranged in contact with the upper face of the third support part 14, whereas an aperture 19*a* formed in the electrically conductive plate 19 is aligned with the loading port 17, thus allowing the loading of the first discharge path restricting part 16. The electrically conductive plate 19 is provided with two lead parts 19*b*, which are electrically connected to respective leading end parts of discharge path restricting plate stem pins (third stem pins) 9C raised from the stem 5 (see FIGS. 2 and 7). A flange part 16*a* provided with the first discharge path restricting part 16 is arranged in contact with the electrically conductive plate 19, and is welded to the electrically conductive plate 19, so as to integrate the electrically conductive plate 19 and the first discharge path restricting part 16 with each other.

Here, the first discharge path restricting part 16 and the second discharge path restricting part 12 are separated from each other with a gap G therebetween for electric insulation. Further, for making this insulation reliable, the first discharge path restricting part 16 and the third support part 14 are separated from each other. This is used for aggressively attaching metal evaporated products, among sputtered products and evaporated products generated from the first discharge path restricting part 16 and second discharge path restricting part 12 at a high temperature during operation of the lamp, to the wall face of the loading port 17. Namely, the first discharge path restricting part 16 and the third support part 14 are separated from each other, so as to increase the area to which evaporated products attach, thereby making it difficult for the first discharge path restricting part 16 and second discharge path restricting part 12 to short-circuit.

Also, the wall face of the funnel part 18*a* is processed into a mirror surface. In this case, the wall face may be finished into a mirror surface by polishing a single material (or alloy) such as tungsten, molybdenum, palladium, nickel, titanium, gold, silver, or platinum; or by using the above-mentioned single material or alloy as a matrix or ceramics as a matrix, and coating the material by plating, vapor deposition processing, or the like. As a consequence, the light emitted by an arc ball can be reflected by the mirror surface of the funnel part 18*a*, so as to be converged toward the light exit window 4, thereby improving the luminance of light.

Figure 8:
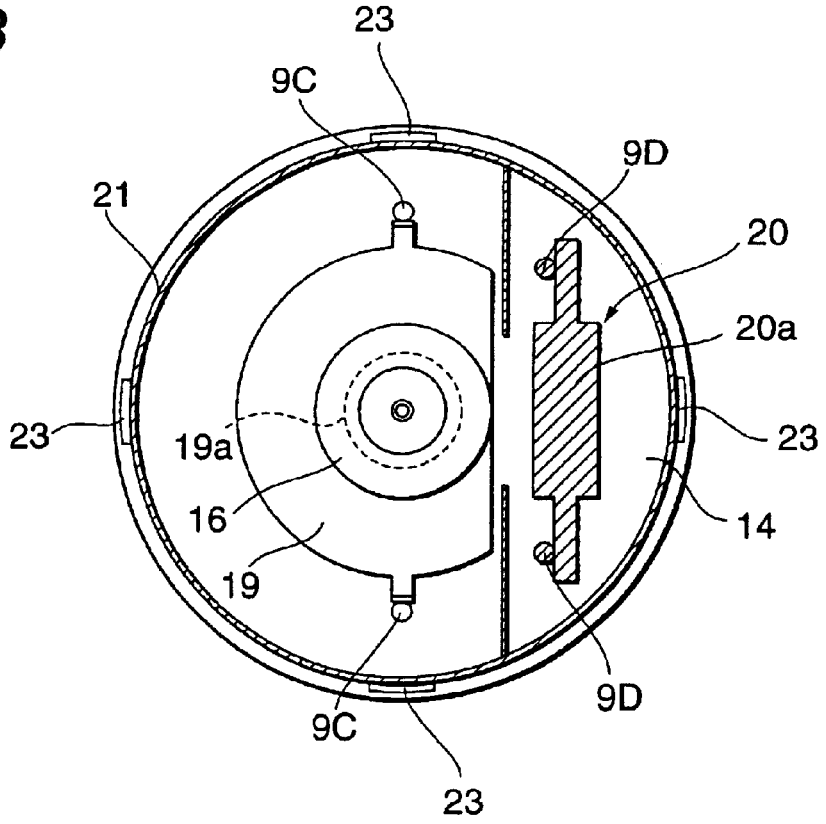
FIG. 8 is a sectional view taken along the line III—III of FIG. 1.

As shown in FIGS. 1 and 8, a cathode part 20 is disposed in the light emitter assembly 6 at a position on the light exit window 4 side deviated from the optical path, whereas both ends of the cathode part 20 are electrically connected to respective leading end parts of cathode part stem pins (second stem pins) 9D raised from the stem 5 so as to penetrate through the support parts 7, 10, 14. The cathode part 20 generates thermoelectrons. Specifically, the cathode part 20 has a coil part 20*a* made of tungsten, extending in parallel with the light exit window 4, for generating thermoelectrons.

Further, the cathode part 20 is accommodated within a cap-shaped front cover 21 made of a metal. The front cover 21 is secured when a nail 21*a* provided therewith is inserted into a slit 23 formed in the third support part 14 and then bent. The front cover 21 is formed with a circular light transmission port 21*b* at a part facing the light exit window 4.

Further, within the front cover 21, a discharge straightening plate 22 is disposed at a position deviated from the optical path between the cathode part 20 and the first discharge path restricting part 16. An electron release window 22*a* of the discharge straightening plate 22 is formed as a rectangular aperture for transmitting thermoelectrons therethrough. A leg 22*b* provided with the discharge straightening plate 22 is mounted on the upper face of the third support part 14 whereas rivets 24 are inserted into the support part 14 from the leg 22*b*, whereby the discharge straightening plate 22 is secured (see FIG. 7). Thus, the cathode part 20 is surrounded by the front cover 21 and the discharge straightening plate 22, so that the sputtered products or evaporated products emitted from the cathode part 20 do not attach to the light exit window 4.

While the light emitter assembly 6 having such a configuration is disposed within the hermetic envelope 2, an exhaust pipe 26 made of glass is integrally formed with the stem 5 of the hermetic envelope 2 at the center thereof, since it is necessary for the hermetic envelope 2 to be filled with a deuterium gas at several hundred Pa. In the final assembling step, the discharge pipe 26 is used for evacuating the hermetic envelope 2 of air once and then appropriately filling it with a deuterium gas at a predetermined pressure, and is sealed by fusion thereafter. Other examples of the gas discharge tube 1 include those encapsulating rare gases such as helium and neon therein.

Further, as shown in FIGS. 1 to 3, eight stem pins 9A to 9D raised from the stem 5 are surrounded by electrically insulating tubes 27A to 27D made of ceramics, so as not to be exposed between the stem 5 and the support part 7, thereby preventing discharge from occurring between the stem pins 9A to 9D. The leading ends of the tubes 27A, 27B, 27C are inserted into the first support part 7 from the lower face side so as to support it from thereunder, whereas the tubes 27D are inserted into the third support part 14 from the lower face side so as to support it from thereunder. Thus, the light emitter assembly 6 is held by the tubes 27A to 27D as well, which contributes to improving the vibration resistance of the lamp.

Such a gas discharge tube 1 has a structure for enhancing its luminance, so that it can easily cause the apertures 18, 13 of the first and second discharge path restricting parts 16, 12 to further reduce their areas while keeping the startability favorable without remarkably raising voltage at the time when the lamp starts operating. Further, since the eight pins 9A to 9D are raised from the stem 5, the gas discharge tube 1 can supply power to each component in the light emitter assembly 6, while making it easy to hold the light emitter assembly 6, whereby a floating structure for the light emitter assembly 6 is easily produced within the hermetic envelope 2.

Operations of the above-mentioned head-on type deuterium discharge tube 1 will now be explained.

First, in a period of about 20 seconds before discharge, a power of about 10 W is supplied from an external power supply to the cathode part 20 by way of the stem pins 9D, so as to preheat the coil part 20*a* of the cathode part 20. Thereafter, a voltage of about 160 V is applied between the cathode part 20 and the anode plate 8, so as to prepare for arc discharge.

After the preparation is done, a trigger voltage of about 350 V is applied from an external power supply to the second discharge path restricting plate 12 by way of the stem pins 9B. Here, the first discharge path restricting part 16 keeps its no power supply state. As a consequence, discharge successively occurs between the cathode part 20 and the second discharge path restricting part 12 and between the cathode part 20 and the anode part 8. When such stepwise discharge is aggressively produced, reliable starting discharge occurs between the cathode part 20 and anode part 8 even when the discharge path is narrowed by the aperture 18 having a diameter of 0.2 mm.

When such starting discharge occurs, arc discharge is maintained between the cathode part 20 and the anode part 8, whereby an arc ball is generated within each of the apertures 13, 18 narrowing the discharge path. UV rays taken out of the arc balls are transmitted through the light exit window 4, so as to be released to the outside as light having a very high luminance. An experiment has verified that the above-mentioned deuterium lamp 1 attains a luminance which is nearly six times that of a conventional deuterium lamp having an aperture with a diameter of 1 mm.

In the above-mentioned explanation of operations, the first stem pins 9C are utilized for holding the light emitter assembly 6 but not for supplying power to the first discharge path restricting part 16. However, the first stem pins 9C may be supplied with power from the outside at the time when the lamp starts operating. In this case, a higher voltage is supplied to the second discharge path restricting plate 12 than to the first discharge path restricting part 16. For example, when a voltage of 120 V is applied to the second discharge path restricting part 12, a voltage of 100 V is applied to the first discharge path restricting part 16. Applying different voltages to the first discharge path restricting part 16 and second discharge path restricting part 12 as such is advantageous when generating an electric field between the first discharge path restricting part 16 and second discharge path restricting part 12, so as to aggressively move electrons from near the first discharge path restricting part 16 to the second discharge path restricting part 12.

Namely, the above-mentioned gas discharge tube comprises at least two electrically conductive aperture members (apertures) 16, 12 disposed within the thermoelectron transmission path between the cathode 20 and anode 8, and the insulator 14 for electrically insulating the electrically conductive aperture members 16, 12 from each other. The electrically conductive aperture members 16, 12 can be provided with potentials independent from each other. Using such a configuration can enhance the startability of light emission and enables light emission with a high luminance. These characteristics improve remarkably in particular when the aperture area of the electrically conductive aperture member on the downstream side in the thermoelectron transmission path is set favorably.

Other embodiments of the gas discharge tube will now be explained only in terms of their substantial differences from the first embodiment, while constituent parts identical or equivalent to those of the first embodiment will be referred to with numerals identical thereto without repeating their descriptions.

(Second Embodiment)

Figure 11:
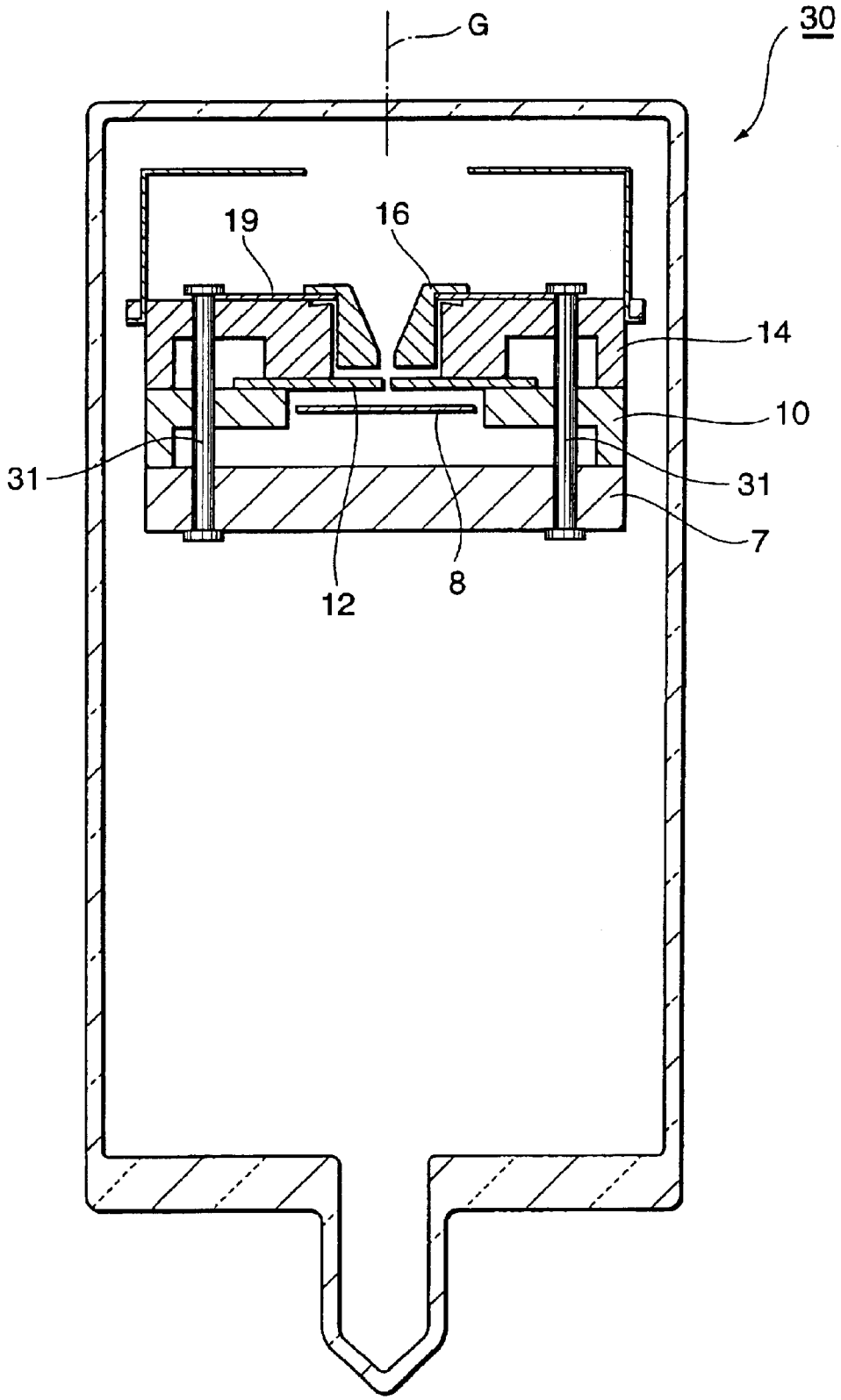
FIG. 11 is a sectional view showing a second embodiment of the gas discharge tube in accordance with the present invention.

As shown in FIG. 11, in a gas discharge tube 30, the first support part 7, second support part 10, and third support part 14 are integrated together with rivets 31 made of a metal which are inserted along the tube axis G. This gas discharge tube 30 does not employ the first stem pins 9C, so that the first stem pins 9C do not project from the stem 5, whereby the number of stem pins projecting from the stem 5 is 6. Therefore, whether power is supplied to the first discharge path restricting part 16 or not can easily be determined according to the number of projecting stem pins at the time of replacing the lamp. Decreasing the number of stem pins can enhance the strength against the thermal expansion occurring in fused parts of stem pins during operation of the lamp.

(Third Embodiment)

Figure 12:
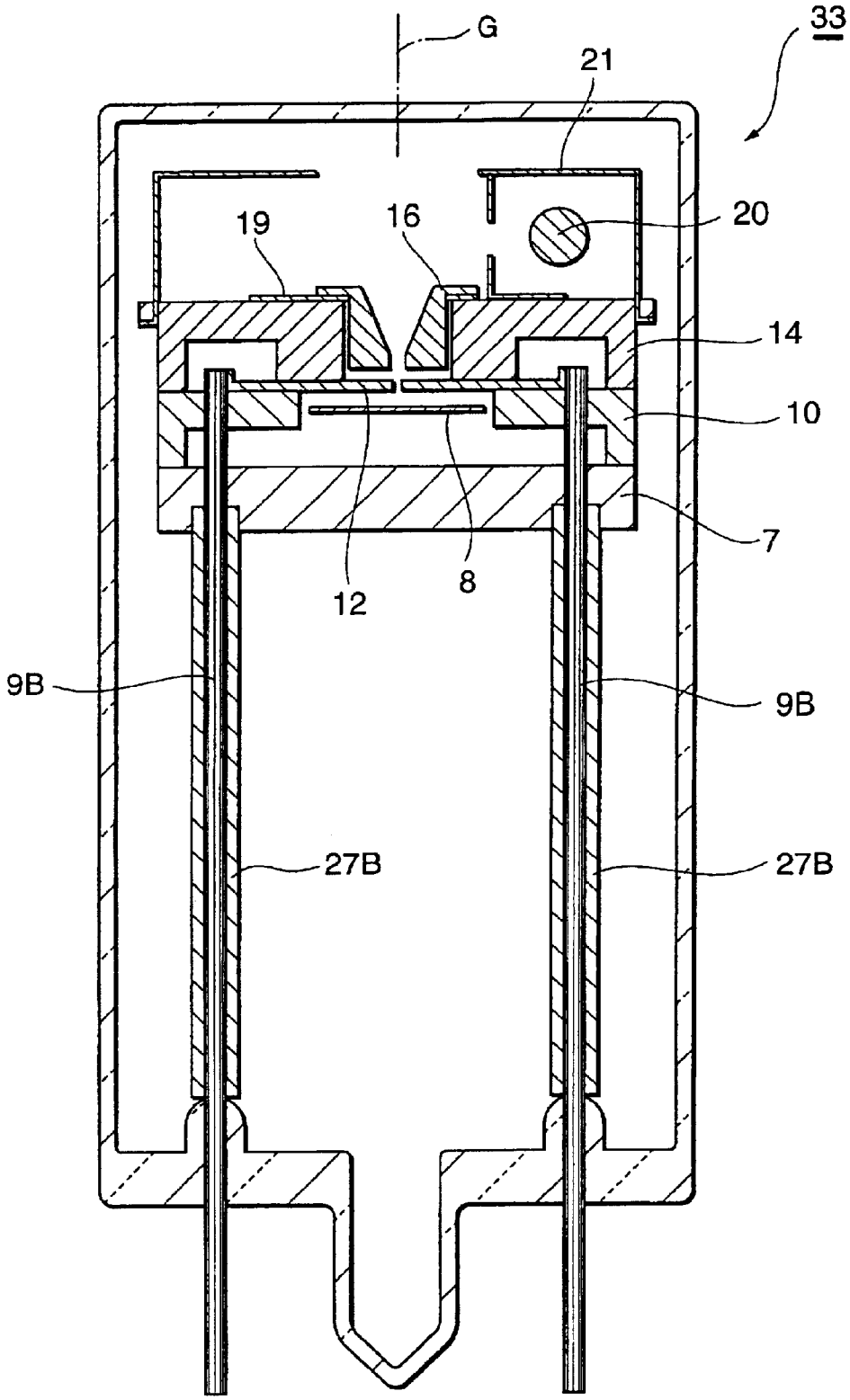
FIG. 12 is a sectional view showing a third embodiment of the gas discharge tube in accordance with the present invention.
Figure 13:
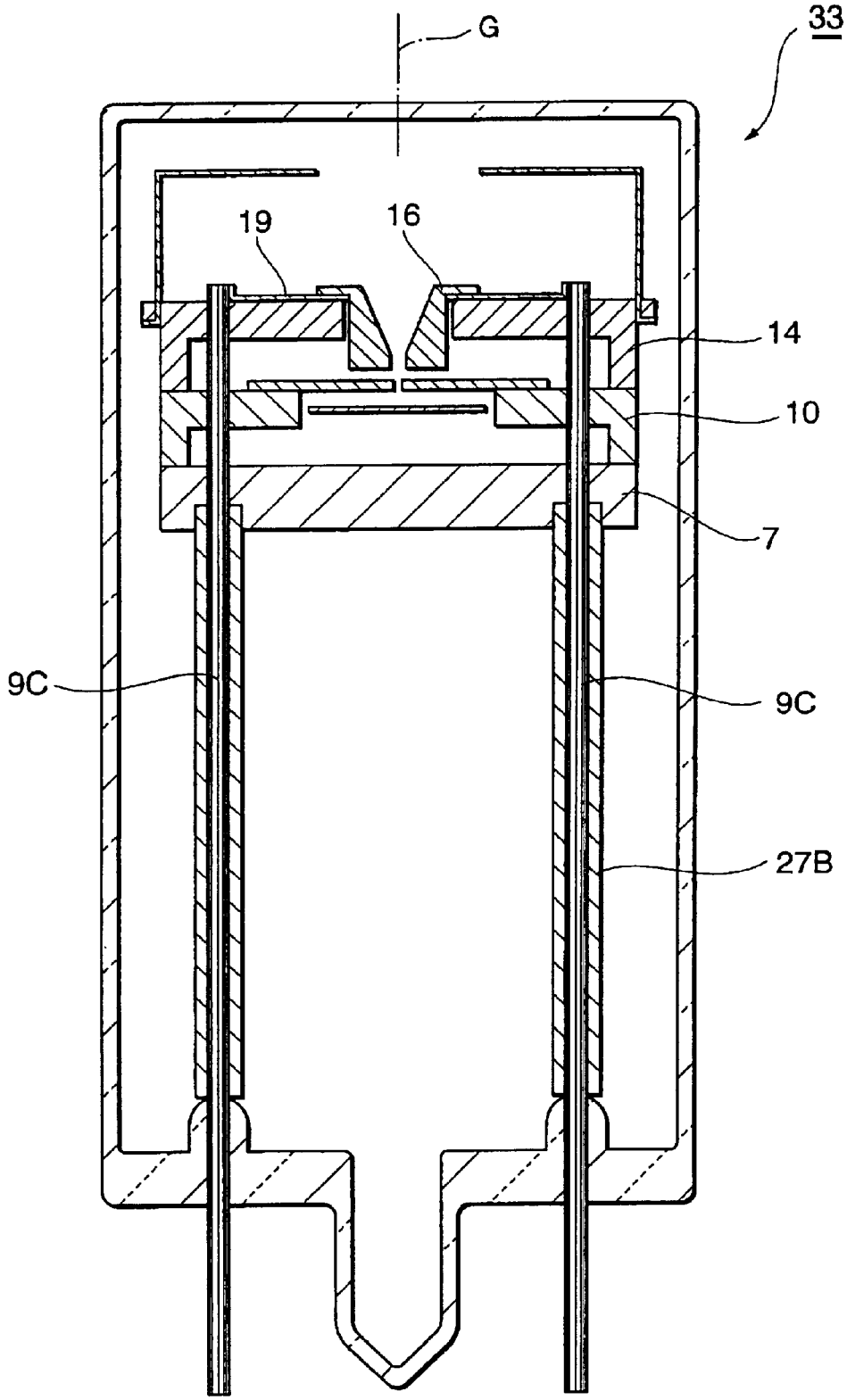
FIG. 13 is a sectional view of the gas discharge tube shown in FIG. 12.

As shown in FIGS. 12 and 13, in a gas discharge tube 33, the second discharge path restricting plate 12 is mounted on the second support part 10 while being simply welded to the leading ends of the stem pins 9B without being held and secured between the second support part 10 and third support part 14. This can increase heat dissipation from the first discharge path restricting part 16 and second discharge path restricting plate 12, decrease the sputtered products and evaporated products in the first discharge path restricting part 16 and second discharge path restricting plate 12, and stably maintain lamp characteristics for a long period.

(Fourth Embodiment)

Figure 14:
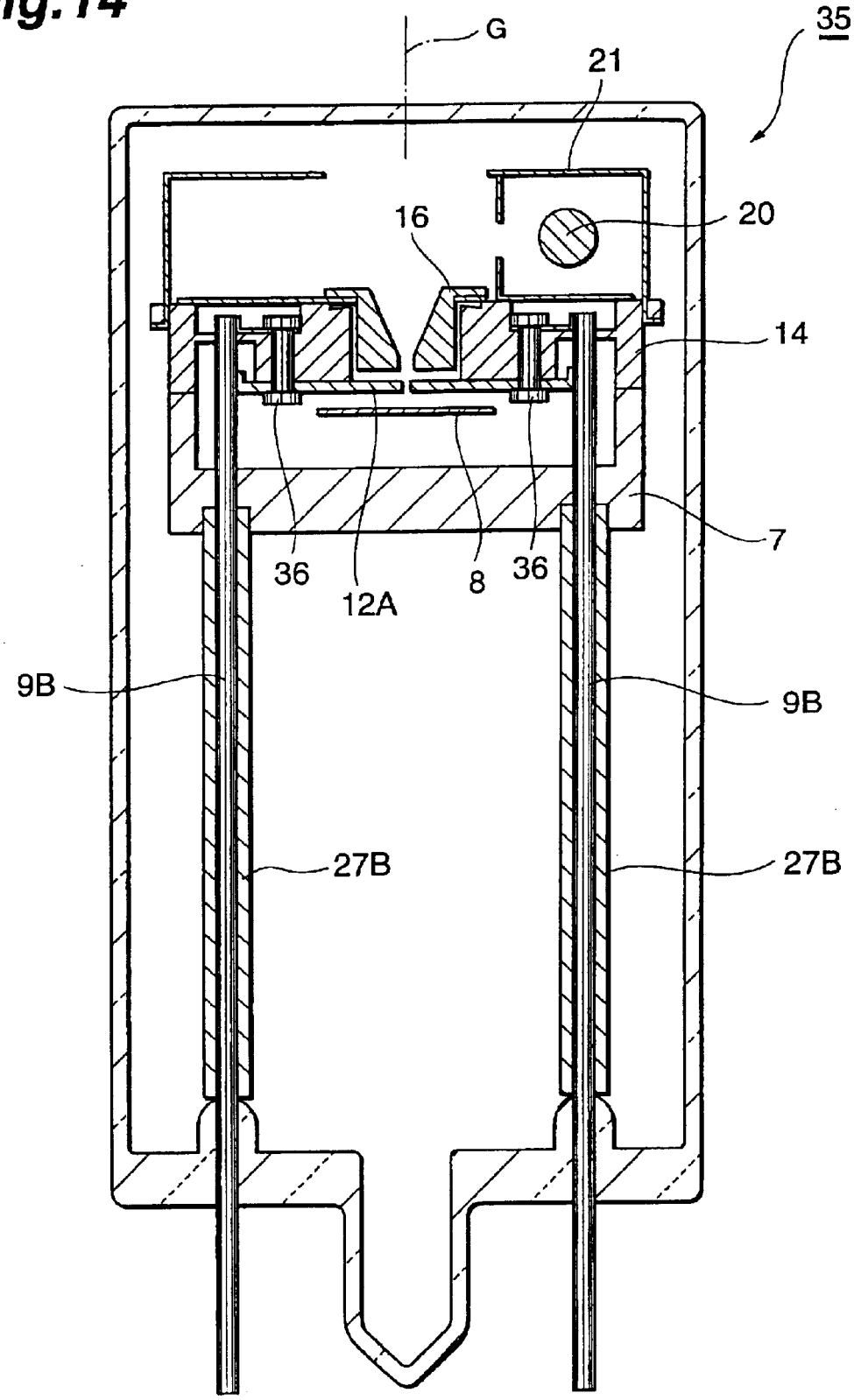
FIG. 14 is a sectional view showing a fourth embodiment of the gas discharge tube in accordance with the present invention.
Figure 15:
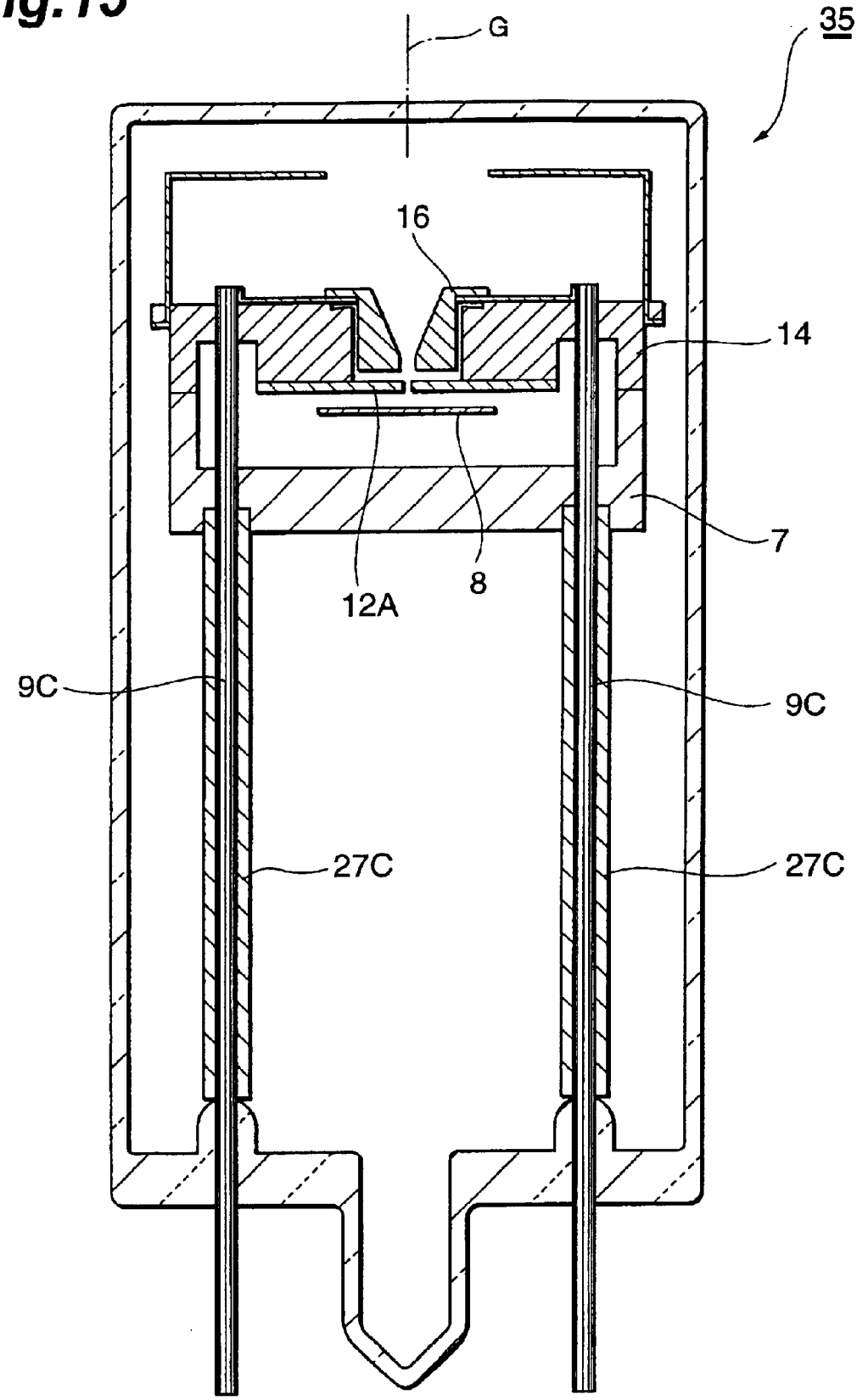
FIG. 15 is a sectional view of the gas discharge tube shown in FIG. 14.

As shown in FIGS. 14 and 15, in a gas discharge tube 35, a second discharge path restricting plate 12A is arranged in contact with the rear face of an electrically insulating part (third support part) 14, and is secured to the electrically insulating part 14 with rivets 36 made of a metal. This integrates the electrically insulating part 14 and second discharge path restricting plate 12A together. During an assembling operation, the rivets 36 are electrically connected to the leading ends of the stem pins 9B. Such a configuration can eliminate the second support part 10 made of ceramics, whereby the number of support parts can be reduced from 3 to 2. It can also increase heat dissipation from the second discharge path restricting plate 12A and anode plate 8, decrease the sputtered products and evaporated products in the second discharge path restricting plate 12A and anode plate 8, and stably maintain lamp characteristics for a long period.

(Fifth Embodiment)

Figure 16:
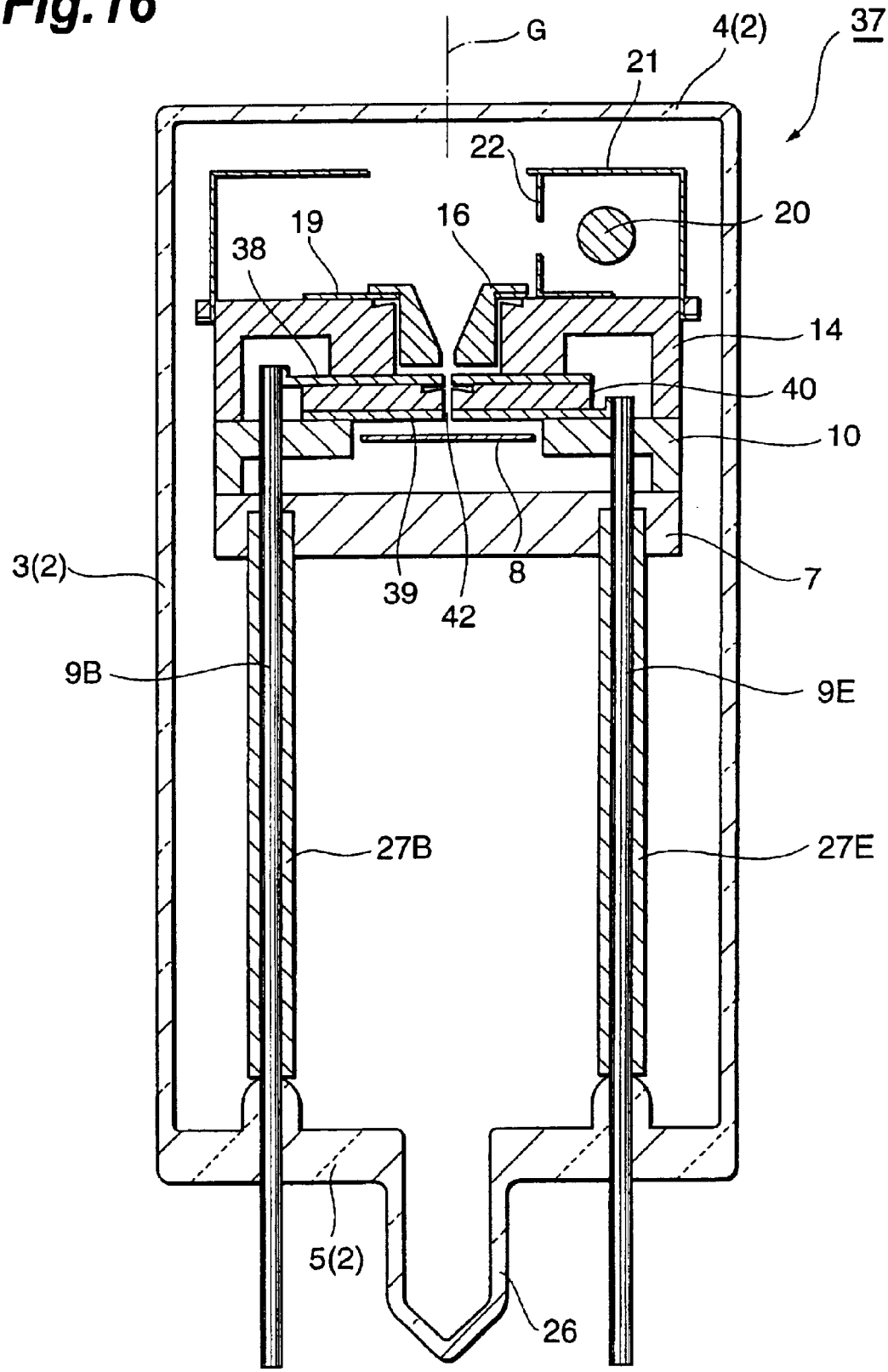
FIG. 16 is a sectional view showing a fifth embodiment of the gas discharge tube in accordance with the present invention.
Figure 17:
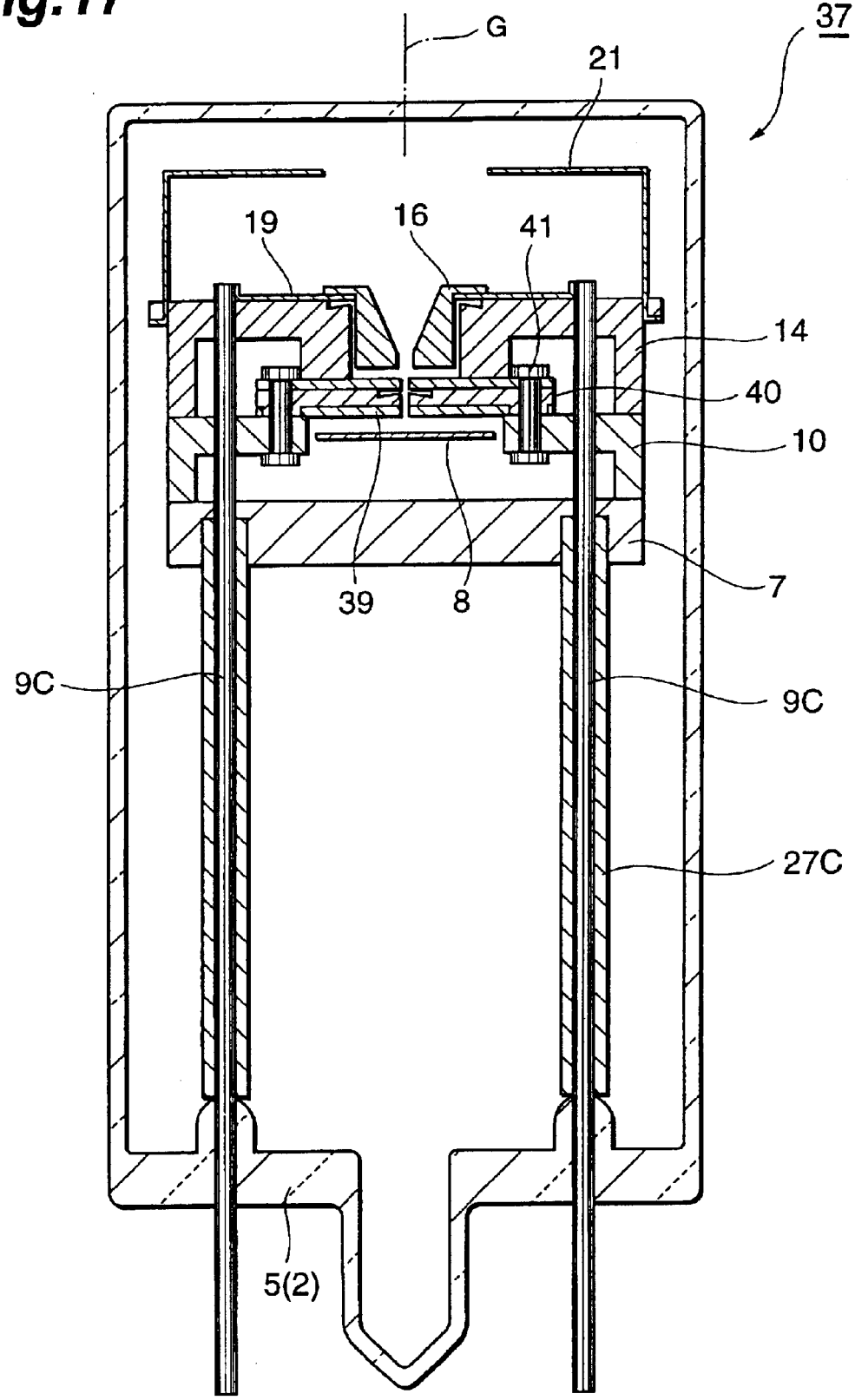
FIG. 17 is a sectional view of the gas discharge tube shown in FIG. 16.
Figure 18:
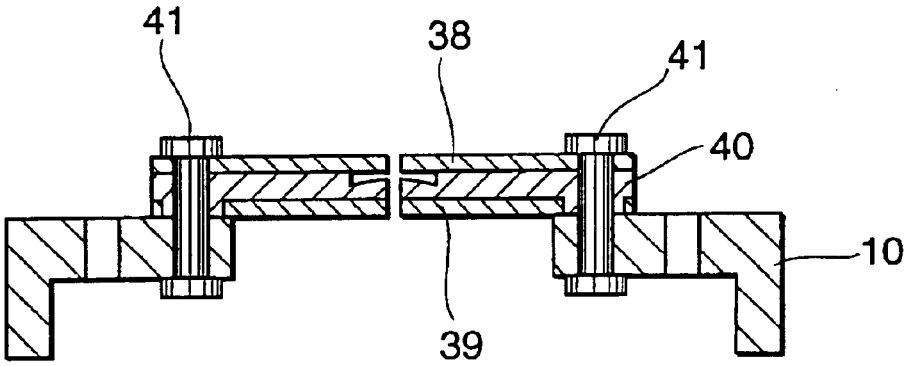
FIG. 18 is a partly enlarged sectional view of the gas discharge tube shown in FIG. 17.

As shown in FIGS. 16, 17, and 18, in a gas discharge tube 37, a disk-shaped spacer 40 made of ceramics is interposed between a disk-shaped second discharge path restricting part 38 and a disk-shaped third discharge path restricting part 39, so as to electrically insulate them from each other. The spacer 40 is secured to the second support part 10 by rivets 41 made of a metal. The second discharge path restricting part 38, third discharge path restricting part 39, and spacer 40 are held and secured between the second support part and third support part 14.

Figure 19:
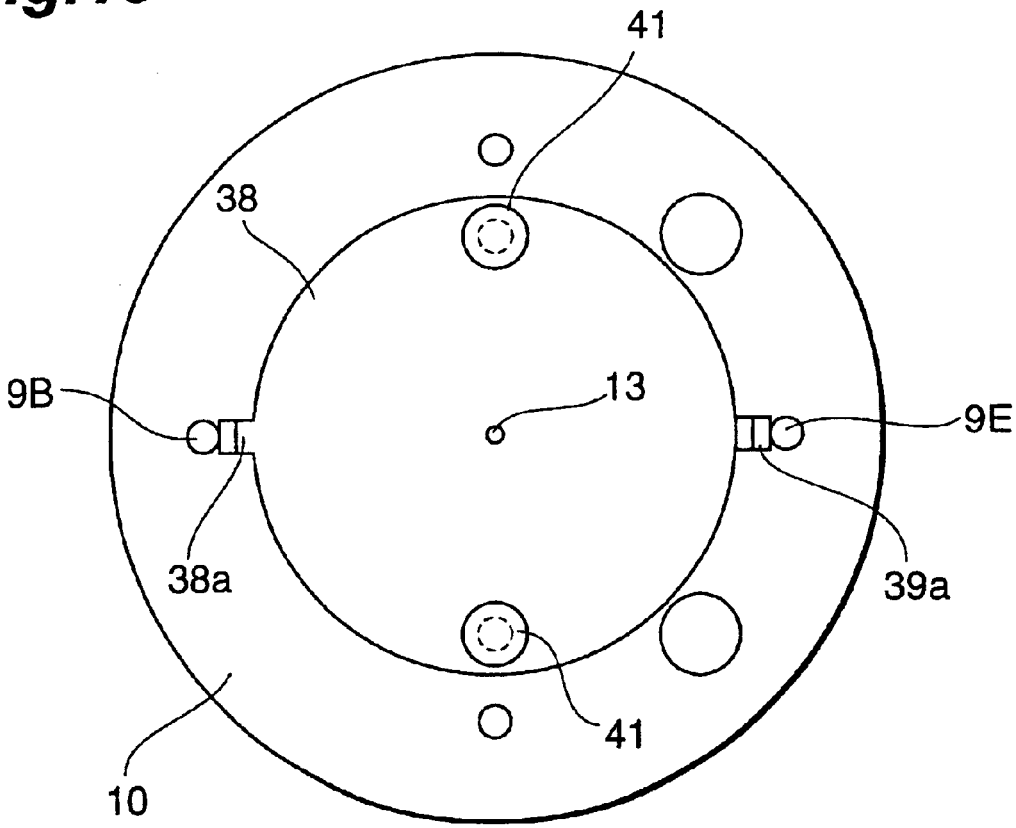
FIG. 19 is a plan view of FIG. 18.

As shown in FIGS. 16 and 19, for applying different potentials to the second discharge path restricting part 38 and third discharge path restricting part 39, respectively, the second discharge path restricting part 38 is electrically connected by way of a lead part 38*a* to the leading end of a fourth stem pin 9B raised from the stem 5. On the other hand, the third discharge path restricting part 39 is electrically connected by way of a lead part 39*a* to a leading end part of a fifth stem pin 9E raised from the stem 5. Here, reference 27E denotes an electrically insulating tube for protecting the stem pin 9E. A higher voltage is applied to the third discharge path restricting part 39 than to the second discharge path restricting part 38. For example, when a voltage of 140 V is applied to the third discharge path restricting part 39, a voltage of 120 V is applied to the second discharge path restricting part 38. Applying different voltages to the second discharge path restricting part 38 and third discharge path restricting part 39 as such is advantageous when generating an electric field between the second discharge path restricting part 38 and third discharge path restricting part 39, so as to aggressively move electrons from near the second discharge path restricting part 38 to the third discharge path restricting part 39.

A third aperture 42 for narrowing the discharge path is formed at the center of the third discharge path restricting part 39. This third aperture 42 may have a diameter identical to or different from that of the second aperture 13 of the second discharge path restricting part 38. When the second aperture 13 is at 0.3 mm, for example, the third aperture 42 having a diameter of 0.1 mm can further narrow the discharge path and achieve a higher luminance.

Figure 20:
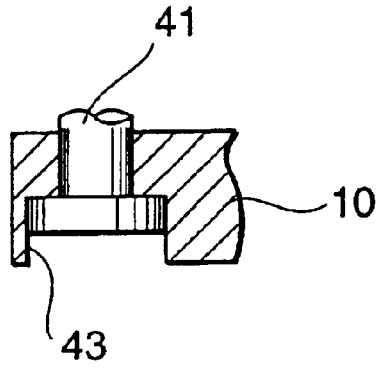
FIG. 20 is a sectional view showing another example of a securing method with a rivet.
Figure 21:
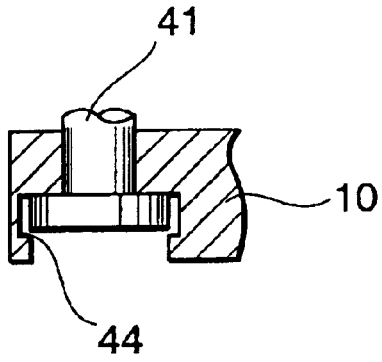
FIG. 21 is a sectional view showing still another example of the securing method with a rivet.
Figure 22:
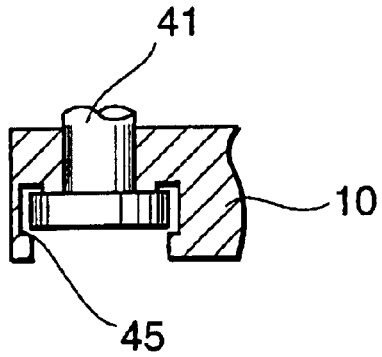
FIG. 22 is a sectional view showing still another example of the securing method with a rivet.

When a rivet 41 attains a high temperature during operation of the lamp, sputtered products and evaporated products are generated from a head part of the rivet 41. Therefore, as shown in FIG. 20, an end part of the rivet 41 is accommodated within a depression 43 formed in the second support part 10, so as to increase the area to which metal evaporated products attach, thereby making it difficult for the second discharge path restricting part 38 and third discharge path restricting part 39 to short-circuit by way of the rivet 41. As shown in FIG. 21, the second support part 10 is formed with a depression 44 for increasing the volume for accommodating the head part of the rivet 41. Also, as shown in FIG. 22, the second support part 10 is formed with a depression 45 for further increasing the volume for accommodating the head part of the rivet 41, whereas the wall face of the depression 45 maximizes the portion separated from the head part.

(Sixth Embodiment)

Figure 23:
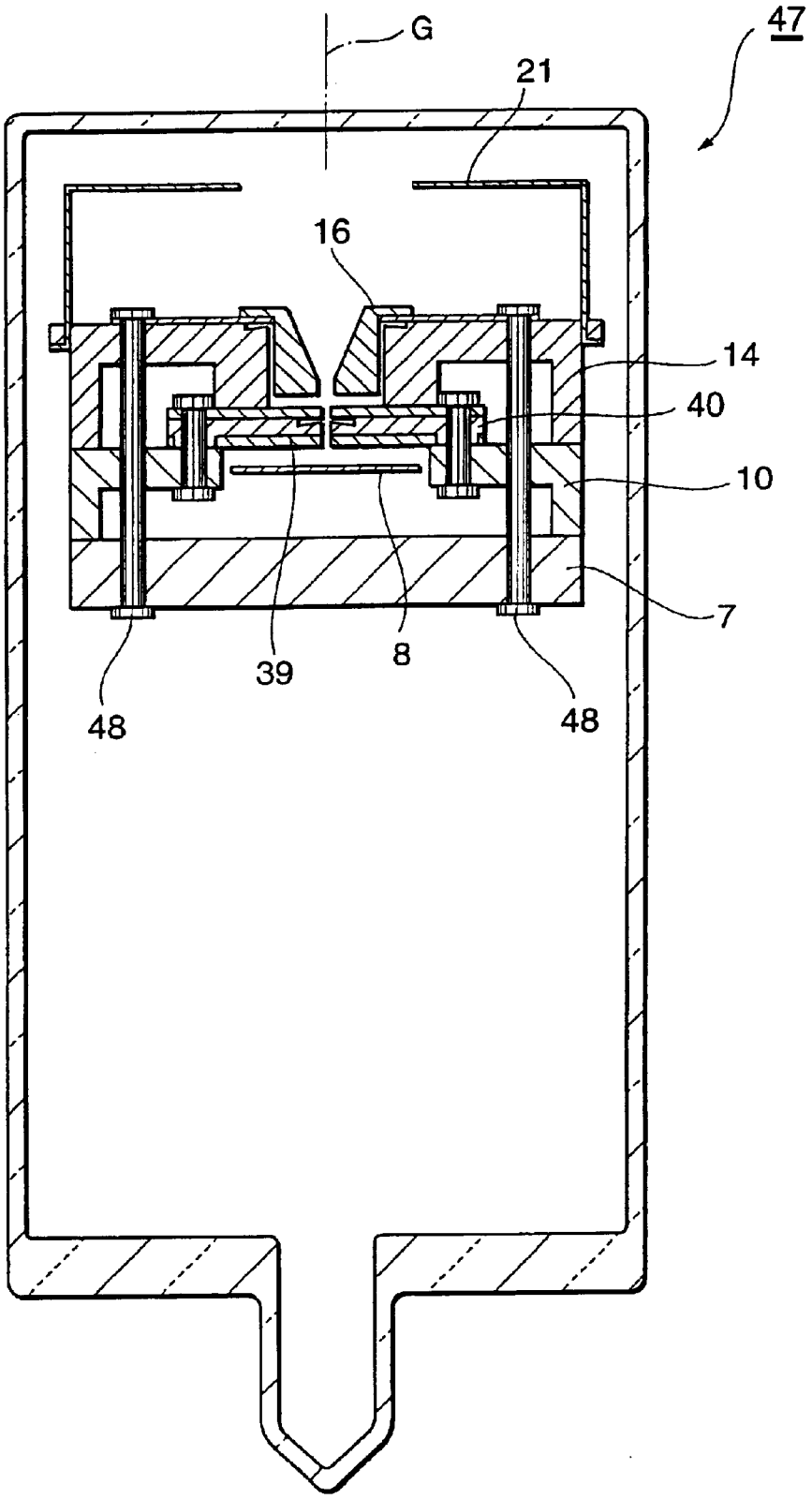
FIG. 23 is a sectional view showing a sixth embodiment of the gas discharge tube in accordance with the present invention.

As shown in FIG. 23, in a gas discharge tube 47, the first support part 7, second support part 10, and third support part 14 are integrated together by rivets 48 made of a metal which are inserted along the tube axis G. This gas discharge tube 47 does not employ the first stem pins 9C, whereby no first stem pins 9C project from the stem 5. This can reliably prevent power from being supplied to the first discharge path restricting part 16, whereas the decrease in the number of stem pins enhances the strength against the thermal expansion occurring in fused parts of stem pins during operation of the lamp. Here, parts substantially common with those in the configuration of the gas discharge tube 37 shown in FIG. 17 are referred to with numerals identical thereto without repeating their overlapping descriptions.

(Seventh Embodiment)

Figure 24:
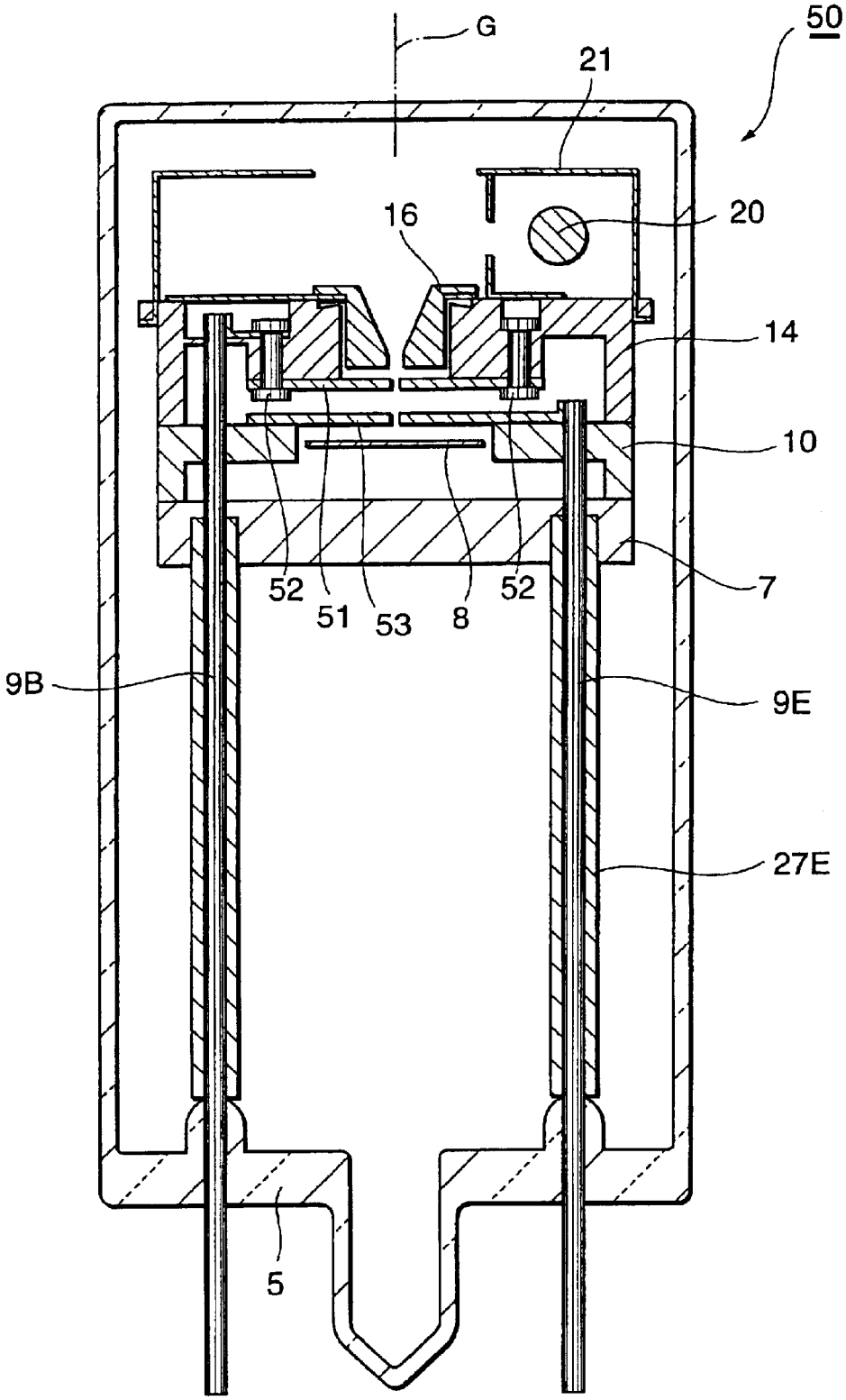
FIG. 24 is a sectional view showing a seventh embodiment of the gas discharge tube in accordance with the present invention.
Figure 25:
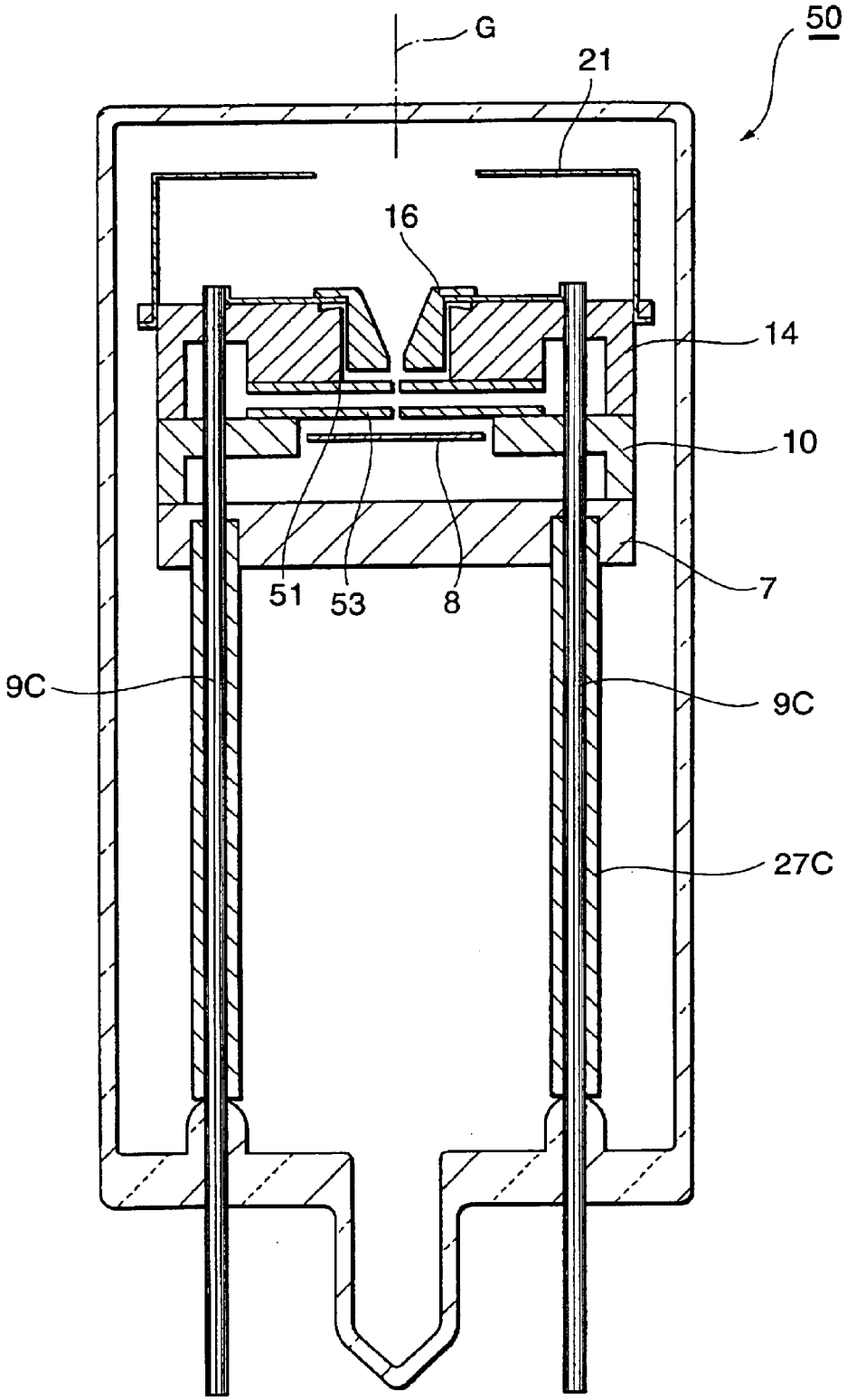
FIG. 25 is a sectional view of the gas discharge tube shown in FIG. 24.

As shown in FIGS. 24 and 25, in a gas discharge tube 50, a second discharge path restricting plate 51 is disposed in contact with the rear face of the electrically insulating part (third support part) 14, and is secured to the electrically insulating part 14 by rivets 52 made of a metal. This integrates the electrically insulating part 14 and second discharge path restricting plate 51 together. Further, a third discharge path restricting part 53 is arranged in contact with the upper face of the second support part 10, whereas the second discharge path restricting part 51 and third discharge path restricting part 53 are separated from each other by a space. The second discharge path restricting part 51 is electrically connected to a fourth stem pin 9B by way of a rivet 52, whereas the third discharge path restricting part 53 is electrically connected to a leading end part of a fifth stem pin 9E raised from the stem 5.

(Eighth Embodiment)

Figure 26:
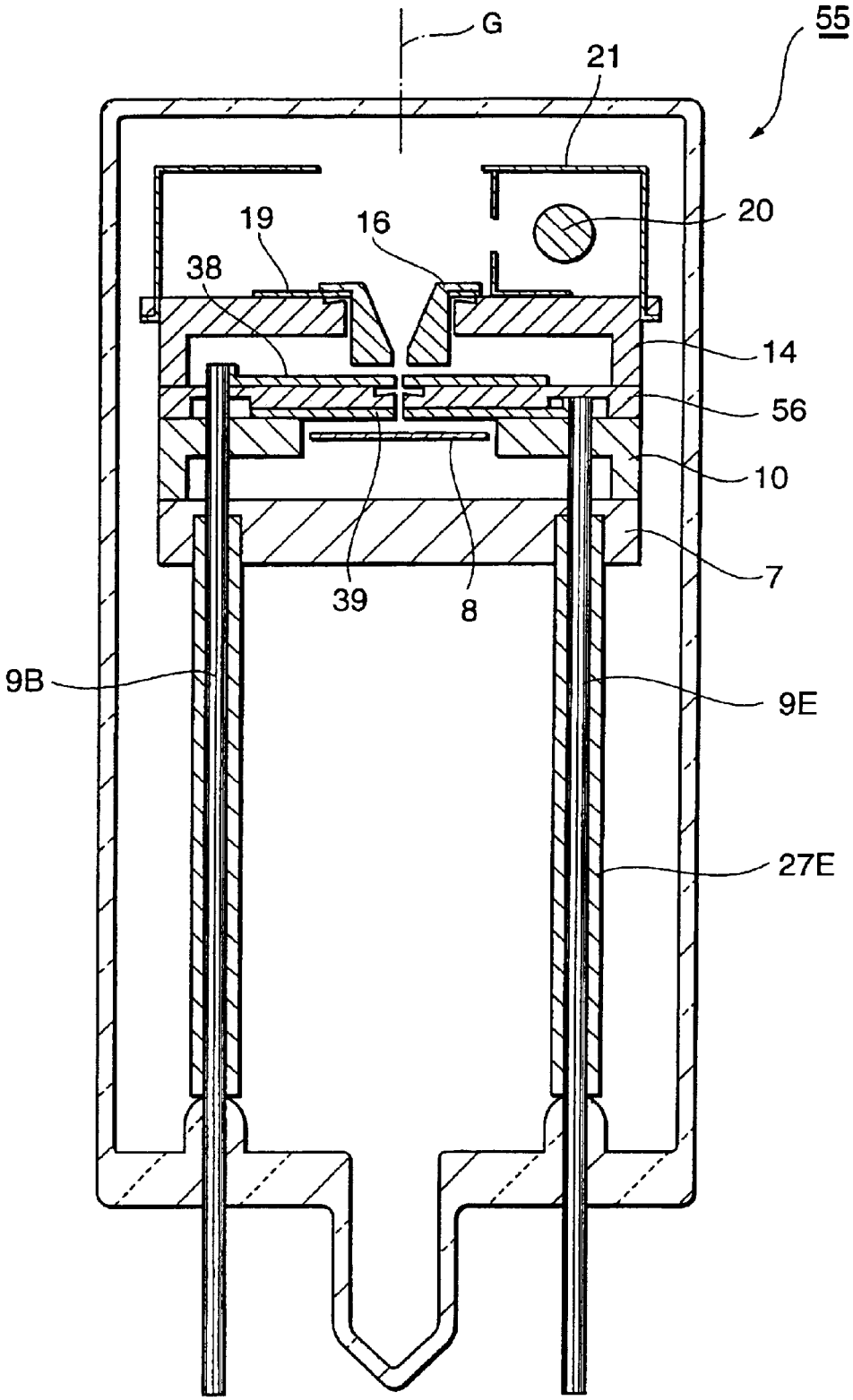
FIG. 26 is a sectional view showing an eighth embodiment of the gas discharge tube in accordance with the present invention.
Figure 27:
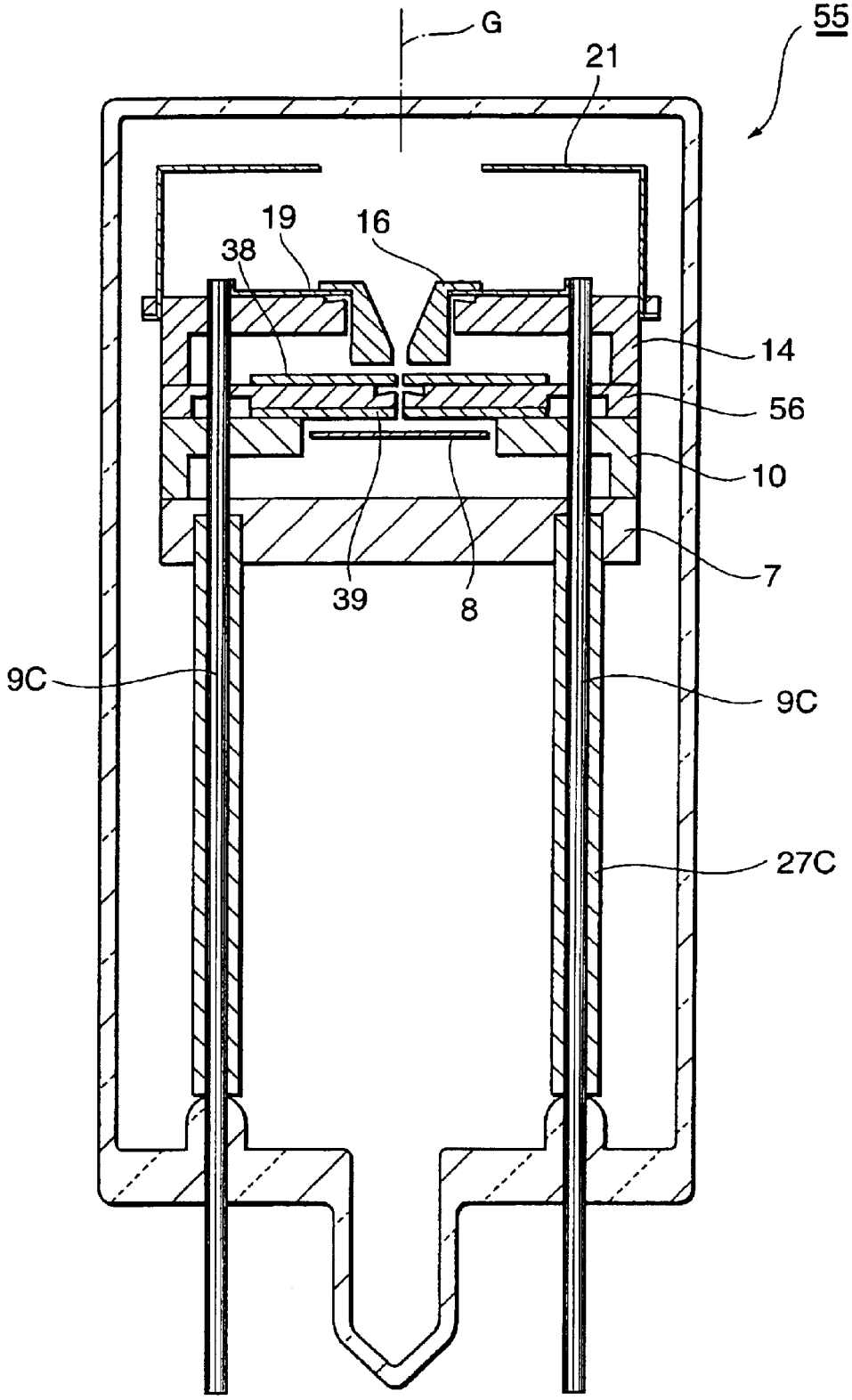
FIG. 27 is a sectional view of the gas discharge tube shown in FIG. 26.

As shown in FIGS. 26 and 27, in a gas discharge tube 55, a disk-shaped spacer 56 made of ceramics is held between the second support part 10 and third support part 14. A second discharge path restricting part 38 is arranged in contact with the upper face of the spacer 56, whereas a third discharge path restricting part 39 is arranged in contact with the rear face and is held and secured between the spacer 56 and the second support part 10. Such a configuration makes it unnecessary to secure the spacer 56 to the second support part 10 with rivets and the like.

(Ninth Embodiment)

Figure 28:
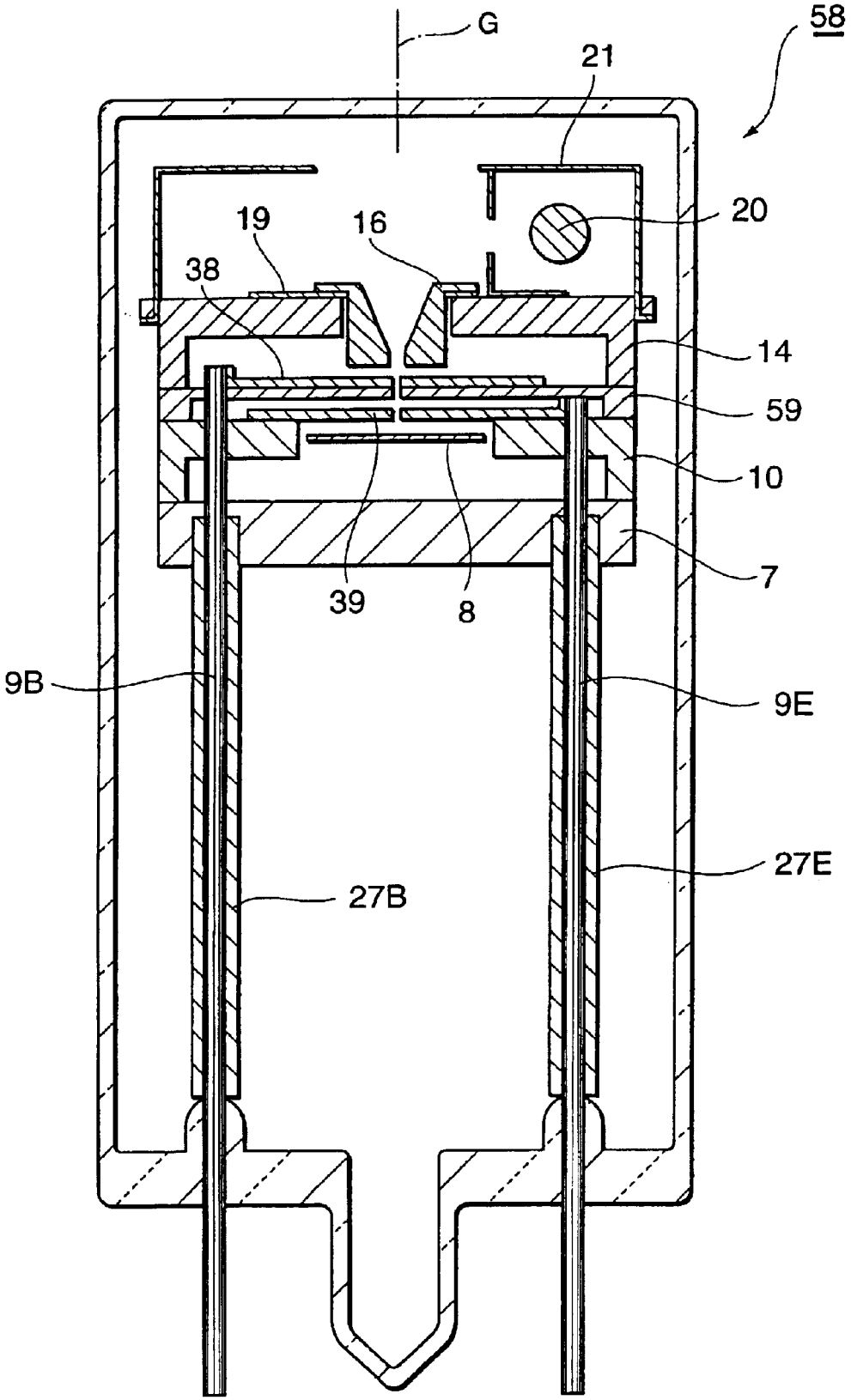
FIG. 28 is a sectional view showing a ninth embodiment of the gas discharge tube in accordance with the present invention.
Figure 29:
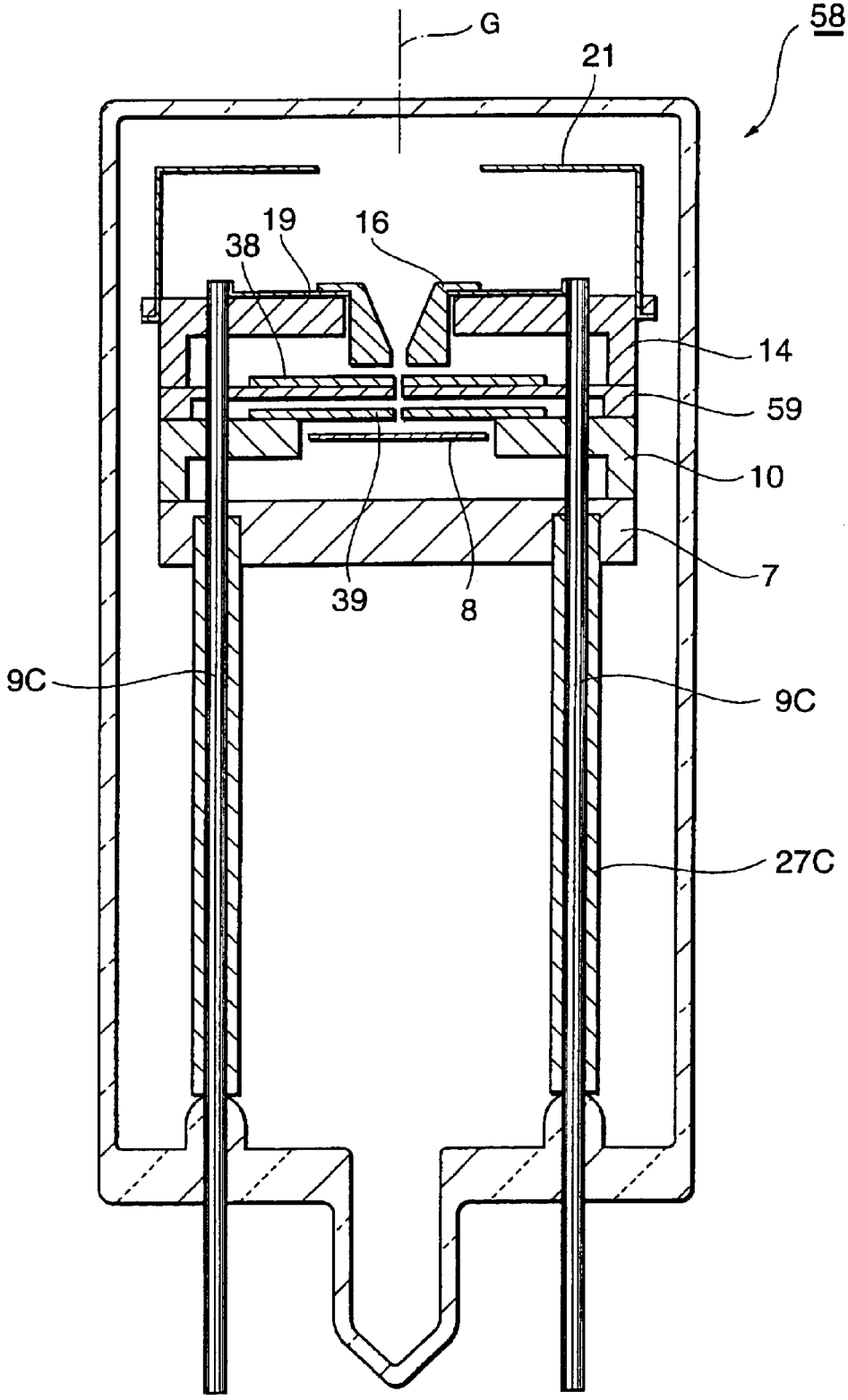
FIG. 29 is a sectional view of the gas discharge tube shown in FIG. 28.

As shown in FIGS. 28 and 29, in a gas discharge tube 58, a disk-shaped spacer 59 made of ceramics is held between the second support part 10 and third support part 14. A second discharge path restricting part 38 is arranged in contact with the upper face of the spacer 59, whereas a third discharge path restricting part 39 is arranged in contact with the upper face of the second support part 10. As a result, the second discharge path restricting part 38 and third discharge path restricting part 39 are separated from each other by way of a space and the spacer 59, thus making it unnecessary to secure the spacer 59 to the second support part 10 with rivets and the like.

(Tenth Embodiment)

Figure 30:
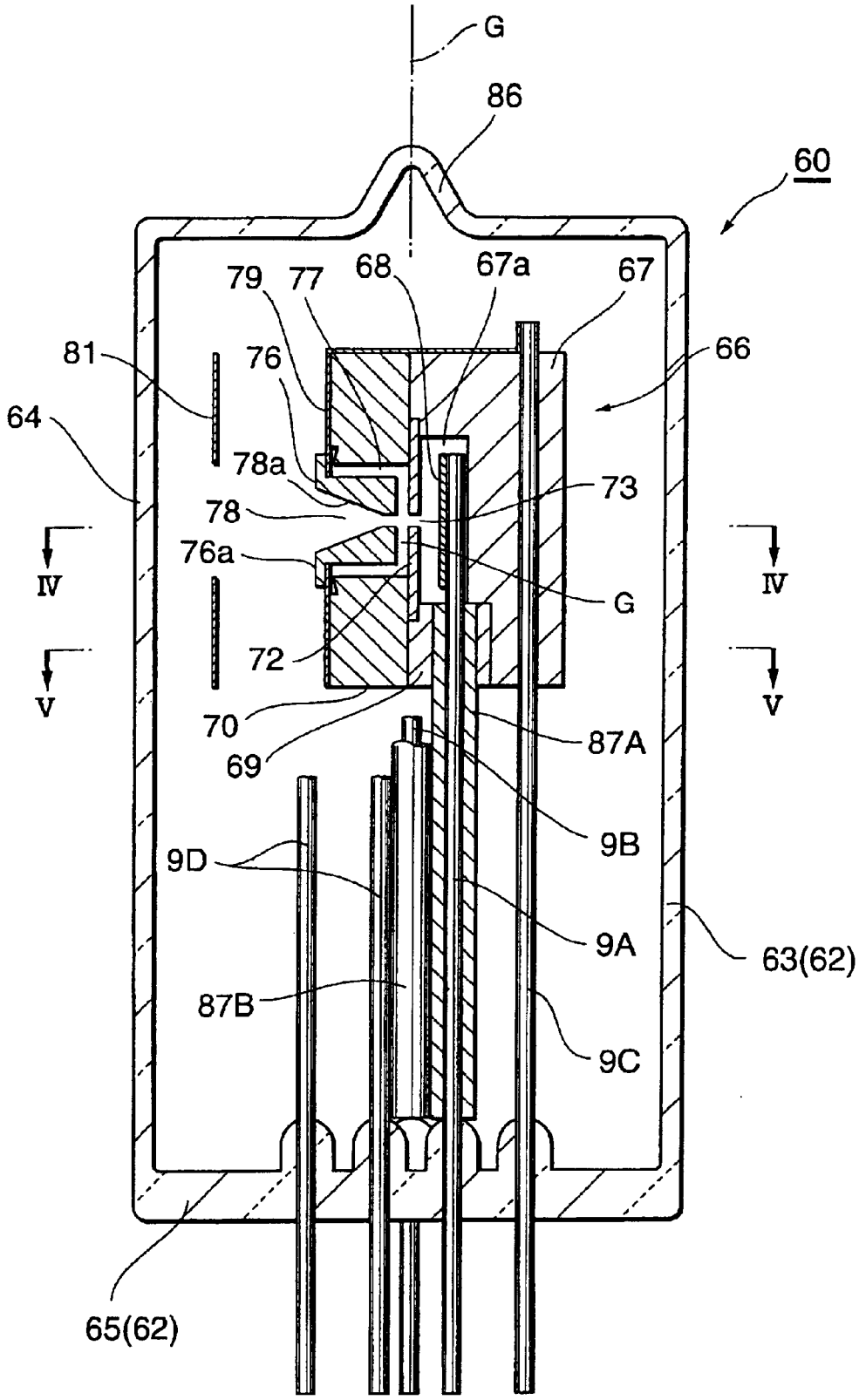
FIG. 30 is a sectional view showing a tenth embodiment of the gas discharge tube in accordance with the present invention.
Figure 31:
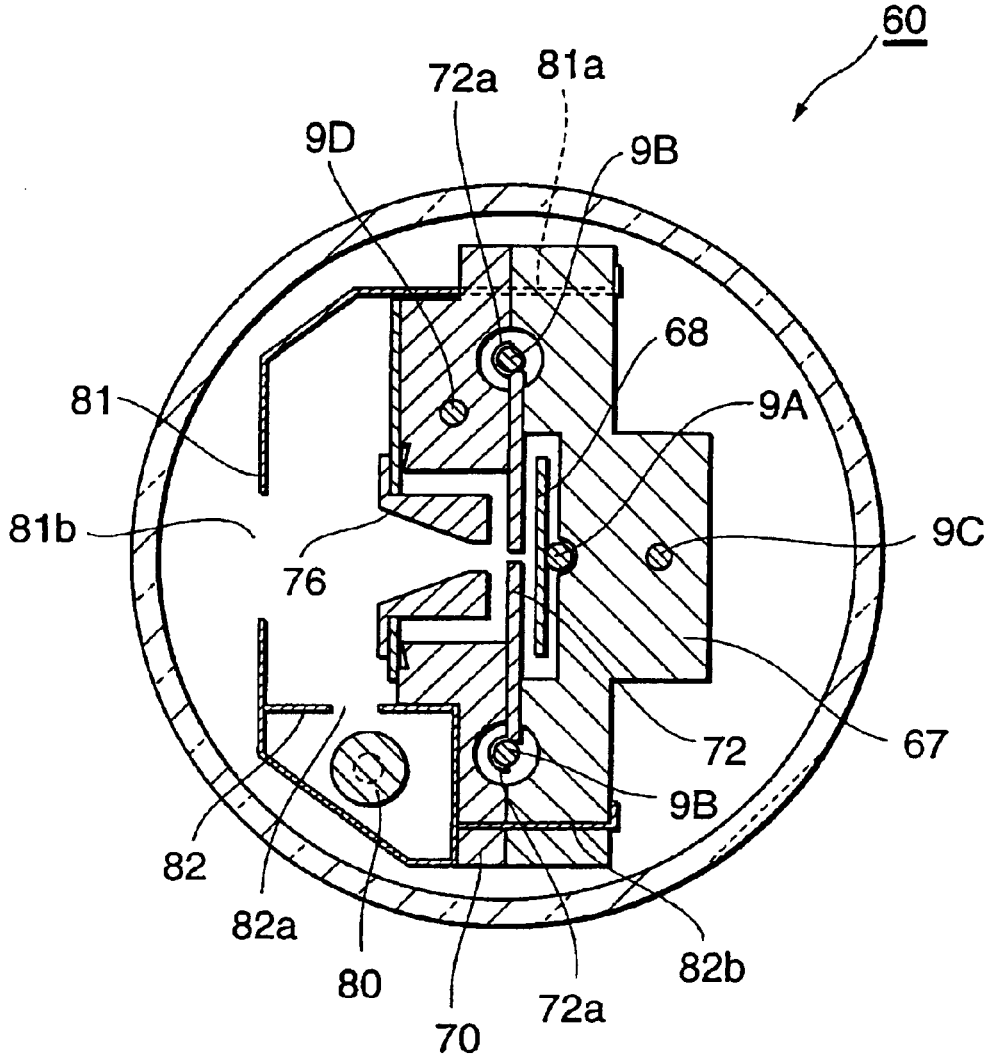
FIG. 31 is a sectional view taken along the line IV—IV of FIG. 30.

A gas discharge tube 60 shown in FIGS. 30 and 31 is a side-on type deuterium lamp 60 having a hermetic envelope 62 made of glass encapsulating a deuterium gas at about several hundred Pa therein. This hermetic envelope 62 comprises a cylindrical side tube 63 having one sealed end side, and a stem 65 for sealing the other end side of the side tube 63, whereas a part of the side tube 63 is utilized as a light exit window 64. Accommodated within the hermetic envelope 62 is a light emitter assembly 66.

The light emitter assembly 66 has an electrically insulating part (first support part) 67 made of electrically insulating ceramics. An anode plate (anode part) 68 is accommodated within a depression 67*a* formed in the front face of the electrically insulating part 67. Electrically connected to the rear face of the anode plate 68 is a leading end part of an anode stem pin (first stem pin) 9A raised from the stem 65 so as to extend along the tube axis G. The first support part 67 is fitted with a loading part 69 made of ceramics through which the first stem pin 9A penetrates.

The light emitter assembly 66 further comprises an electrically insulating part (second support part) 70 made of electrically insulating ceramics. The second support part 70 is secured so as to overlie the first support part 67 in a direction perpendicular to the tube axis G. A planar second discharge path restricting part 72 is held and secured between the front face of the first support part 67 and the rear face of the second support part 70, so that the second discharge path restricting part 72 and the anode plate 68 face each other.

A small hole (second aperture) 73 having a diameter of 0.2 mm for narrowing the discharge path is formed at the center of the second discharge path restricting part 72. Also, the discharge path restricting plate 72 is provided with two lead parts 72*a* on the left and right sides, whereas the lead parts 72*a* are electrically connected to respective leading end parts of discharge path restricting plate stem pins (fourth stem pins) 9B raised from the stem 65.

The second support part 70 is formed with a loading part 77, extending in a direction perpendicular to the tube axis G, for loading a first discharge path restricting part 76 made of an electrically conductive metal (e.g., molybdenum, tungsten, or their alloys) from a side thereof. For narrowing the discharge path, the first discharge path restricting part 76 is formed with a first aperture 78 having a diameter greater than that of the second aperture 73, whereas the first aperture 78 is positioned on the same tube axis G as the second aperture 73.

The first aperture 78 has a funnel part 78*a*, extending in a direction perpendicular to the tube axis G, for producing a favorable arc ball, whereas the funnel part 78*a* tapers down its diameter from the light exit window 64 toward the anode part 68. Specifically, it is formed with a diameter of 3.2 mm on the light exit window 64 side and with a diameter of about 1 mm on the anode part 68 side so as to attain an aperture area greater than that of the second aperture 73. Thus, the discharge path is narrowed by the first aperture 78 and second aperture 73 in cooperation.

Figure 32:
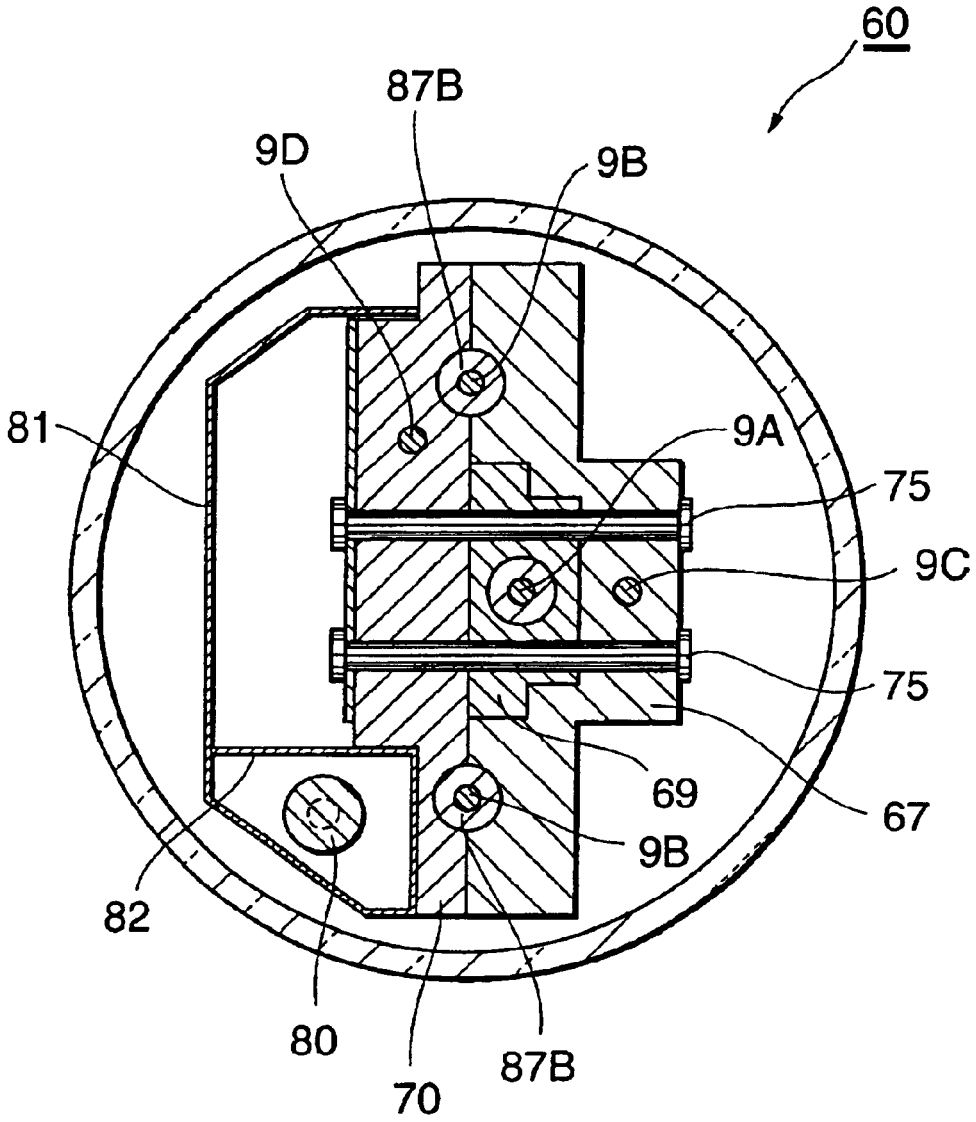
FIG. 32 is a sectional view taken along the line V—V of FIG. 30.

An electrically conductive plate 79 is arranged in contact with the front face of the second support part 70, and is secured with rivets 75 penetrating through the first and second support parts 67, 70 (see FIG. 32). An aperture formed in the electrically conductive plate 79 is aligned with the loading port 77, thus allowing the loading of the first discharge path restricting part 76. The electrically conductive plate 79 extends along the surfaces of first support part 67 and second support part 70 to the rear side, and is electrically connected to a leading end part of a discharge path restricting plate stem pin (third stem pin) 9C raised from the stem 65 so as to penetrate through the first support part 67. A flange part 76*a* provided with the first discharge path restricting part 76 is arranged in contact with the electrically conductive plate 79, and is welded to the electrically conductive plate 79, so as to integrate the electrically conductive plate 79 and the first discharge path restricting part 76 with each other.

Here, the first discharge path restricting part 76 and the second discharge path restricting part 72 are separated from each other with a gap G therebetween for electric insulation. Further, for making this insulation reliable, the first discharge path restricting part 76 and the second support part 70 are separated from each other. This is used for aggressively attaching metal evaporated products, among sputtered products and evaporated products generated from the first discharge path restricting part 76 and second discharge path restricting part 72 at a high temperature during operation of the lamp, to the wall face of the loading port 77. Namely, the first discharge path restricting part 76 and the second support part 70 are separated from each other, so as to increase the area to which evaporated products attach, thereby making it difficult for the first discharge path restricting part 76 and second discharge path restricting part 72 to short-circuit.

Also, the wall face of the funnel part 78*a* is processed into a mirror surface. In this case, the wall face may be finished into a mirror surface by polishing a single material (or alloy) such as tungsten, molybdenum, palladium, nickel, titanium, gold, silver, or platinum; or by using the above-mentioned single material or alloy as a matrix or ceramics as a matrix, and coating the material by plating, vapor deposition processing, or the like. As a consequence, the light emitted by an arc ball is reflected by the mirror surface of the funnel part 78*a*, so as to be converged toward the light exit window 64, whereby the luminance of light is enhanced.

In the light emitter assembly 66, a cathode part 80 is disposed at a position on the light exit window 64 side deviated from the optical path, whereas both ends of the cathode part 80 are electrically connected by way of undepicted connecting pins to respective leading end parts of cathode part stem pins (second stem pins) 9D raised from the stem 65. The cathode part 80 generates thermoelectrons.

Specifically, the cathode part 80 has a coil part made of tungsten, extending along the tube axis G, for generating thermoelectrons.

Further, the cathode part 80 is accommodated within a cap-shaped front cover 81 made of a metal. The front cover 81 is secured when a nail 81*a* provided therewith is inserted into a slit (not depicted) formed in the first support part 67 and then bent. The front cover 81 is formed with a rectangular light transmission port 81*b* at a part facing the light exit window 64.

Further, within the front cover 81, a discharge straightening plate 82 is disposed at a position deviated from the optical path between the cathode part 80 and the first discharge path restricting part 76. An electron release window 82*a* of the discharge straightening plate 82 is formed as a rectangular aperture for transmitting thermoelectrons therethrough.

The discharge straightening plate 82 is secured when a nail 82*b* provided therewith is inserted into a slit (not depicted) formed in the first support part 67 and then bent. Thus, the cathode part 80 is surrounded by the front cover 81 and the discharge straightening plate 82, so that the sputtered products or evaporated products emitted from the cathode part 80 do not attach to the light exit window 64.

While the light emitter assembly 66 having such a configuration is disposed within the hermetic envelope 62, an exhaust pipe 86 made of glass is integrally formed with the hermetic envelope 62, since it is necessary for the hermetic envelope 62 to be filled with a deuterium gas at several hundred Pa. In the final assembling step, the discharge pipe 86 is used for evacuating the hermetic envelope 62 of air once and then appropriately filling it with a deuterium gas at a predetermined pressure, and is sealed by fusion thereafter. Though all the stem pins 9A to 9D raised from the stem 65 may be protected by electrically insulating tubes made of ceramics, at least the step pins 9A and 9B are surrounded with tubes 87A and 87B.

The principle of operations of thus configured side-on type deuterium lamp 60 is the same as that of the above-mentioned head-on type deuterium lamp 1 and thus will not be explained. Here, the first stem pin 9C is utilized for holding the light emitter assembly 66 but not for supplying power to the first discharge path restricting part 76. However, the first stem pin 9C may be supplied with power from the outside at the time when the lamp starts operating. In this case, a higher voltage is supplied to the second discharge path restricting plate 72 than to the first discharge path restricting part 76. For example, when a voltage of 120 V is applied to the second discharge path restricting part 72, a voltage of 100 V is applied to the first discharge path restricting part 76. Applying different voltages to the first discharge path restricting part 76 and second discharge path restricting plate 72 as such is advantageous when generating an electric field between the first discharge path restricting part 76 and second discharge path restricting part 72, so as to aggressively move electrons from near the first discharge path restricting part 76 to the second discharge path restricting part 72.

Other embodiments of the side-on type gas discharge tube will now be explained only in terms of their substantial differences from the tenth embodiment, while constituent parts identical or equivalent to those of the tenth embodiment will be referred to with numerals identical thereto without repeating their descriptions.

(Eleventh Embodiment)

Figure 33:
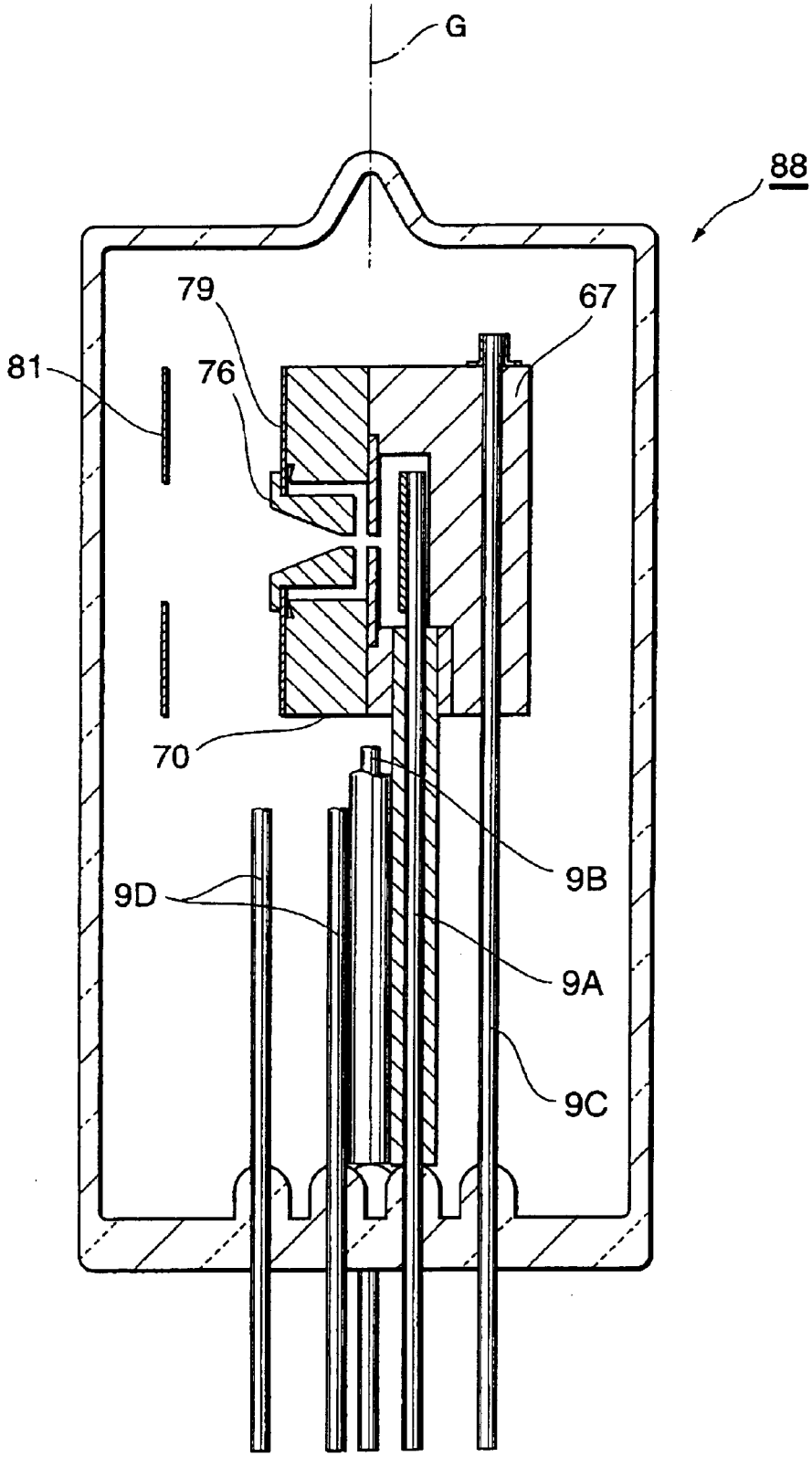
FIG. 33 is a sectional view showing an eleventh embodiment of the gas discharge tube in accordance with the present invention.

As shown in FIG. 33, in a gas discharge tube 88, the electrically conductive plate 79 is unconnected to the first stem pin 9C in order to achieve a state where no power is supplied to the first discharge path restricting part 76. As a consequence, the first discharge path restricting part 76 attains a state electrically unconnected to an external power supply.

(Twelfth Embodiment)

Figure 34:
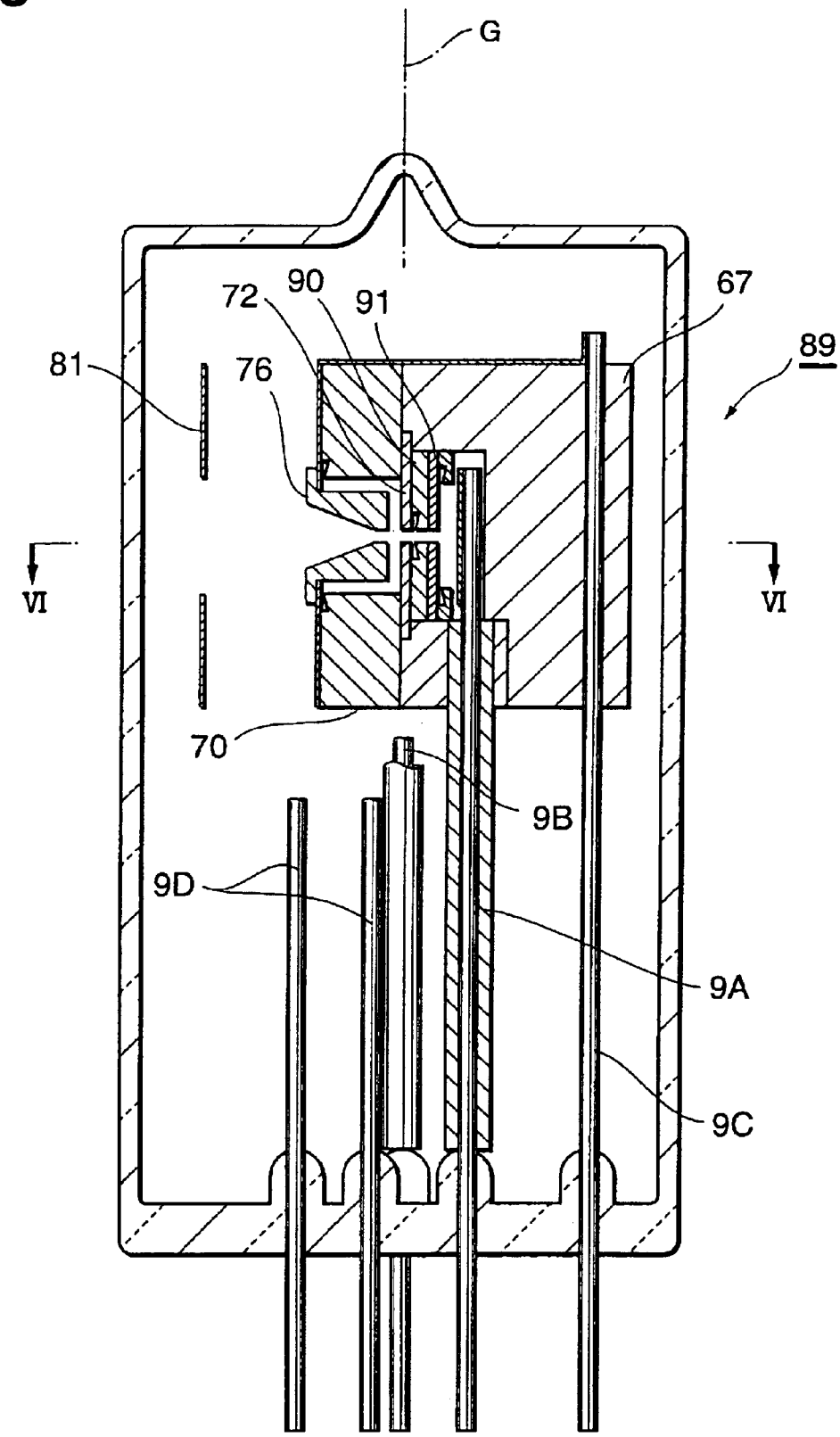
FIG. 34 is a sectional view showing a twelfth embodiment of the gas discharge tube in accordance with the present invention.
Figure 35:
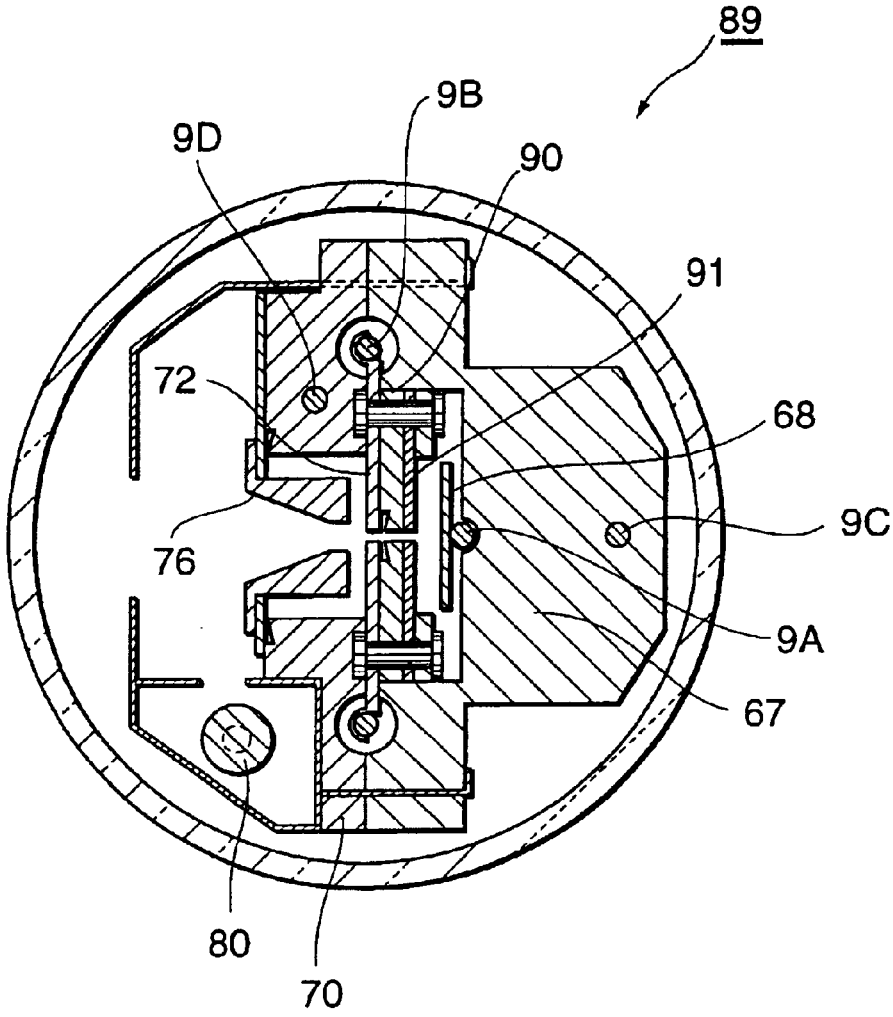
FIG. 35 is a sectional view taken along the line VI—VI of FIG. 34.
Figure 36:
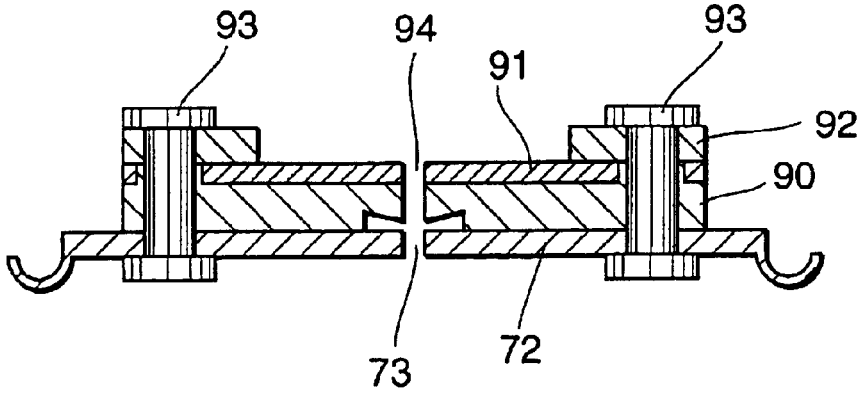
FIG. 36 is a partly enlarged sectional view of the gas discharge tube shown in FIG. 35.

As shown in FIGS. 34, 35, and 36, in a gas discharge tube 89, an electrically insulating spacer 90 made of ceramics is disposed at the rear face of the second discharge path restricting part 72, whereas a third discharge path restricting part 91 is disposed at the rear face of the spacer 90. The third discharge path restricting part 91 is held between the spacer 90 and an electrically insulating plate 92, whereas the second discharge path restricting part 72 and third discharge path restricting part 91 are integrated with each other by rivets 93. The planar second discharge path restricting part 72 is held and secured between the front face of the first support part 67 and the rear face of the second support part 70.

Further, a third aperture 94 for narrowing the discharge path is formed at the center of the third discharge path restricting part 91. This third aperture 94 may have a diameter identical to or different from that of the second aperture 73 of the second discharge path restricting part 72. When the second aperture 73 is at 0.3 mm, for example, the third aperture 72 having a diameter of 0.1 mm can further narrow the discharge path and achieve a higher luminance.

Figure 37:
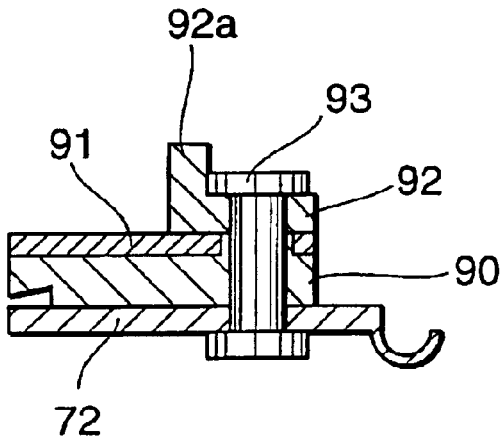
FIG. 37 is a sectional view showing another example of the securing method with a rivet.
Figure 38:
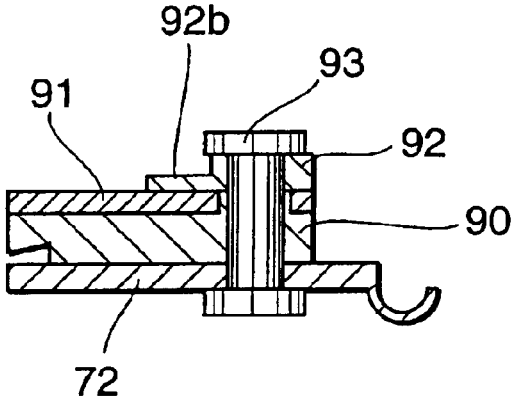
FIG. 38 is a sectional view showing still another example of the securing method with a rivet.
Figure 39:
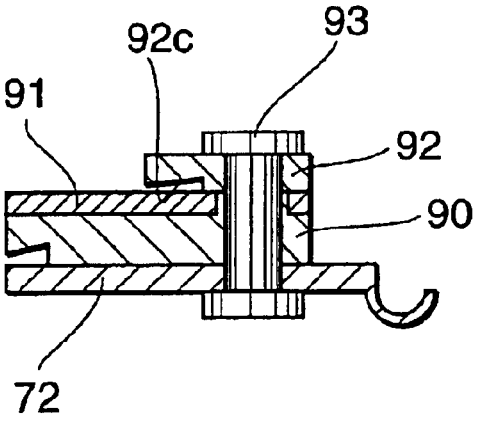
FIG. 39 is a sectional view showing still another example of the securing method with a rivet.

When a rivet 93 attains a high temperature during operation of the lamp, sputtered products are generated from a head part of the rivet 93. Therefore, as shown in FIG. 37, a barrier 92*a* is formed so as to project from the electrically insulating plate 92, thereby making metal evaporated products generated from the rivet 93 hard to attach to the third discharge path restricting part 91, thus making it difficult for the second discharge path restricting part 72 and third discharge path restricting part 91 to short-circuit by way of the rivet 93. Also, as shown in FIG. 38, the surface of the electrically insulating plate 92 is formed with a cutout 92*b*, so as to increase the area to which metal evaporated products attach. Similarly, as shown in FIG. 39, the rear face of the electrically insulating plate 92 is formed with a cutout 92*c*, so as to increase the area to which metal evaporated products attach.

(Thirteenth Embodiment)

Figure 40:
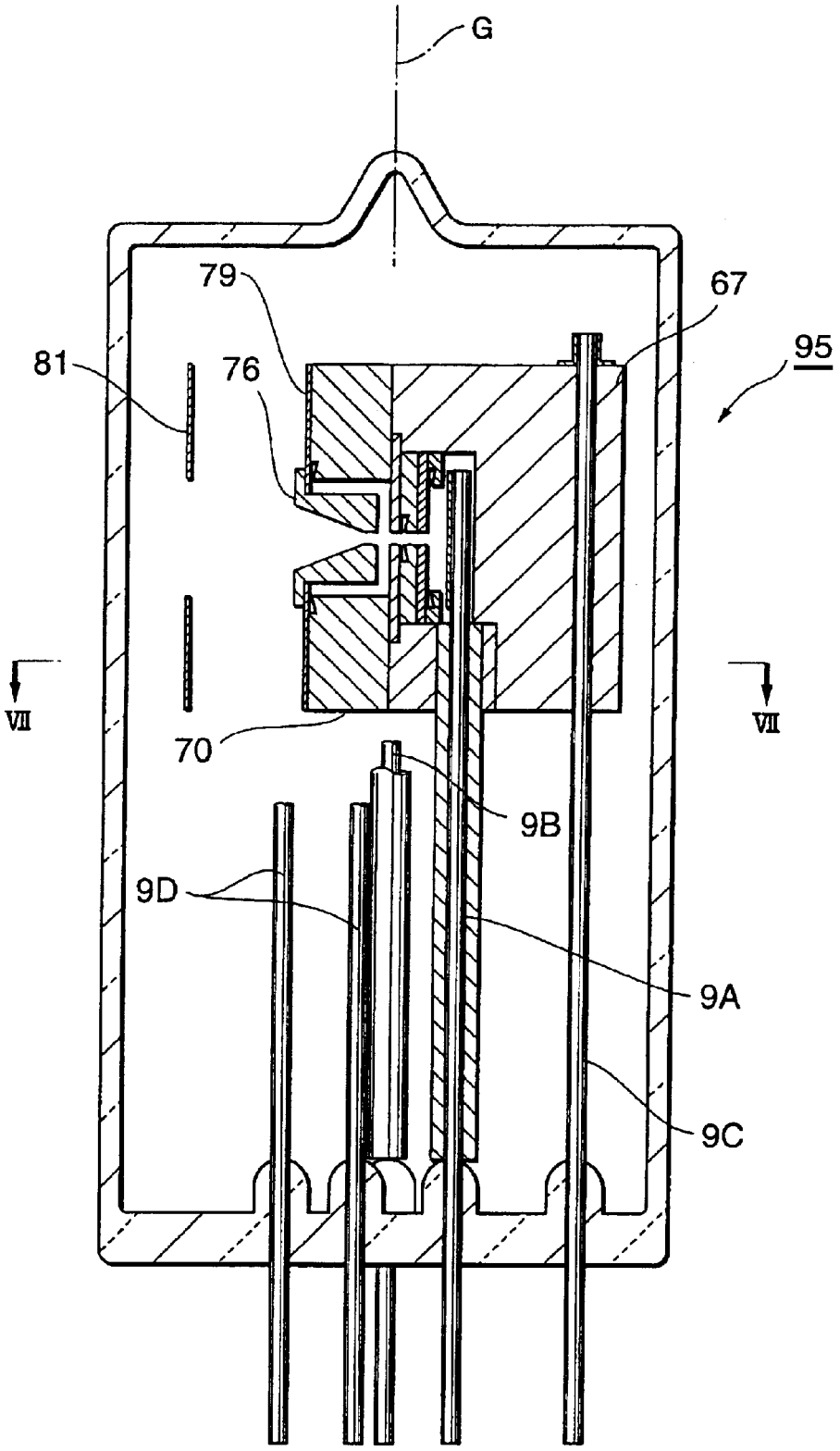
FIG. 40 is a sectional view showing a thirteenth embodiment of the gas discharge tube in accordance with the present invention.
Figure 41:
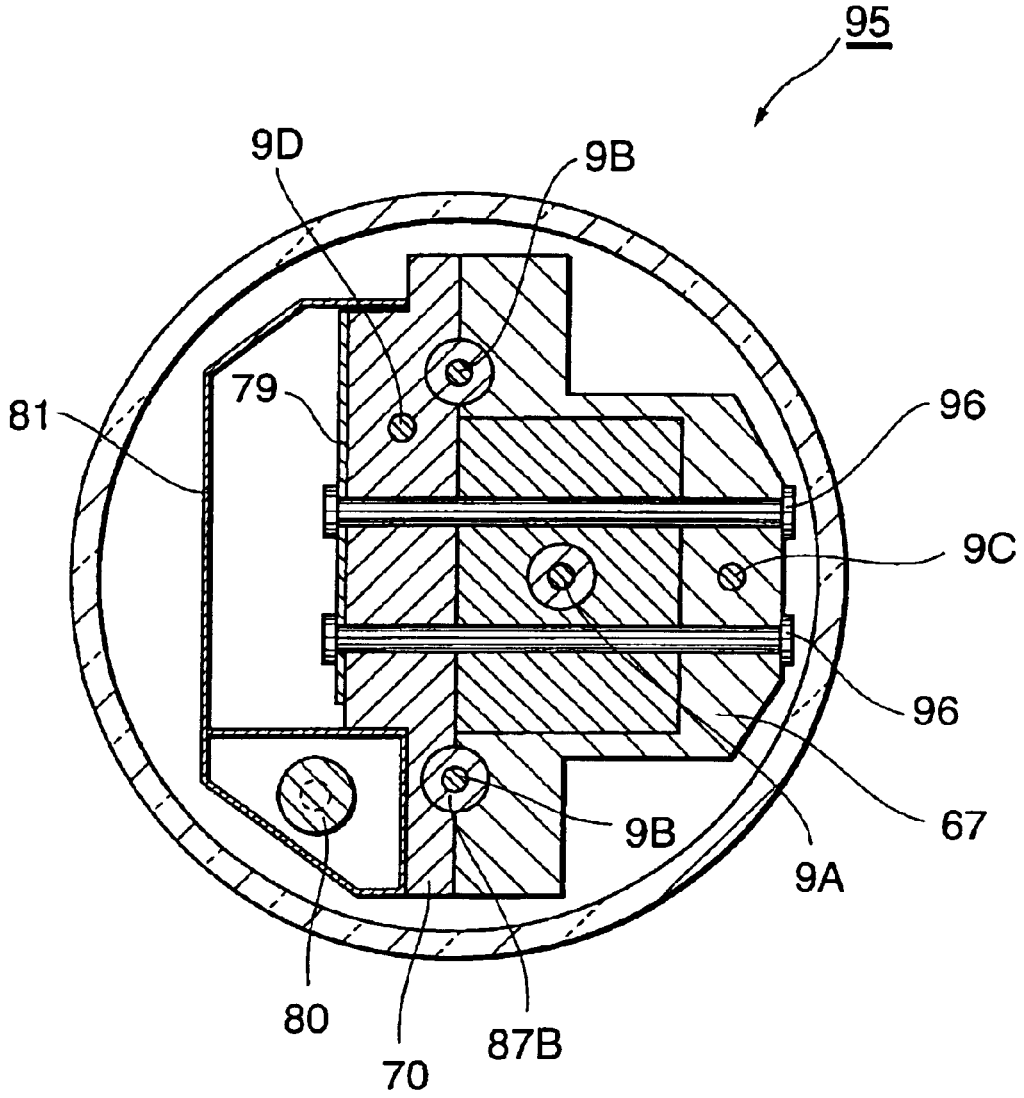
FIG. 41 is a sectional view taken along the line VII—VII of FIG. 40.

As shown in FIGS. 40 and 41, in a gas discharge tube 95, the electrically conductive plate 79 is unconnected to the first stem pin 9C in order to achieve a state where no power is supplied to the first discharge path restricting part 76. As a consequence, the first discharge path restricting part 76 attains a state electrically unconnected to an external power supply. The first support part 67 and second support part 70 are integrated with each other by rivets 96 made of a metal which are inserted in the light emitting direction.

(Fourteenth Embodiment)

Figure 42:
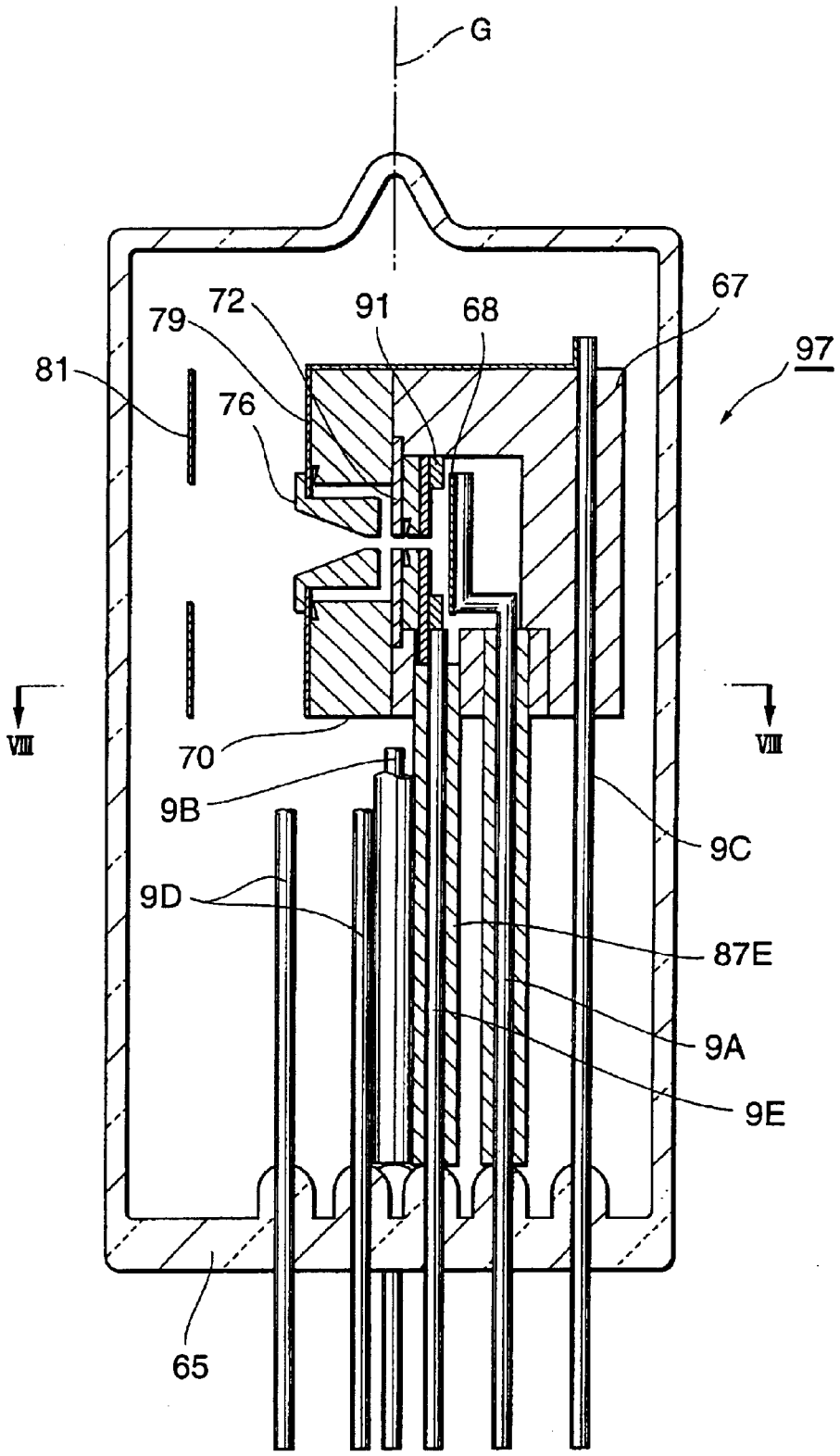
FIG. 42 is a sectional view showing a fourteenth embodiment of the gas discharge tube in accordance with the present invention.
Figure 43:
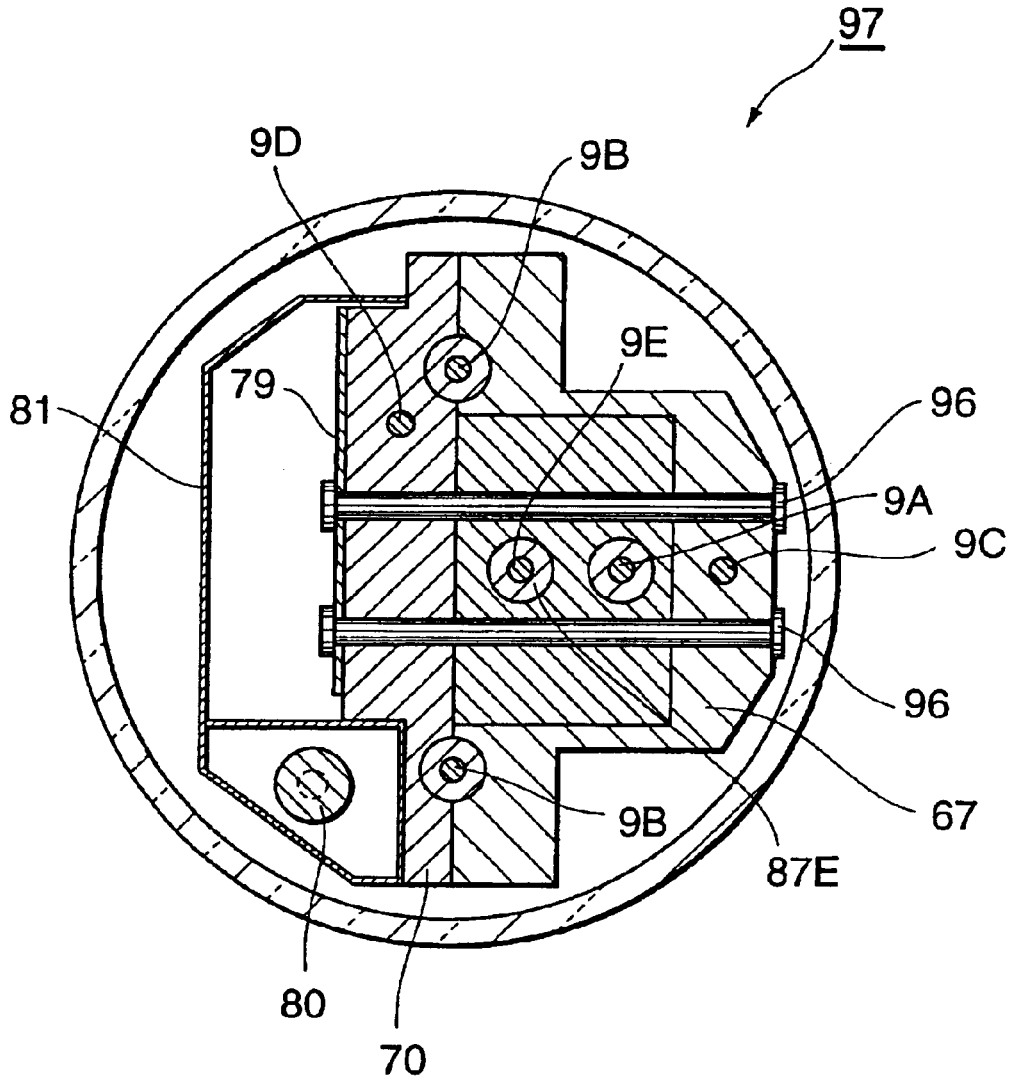
FIG. 43 is a sectional view taken along the line VIII—VIII of FIG. 42.

As shown in FIGS. 42 and 43, in a gas discharge tube 97, the second discharge path restricting part 72 is electrically connected to the leading ends of fourth stem pins 9B raised from a stem 65, in order to apply different potentials to the second discharge path restricting part 72 and third discharge path restricting part 91, respectively. On the other hand, the third discharge path restricting part 91 is electrically connected to a leading end part of a fifth stem pin 9E raised from the stem 65. Here, reference 87E denotes an electrically insulating tube for protecting the stem pin 9E.

Various circuits for operating the above-mentioned gas discharge tubes will now be explained with reference to the drawings. In FIGS. 44 to 47, references C1 and C2 denote terminals for a cathode part S, C3 an anode part, C4 a second discharge path restricting part, C5 a third discharge path restricting part, 1 a main power supply, 2 a trigger power supply, 3 a cathode heating power supply, and 4 a thyristor. The first discharge path restricting part is in the state with no power supply, and thus is not present on the circuit.

Figure 44:
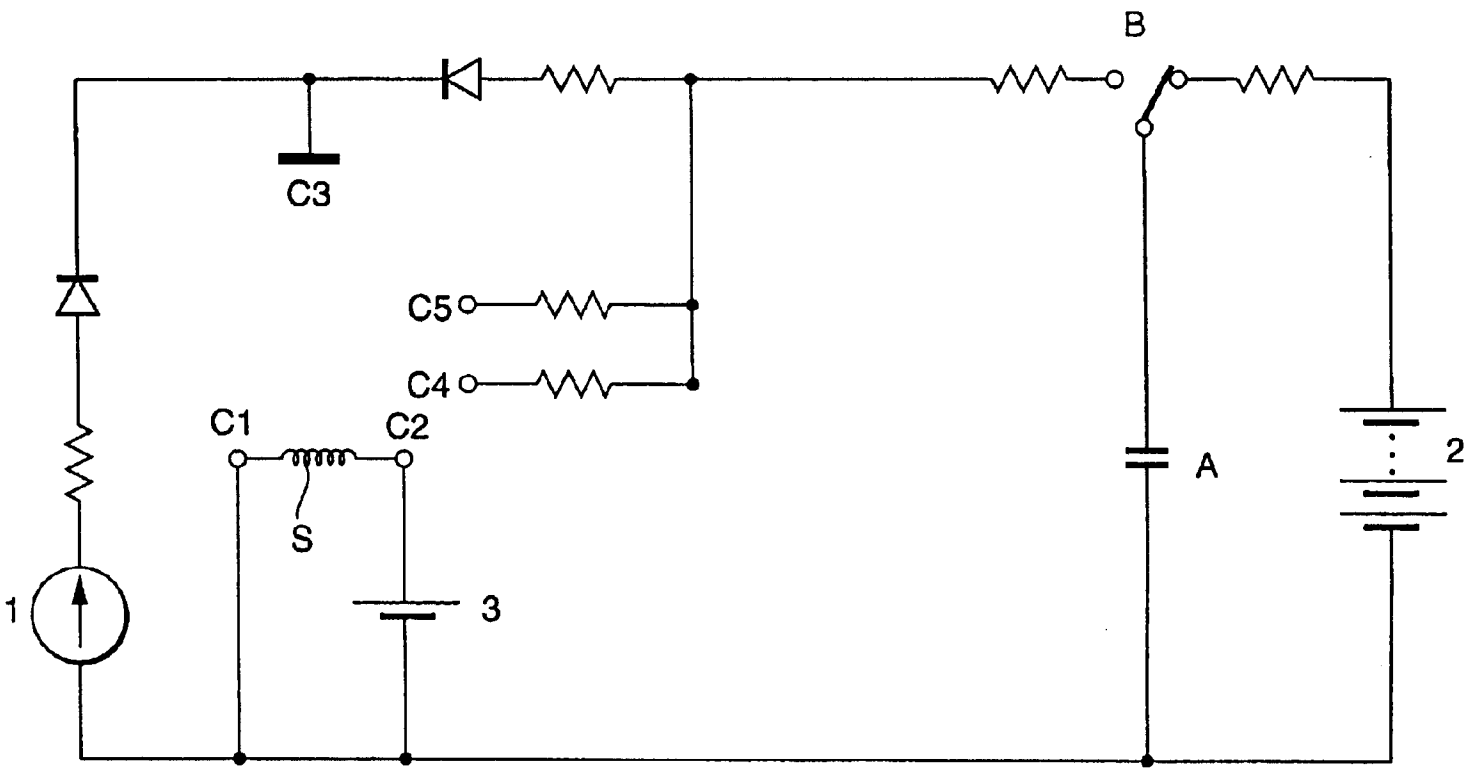
FIG. 44 is a diagram showing a first driving circuit employed in the gas discharge tube in accordance with the present invention.

The first driving circuit shown in FIG. 44 will be explained. First, the power supply 3 supplies a power at a voltage of about 10 W between the terminals C1 and C2, so as to heat the cathode part S, whereas the capacitor A is charged with the trigger power supply 2. Thereafter, the main power supply 1 applies a voltage of 160 V between the terminal C1 and the anode part C3. At the time when the cathode part S is fully heated, the switch B is changed over, so that, because of power supplied from the capacitor A, a voltage of 350 V is applied between C1 and C3, a voltage of 350 V is applied between the terminals C1 and C4, and a voltage of 350 V is applied between C1 and C5.

At this time, discharge occurs between the cathode part S and the second discharge path restricting part C4, whereby the voltage between the cathode part S and the second discharge path restricting part C4 drops. This voltage drop increases the potential difference between the second discharge path restricting part C4 and third discharge path restricting part C5, whereby charged particles existing near the second discharge path restricting part C4 migrate to the third discharge path restricting part C5. As a result, discharge occurs between the cathode part S and the third discharge path restricting part C5, whereby the voltage between the cathode part S and the third discharge path restricting part C5 drops. Here, the discharge between the cathode part S and the second discharge path restricting part C4 continues.

This voltage drop increases the potential difference between the third discharge path restricting part C5 and the anode part C3, whereby charged particles existing near the third discharge path restricting part C5 migrate to the anode part C3. As a result, starting discharge occurs between the cathode part S and the anode part C3. Here, the discharge between the cathode part S and the second and third discharge path restricting parts C4, C5 continues. This starting discharge enables the main power supply 1 to maintain the discharge between the cathode part S and the anode part C3, whereby the lamp keeps lighting. At the time when the capacitor A is completely discharged, the starting discharge ends.

Figure 45:
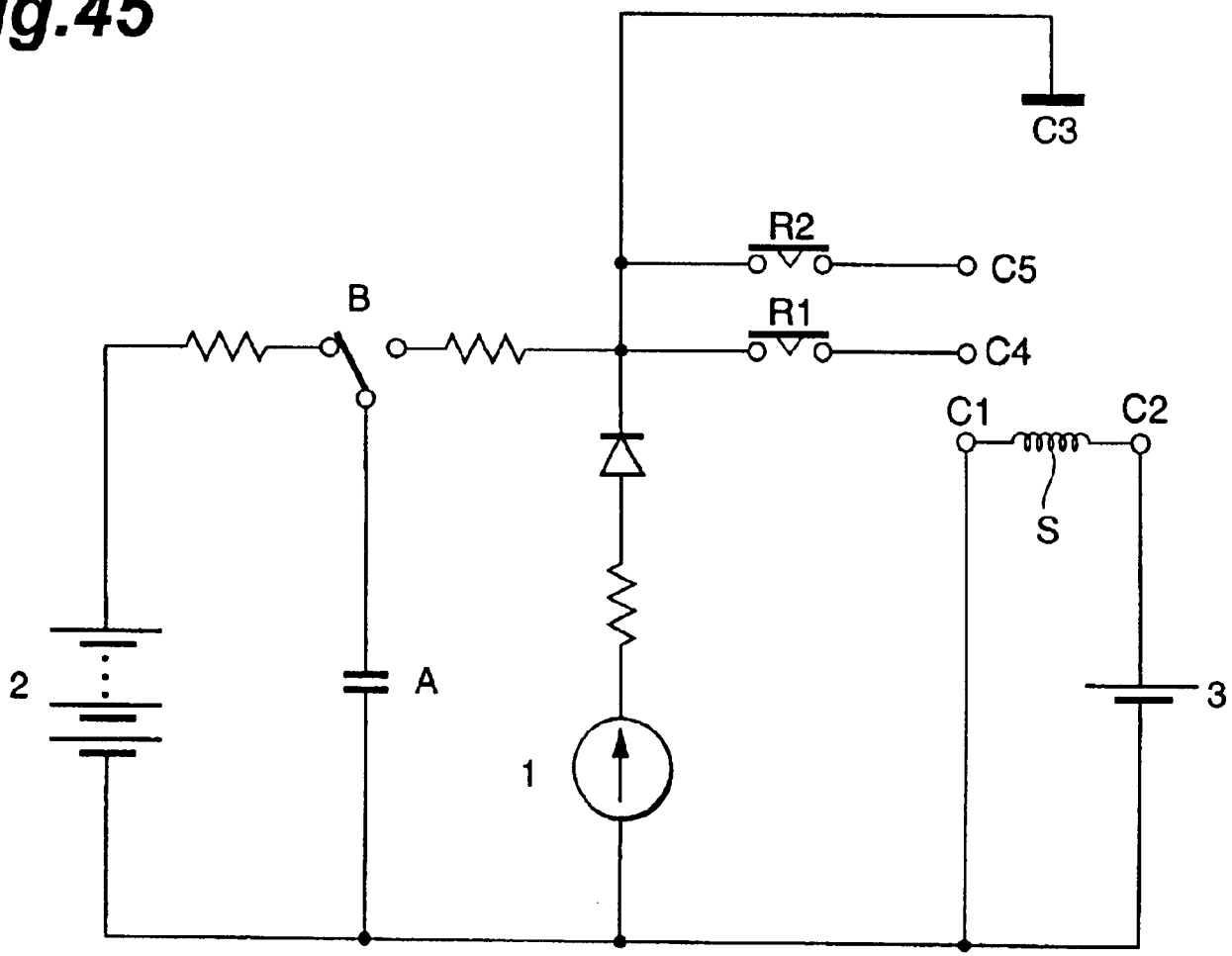
FIG. 45 is a diagram showing a second driving circuit employed in the gas discharge tube in accordance with the present invention.

The second driving circuit shown in FIG. 45 will be explained. First, the power supply 3 supplies a power at a voltage of about 10 W between the terminals C1 and C2, so as to heat the cathode part S, whereas the capacitor A is charged with the trigger power supply 2. Thereafter, the main power supply 1 applies a voltage of 160 V between the terminal C1 and the anode part C3. At the time when the cathode part S is fully heated, the switch B is changed over, so that, because of power supplied from the capacitor A, a voltage of 350 V is applied between C1 and C3, a voltage of 350 V is applied between C1 and C4, and a voltage of 350 V is applied between C1 and C5.

At this time, discharge occurs between the cathode part S and the second discharge path restricting part C4, whereby the voltage between the cathode part S and the second discharge path restricting part C4 drops. When electric conduction is detected between the cathode part S and the second discharge path restricting part C4 by a current detecting part disposed between a relay switch R1 and the second discharge path restricting part C4, the relay switch R1 is opened, so as to terminate the discharge between the cathode part S and the second discharge path restricting part C4.

Thereafter, charged particles existing near the second discharge path restricting part C4 migrate to the third discharge path restricting part C5. As a result, discharge occurs between the cathode part S and the third discharge path restricting part C5, whereby the voltage between the cathode part S and the third discharge path restricting part C5 drops. When electric conduction is detected between the cathode part S and the discharge path restricting part C5 by a current detecting part disposed between a relay switch R2 and the third discharge path restricting part C5, the relay switch R2 is opened, so as to terminate the discharge between the cathode part S and the third discharge path restricting part C5.

Thereafter, charged particles existing near the third discharge path restricting part C5 migrate to the anode part C3. As a result, starting discharge occurs between the cathode part S and the anode part C3. This starting discharge enables the main power supply 1 to maintain the cathode part S and the anode part C3, whereby the lamp keeps lighting.

Figure 46:
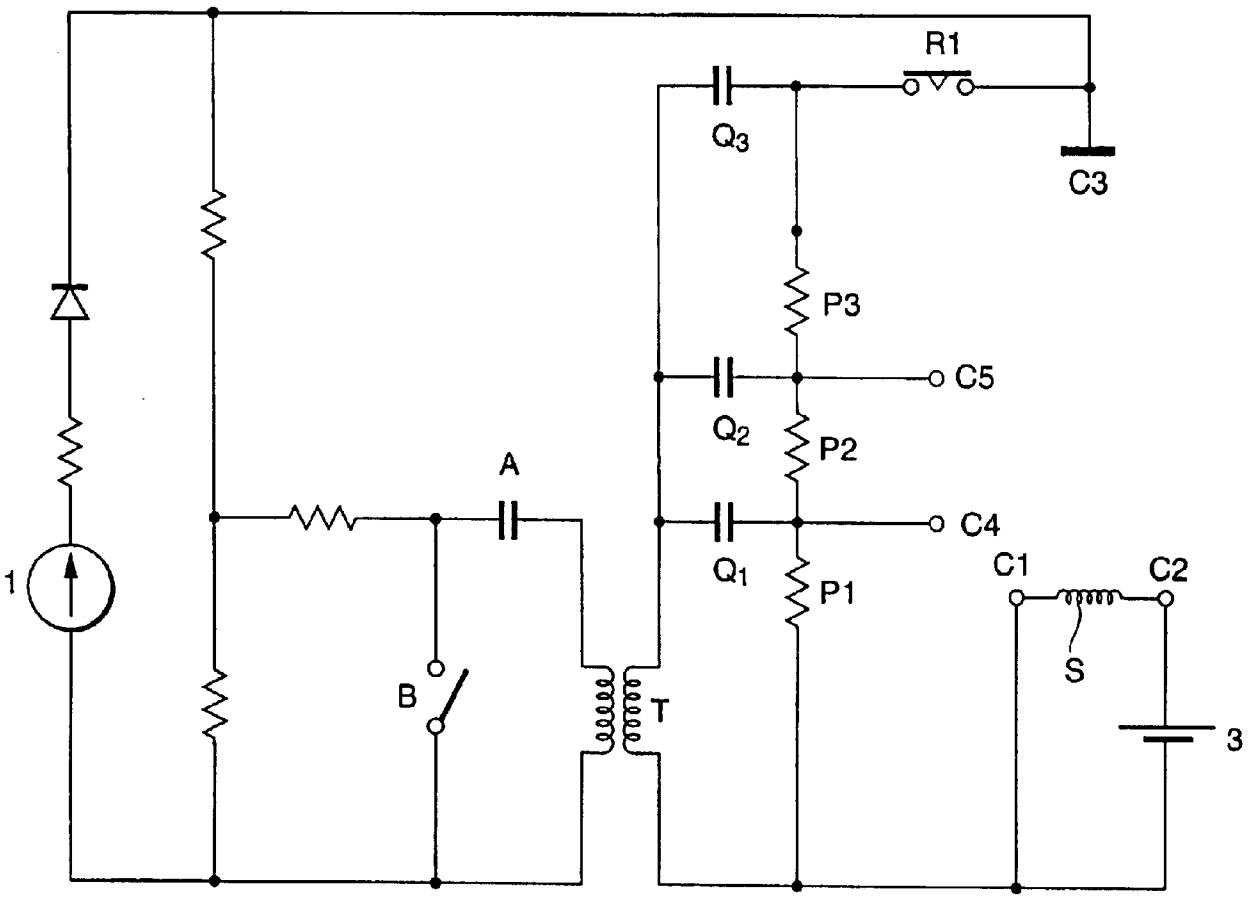
FIG. 46 is a diagram showing a third driving circuit employed in the gas discharge tube in accordance with the present invention.

The third driving circuit shown in FIG. 46 will be explained. First, the power supply 3 supplies a power at a voltage of about 10 W between the terminals C1 and C2, so as to heat the cathode part S. Then, the main power supply 1 charges the capacitor A, and applies a voltage of 160 V between the terminal C1 and the anode part C3, whereby a potential gradient is formed by resistors P1, P2, and P3. At the time when the cathode part S is fully heated, the switch B is turned ON, so as to make the capacitor A release the electric charge, while causing a pulse transformer T to generate a high-voltage pulse.

This pulse voltage is applied to the second discharge path restricting part C4, third discharge path restricting part C5, and anode part C3 by way of respective bypass capacitors Q1 to Q3. Then, starting discharge occurs between the cathode part S and the second discharge path restricting part C4, between the second discharge path restricting part C4 and the third discharge path restricting part C5, and between the third discharge path restricting part C5 and the anode part C3. This starting discharge enables the main power supply 1 to maintain the discharge between the cathode part S and the anode part C3, whereby the lamp keeps lighting. After the formation of discharge is verified between the cathode part S and anode part C3 by a current detecting part disposed between the main power supply 1 and the anode part C3, the relay switch R1 is opened, so as to terminate the starting discharge.

Figure 47:
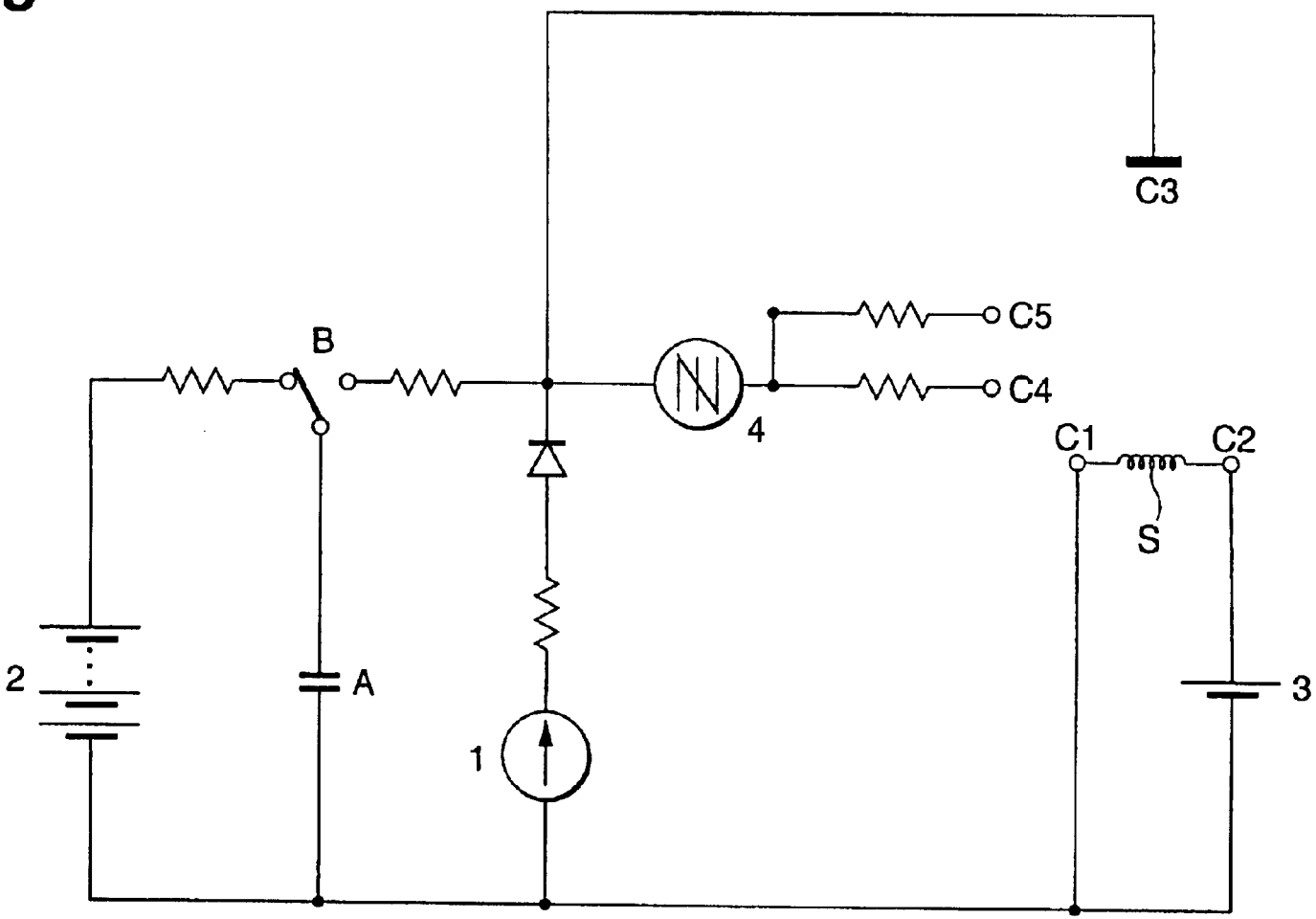
FIG. 47 is a diagram showing a fourth driving circuit employed in the gas discharge tube in accordance with the present invention.

The fourth driving circuit shown in FIG. 47 will be explained. First, the power supply 3 supplies a power of about 10 W between the terminals C1 and C2, so as to heat the cathode part S, whereas the capacitor A is charged with the trigger power supply 2. Then, the main power supply 1 applies a voltage of 160 V between the terminal C1 and the anode part C3. At the time when the cathode part S is fully heated, the switch B is changed over, so as to apply a voltage of 350 V between C1 and C3, and a voltage of 350 V between the terminal C1 and the thyristor 4. Upon occurrence of a trigger voltage, the thyristor 4 attains an electrically conductive state, thereby applying a voltage of 350 V between C1 and C4, and a voltage of 350 V between C1 and C5.

At this time, the electric charge stored in the capacitor A generates discharge between the cathode part S and the second discharge path restricting part C4, whereby the voltage between the cathode part S and the second discharge path restricting part C4 drops. This voltage drop increases the potential difference between the second discharge path restricting part C4 and the third discharge path restricting part C5, whereby charged particles existing near the second discharge path restricting part C4 migrate to the third discharge path restricting part C5. As a result, discharge occurs between the cathode part S and the third discharge path restricting part C5, whereby the voltage between the cathode part S and the third discharge path restricting part C5 drops. Here, the discharge between the cathode part S and the second discharge path restricting part C4 continues.

This voltage drop increases the potential difference between the third discharge path restricting part C5 and the anode part C3, whereby charged particles existing near the third discharge path restricting part C5 migrate to the anode part C3. As a result, starting discharge occurs between the cathode part S and the anode part C3. Here, the discharge between the cathode part S and the second and third discharge path restricting parts C4, C5 continues. This starting discharge enables the main power supply 1 to maintain the discharge between the cathode part S and the anode part C3, whereby the lamp keeps lighting. At the time when the sum of the respective discharge current values between C1 and C4 and between C1 and C5 drops to a current value at which the thyristor 4 attains an insulated state or lower, the starting discharge ends between C1 and C4 and between C1 and C5.

The gas discharge tube in accordance with the present invention should not be restricted to the embodiments mentioned above. For example, the above-mentioned third discharge path restricting part 39, 53, 91 maybe constituted by a plurality of sheets.

The following problems exist in the conventional gas discharge tube mentioned above. Namely, no voltage is applied to each metal barrier, whereas the small hole of each metal barrier is utilized only for narrowing the discharge path. While the luminance can certainly be enhanced by narrowing the discharge path, the discharge starting voltage must be made much higher as the small hole decreases its size as described in the above-mentioned publication as well, whereby the diameter of the small hole and the number of metal barriers are restricted severely.

The discharge tube in accordance with the present invention is a gas discharge tube achieving a favorable startability while realizing a higher luminance. This gas discharge tube is a gas discharge tube which encapsulates a gas within a hermetic envelope, whereas discharge is generated between an anode part and a cathode part which are disposed within the hermetic envelope, so as to emit predetermined light from a light exit window of the hermetic envelope to the outside, the gas discharge tube comprising a first discharge path restricting part, disposed in the middle of a discharge path between the anode and cathode parts, having a first aperture for narrowing the discharge path; a second discharge path restricting part, disposed in the middle of a discharge path between the discharge path restricting part and the anode part, having a second aperture for narrowing the discharge path with an aperture area smaller than that of the first aperture and electrically connecting with an external power supply; and an electrically insulating part disposed between the first and second discharge path restricting parts.

For producing light with a high luminance, it will not be enough if the aperture part for narrowing the discharge path is simply made smaller. As the aperture part is made smaller, the discharge at the time when the lamp begins to operate becomes harder to occur. For enhancing the startability of the lamp, a remarkably large potential difference must be generated between the cathode and anode parts, whereby the lamp life shortens as has been verified by an experiment. Therefore, in the gas discharge tube of the present invention, the second aperture of the second discharge path restricting part is formed with an aperture area smaller than that of the first aperture, so as to narrow the aperture area stepwise, in order to attain light with a high luminance. Further, for yielding a favorable startability of the lamp even when the discharge path is narrowed, a predetermined voltage is applied to the second discharge path restricting part from the outside. This produces such aggressive starting discharge as to pass through the first aperture between the cathode part and the second discharge path restricting part, so that the starting discharge is easier to pass through the first and second apertures, whereby the discharge between the cathode and anode parts starts rapidly. Such a configuration can easily cause the apertures of discharge path restricting parts to reduce their areas while favorably keeping the startability without remarkably enhancing the voltage at the time when the lamp begins to operate, in order to enhance luminance.

Preferably, the first discharge path restricting part is electrically unconnected to the external power supply. Such a configuration can reduce the number of pins for introducing electricity.

In the case where the first discharge path restricting part is electrically connected to the external power supply, it is preferred that a higher voltage be applied to the second discharge path restricting part than to the first discharge path restricting part. Such a configuration can apply an appropriate discharge starting voltage between the first and second discharge path restricting parts in conformity to the potential difference between the cathode and anode parts, whereby the starting discharge can be generated smoothly.

Preferably, the first aperture of the first discharge path restricting part has a funnel part narrowing its diameter from the light exit window toward the anode part. This funnel part makes it easier for discharge to converge into the first aperture, so that an arc ball can reliably be generated in this part, and the arc ball can appropriately be prevented from widening.

Preferably, the second discharge path restricting part is arranged in contact with an electrically insulating support part. Such a configuration allows the second discharge path restricting part to be disposed within the hermetic envelope in a stable state.

It will also be preferred if the second discharge path restricting part is held and secured between an electrically insulating part and a support part. Such a configuration reliably secures the second discharge path restricting part within the hermetic envelope in view of the workability of assembling the gas discharge tube. It can also prevent the second discharge path restricting part from moving due to thermal expansion at a high temperature when the lamp is in operation.

Preferably, the gas discharge tube further comprises a third discharge path restricting part, disposed in the middle of a discharge path between the second discharge path restricting part and the anode part, having a third aperture for narrowing the discharge path. This can narrow the discharge path stepwise by the respective apertures of the discharge path restricting parts in cooperation, thereby further enhancing the luminance and startability.

It will also be preferred if an electrically insulating part is disposed between the second and third discharge path restricting parts. Such a configuration allows the second and third discharge path restricting parts to have respective voltages different from each other, thereby attaining a favorable startability.

In the case where the third discharge path restricting part is electrically connected to the external power supply, it is preferred that a higher voltage be applied to the third discharge path restricting part than to the second discharge path restricting part. Such a configuration can apply an appropriate discharge starting voltage between the second and third discharge path restricting parts in conformity to the potential difference between the cathode and anode parts, whereby the starting discharge can be generated smoothly.

Preferably, the third discharge path restricting part is arranged in contact with an electrically insulating support part. Such a configuration can arrange the third discharge path restricting part within the hermetic envelope in a stable state.

It will also be preferred if the third discharge path restricting part is held and secured between an electrically insulating part and a support part. Such a configuration reliably secures the third discharge path restricting part within the hermetic envelope in view of the workability of assembling the gas discharge tube. It can also prevent the third discharge path restricting part from moving due to thermal expansion at a high temperature when the lamp is in operation.

A gas discharge tube achieving a favorable startability while realizing a higher luminance can also be realized by enlarging the second aperture.

Namely, such a gas discharge tube is a gas discharge tube which encapsulates a gas within a hermetic envelope, whereas discharge is-generated between an anode part and a cathode part which are disposed within the hermetic envelope, so as to emit predetermined light from a light exit window of the hermetic envelope to the outside, the gas discharge tube comprising a first discharge path restricting part, disposed in the middle of a discharge path between the anode and cathode parts, having a first aperture for narrowing the discharge path; a second discharge path restricting part, disposed in the middle of a discharge path between the discharge path restricting part and the anode part, having a second aperture for narrowing the discharge path with an aperture area not smaller than that of the first aperture and electrically connecting with an external power supply; and an electrically insulating part disposed between the first and second discharge path restricting parts.

For producing light with a high luminance, it will not be enough if a plurality of stages of discharge restricting parts for narrowing the discharge path are simply provided. As the number of discharge path restricting parts is made greater and as apertures are made smaller, the discharge becomes harder to occur at the time when the lamp starts operating. For enhancing the startability of the lamp, a remarkably large potential difference must be generated between the cathode and anode parts, whereby the lamp life shortens as has been verified by an experiment. Therefore, for attaining light with a high luminance, the discharge path is narrowed by the first and second apertures in cooperation in the gas discharge tube of the present invention. Further, for yielding a favorable startability of the lamp even when the discharge path is narrowed, a predetermined voltage is applied to the second discharge path restricting part from the outside. This produces such aggressive starting discharge as to pass through the first aperture. Since the second aperture has an area identical to or greater than that of the first aperture, the discharge at the time when the lamp starts operating is not restricted by the second aperture. This makes it easier for the discharge at the time of starting to pass through the first and second apertures, whereby the discharge between the cathode and anode parts starts rapidly. Such a configuration can achieve a higher luminance by increasing the number of discharge path restricting parts, while favorably keeping the startability without remarkably enhancing the voltage at the time when the lamp starts operating.

Gas discharge tubes of such a type will now be explained.

(Fifteenth Embodiment)

Figure 48:
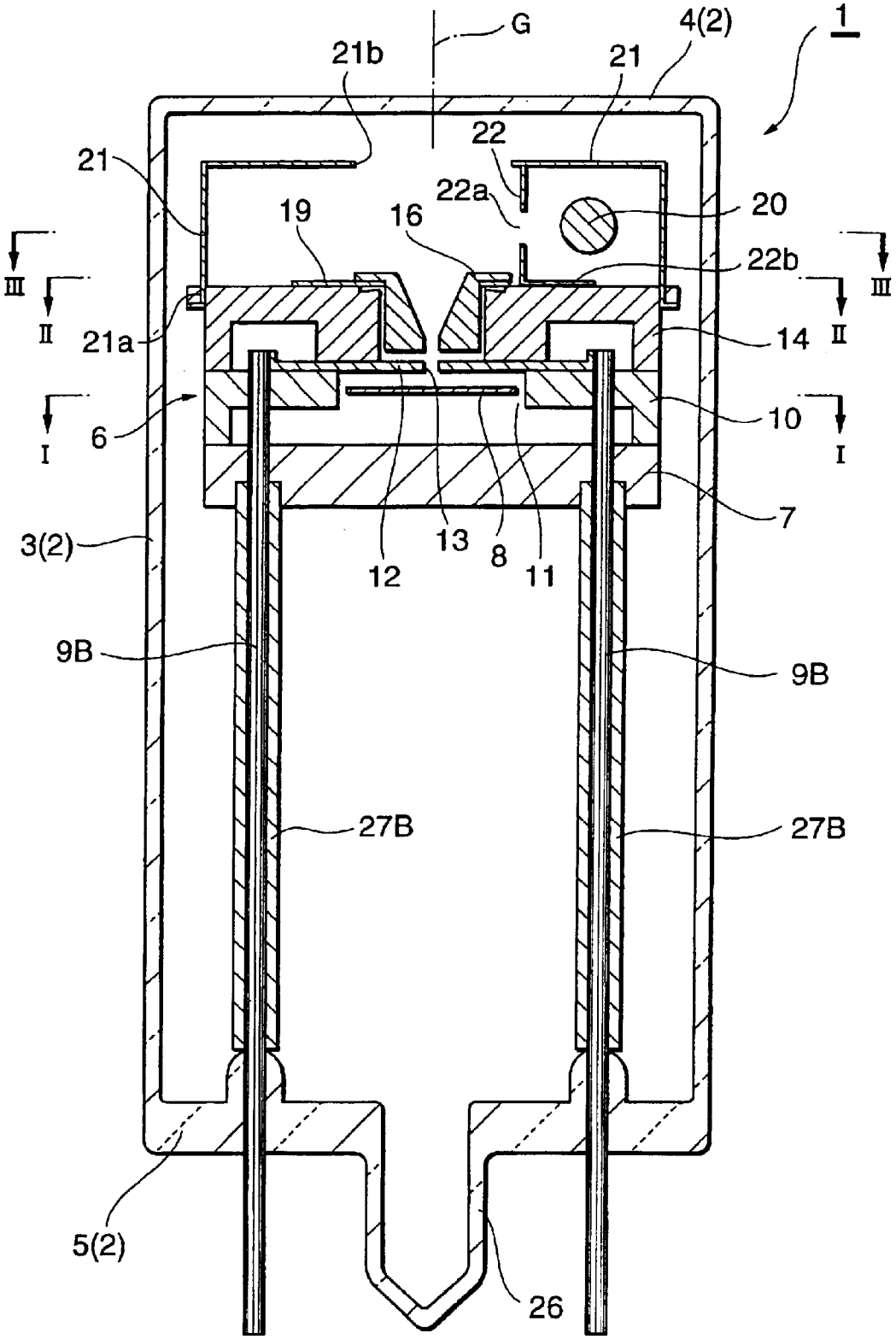
FIG. 48 is a sectional view showing a fifteenth embodiment of the gas discharge tube in accordance with the present invention.
Figure 49:
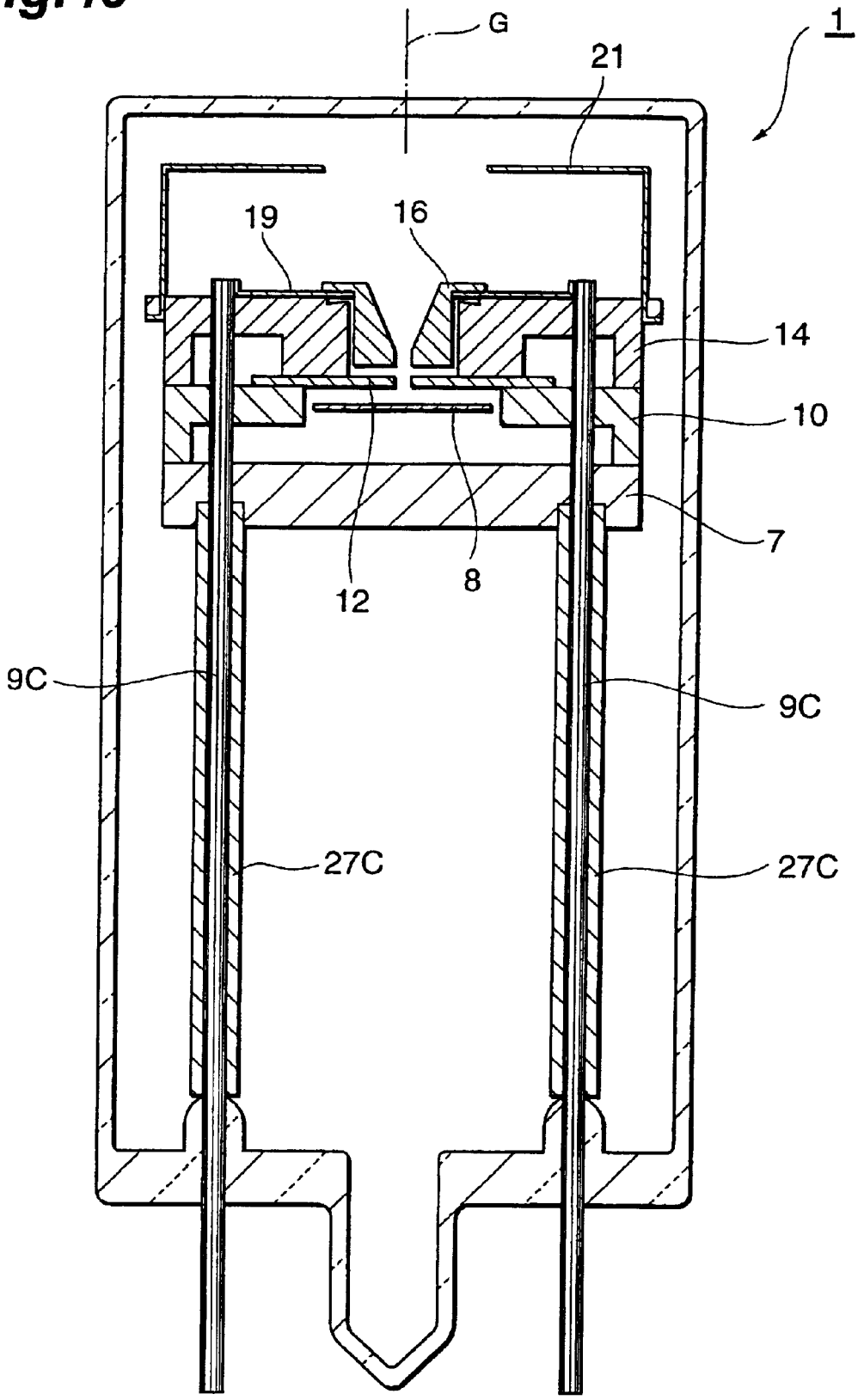
FIG. 49 is a sectional view of the gas discharge tube shown in FIG. 48.
Figure 50:
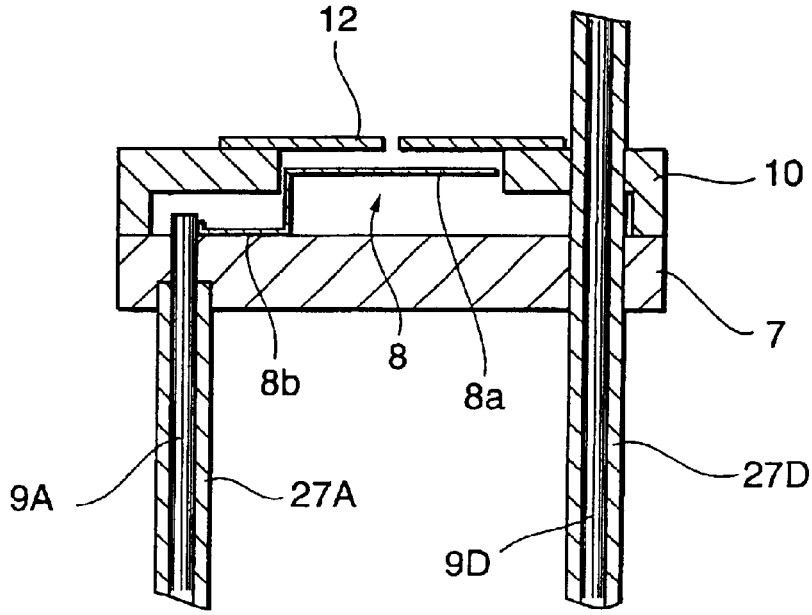
FIG. 50 is a partly enlarged view of an anode part.
Figure 51:
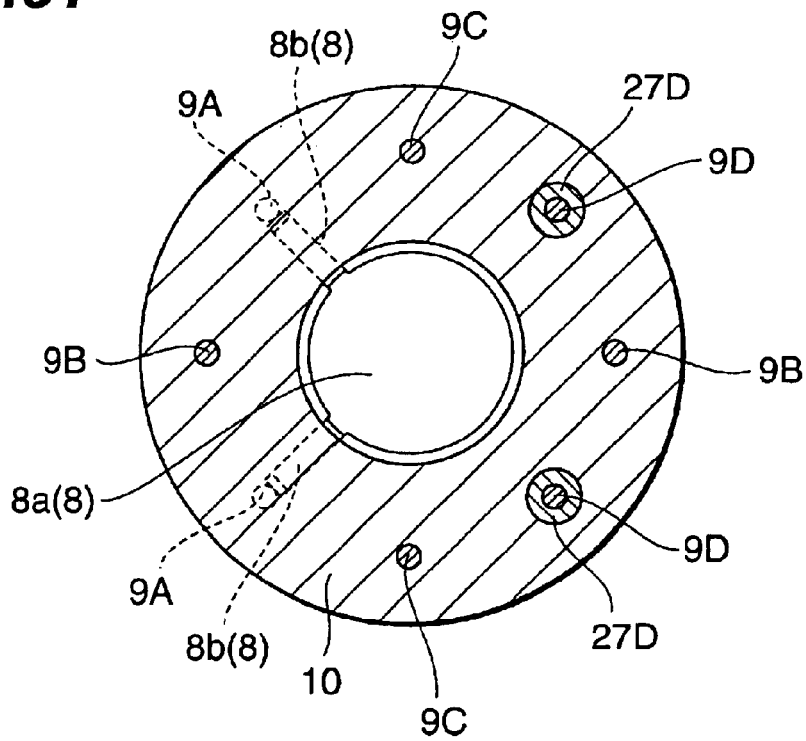
FIG. 51 is a sectional view taken along the line I—I of FIG. 48.
Figure 56:
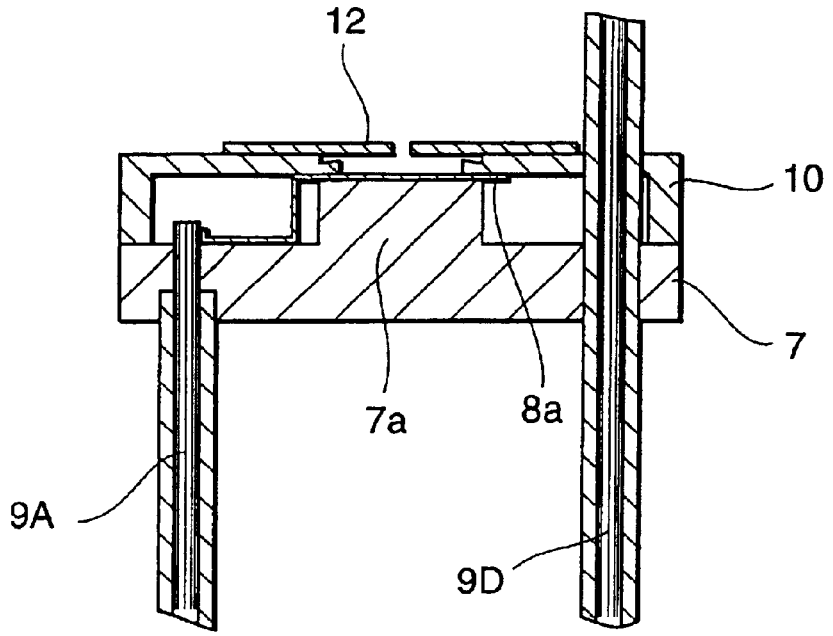
FIG. 56 is a sectional view showing another method of securing the anode part.

As shown in FIGS. 48 and 49, a gas discharge tube 1 is a head-on type deuterium lamp. As shown in FIGS. 50 and 51, an anode plate (anode part) 8 is disposed on an electrically insulating part 7. Here, a main part 8*a* maybe held and secured between the upper face of a projection 7*a* provided with the electrically insulating part 7 and the rear face of a second support part 10 which will be explained later (see FIG. 56). As shown in FIGS. 48 and 49, a light emitter assembly 6 has a disk-shaped electrically insulating part (second support part) 10 made of electrically insulating ceramics. A disk-shaped discharge path restricting plate (second discharge path restricting part) 12 made of a metal is brought into contact with the upper face of the second support part 10, whereby the main part 8*a* of the anode plate 8 and the discharge path restricting part 12 face each other.

Figure 52:
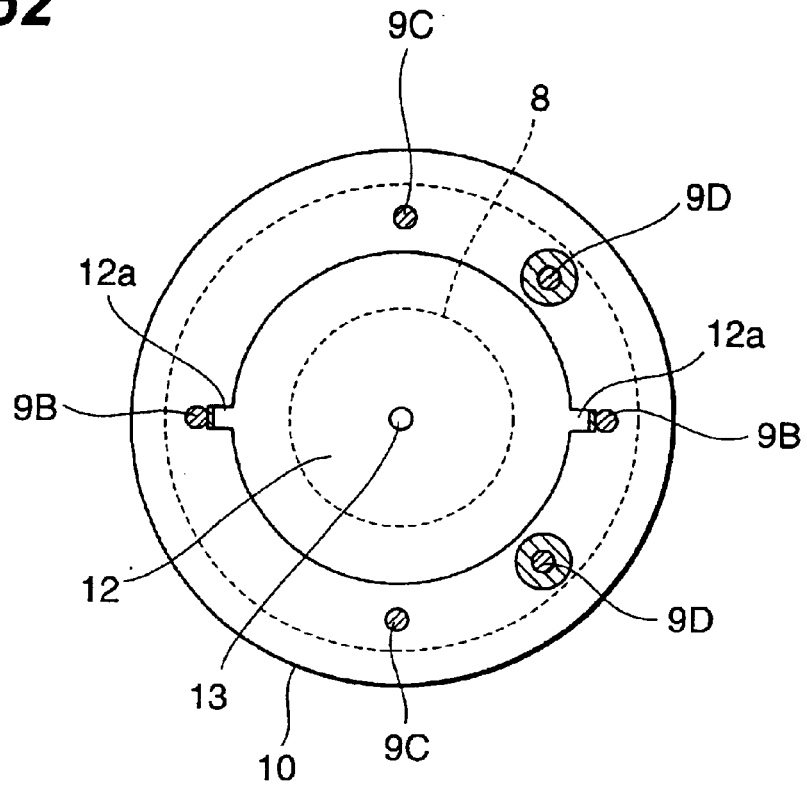
FIG. 52 is a plan view showing a second discharge path restricting part.

As shown in FIG. 52, a small hole (second aperture) 13 having a diameter of 0.5 mm for narrowing the discharge path is formed at the center of the discharge path restricting plate 12. Also, the discharge path restricting part 12 is provided with two lead parts 12*a*, which are electrically connected to respective leading end parts of discharge path restricting plate stem pins (fourth stem pins) 9B raised from a stem 5.

Figure 53:
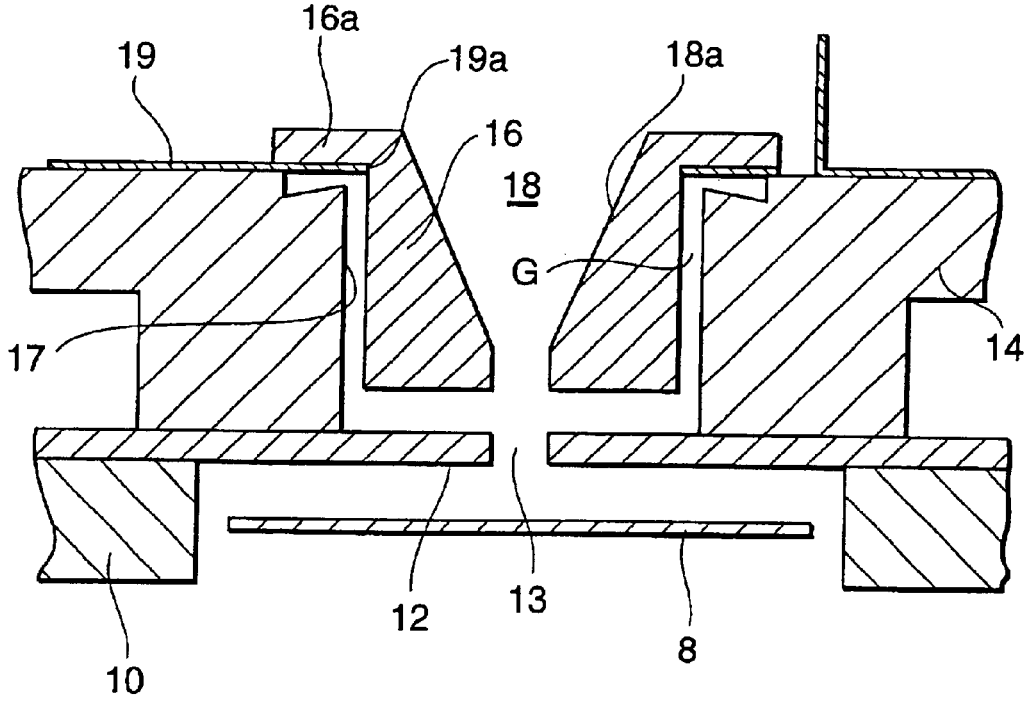
FIG. 53 is a partly enlarged sectional view of discharge path restricting parts.
Figure 57:
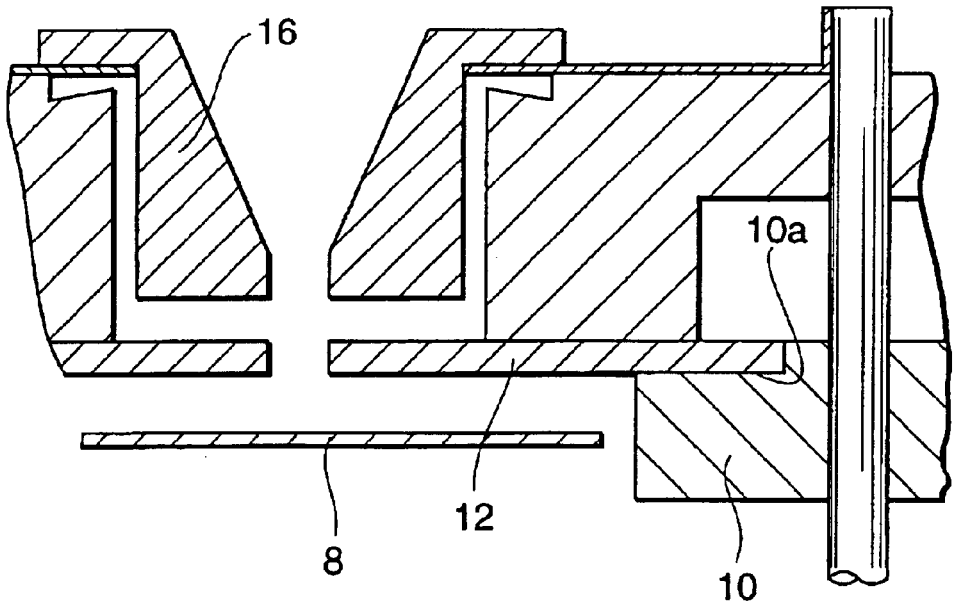
FIG. 57 is a sectional view showing another method of securing the second discharge path restricting part.

As shown in FIGS. 48, 49, and 53, the light emitter assembly 6 has a disk-shaped electrically insulating part (third support part) 14 made of electrically insulating ceramics. The third support part 14 is mounted so as to be overlaid on the second support part 10, and is formed with the same diameter as that of the second support part 10. The second discharge path restricting plate 12 is held and secured between the lower face of the third support part 14 and the upper face of the second support part 10. Here, the second discharge path restricting plate 12 may be accommodated within a depression 10*a* formed in the upper face of the second support part 10, so as to improve the seatability of the second discharge path restricting plate 12 (see FIG. 57). A loading port 17 for loading a first discharge path restricting part 16 made of an electrically conductive metal (e.g., molybdenum, tungsten, or their alloys) is formed at the center of the third support part 14. For narrowing the discharge path, the discharge path restricting part 16 is formed with a first aperture 18 having the same diameter as that of the second aperture 13, whereas the first aperture 18 is positioned on the same tube axis G as the second aperture 13.

The first aperture 18 has a funnel part 18*a*, extending along the tube axis G, for producing a favorable arc ball, whereas the funnel part 18*a* tapers down its diameter from a light exit window 4 toward the anode part 8. Specifically, it is formed with a diameter of 3.2 mm on the light exit window 4 side and with a diameter of about 0.5 mm on the anode part 8 side so as to attain the same diameter of aperture area as that of the second aperture 13.

Thus, the discharge path is narrowed by the first aperture 18 and second aperture 13 in cooperation. Since the second aperture 13 has the same diameter as that of the first aperture 18, the discharge at the time when the lamp starts operating is not restricted by the second aperture 13. Therefore, the discharge at the time when the lamp starts operating is not restricted even in the case where the number of discharge path restricting parts is increased in order to attain a higher luminance.

Figure 54:
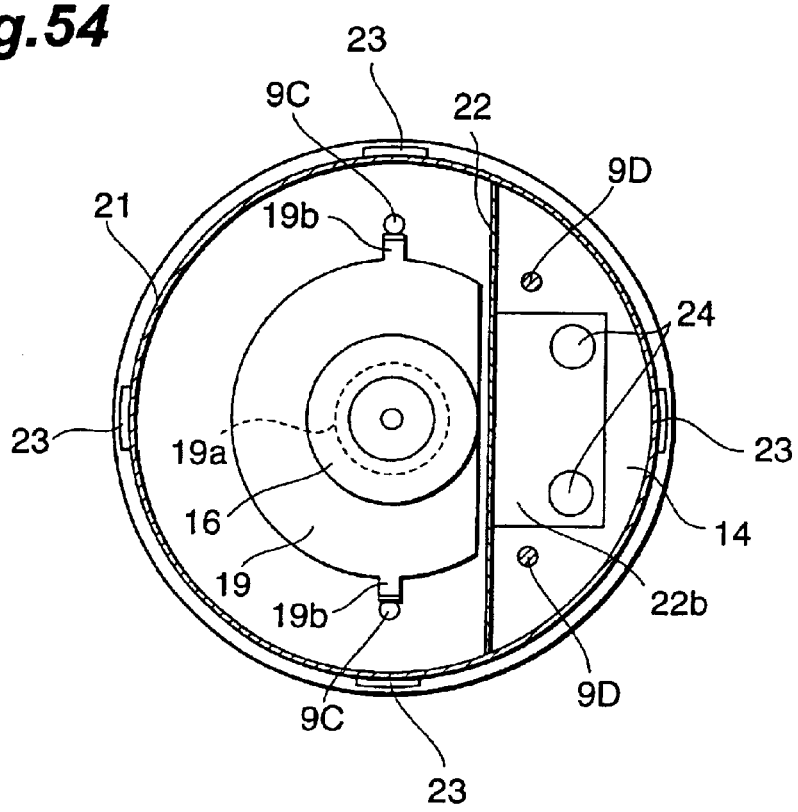
FIG. 54 is a sectional view taken along the line II—II of FIG. 48.

An electrically conductive plate 19 is arranged in contact with the upper face of the third support part 14, whereas an aperture 19*a* formed in the electrically conductive plate 19 is aligned with the loading port 17, thus allowing the loading of the first discharge path restricting part 16. The electrically conductive plate 19 is provided with two lead parts 19*b*, which are electrically connected to respective leading end parts of discharge path restricting plate stem pins (third stem pins) 9C raised from the stem 5 (see FIGS. 49 and 54). A flange part 16*a* provided with the first discharge path restricting part 16 is arranged in contact with the electrically conductive plate 19, and is welded to the electrically conductive plate 19, so as to integrate the electrically conductive plate 19 and the first discharge path restricting part 16 with each other.

Here, the first discharge path restricting part 16 and the second discharge path restricting part 12 are separated from each other with a gap G therebetween for electric insulation. Further, for making this insulation reliable, the first discharge path restricting part 16 and the third support part 14 are separated from each other. This is used for aggressively attaching metal evaporated products, among sputtered products and evaporated products generated from the first discharge path restricting part 16 and second discharge path restricting part 12 at a high temperature during operation of the lamp, to the wall face of the loading port 17. Namely, the first discharge path restricting part 16 and the third support part 14 are separated from each other, so as to increase the area to which evaporated products attach, thereby making it difficult for the first discharge path restricting part 16 and second discharge path restricting part 12 to short-circuit.

Figure 55:
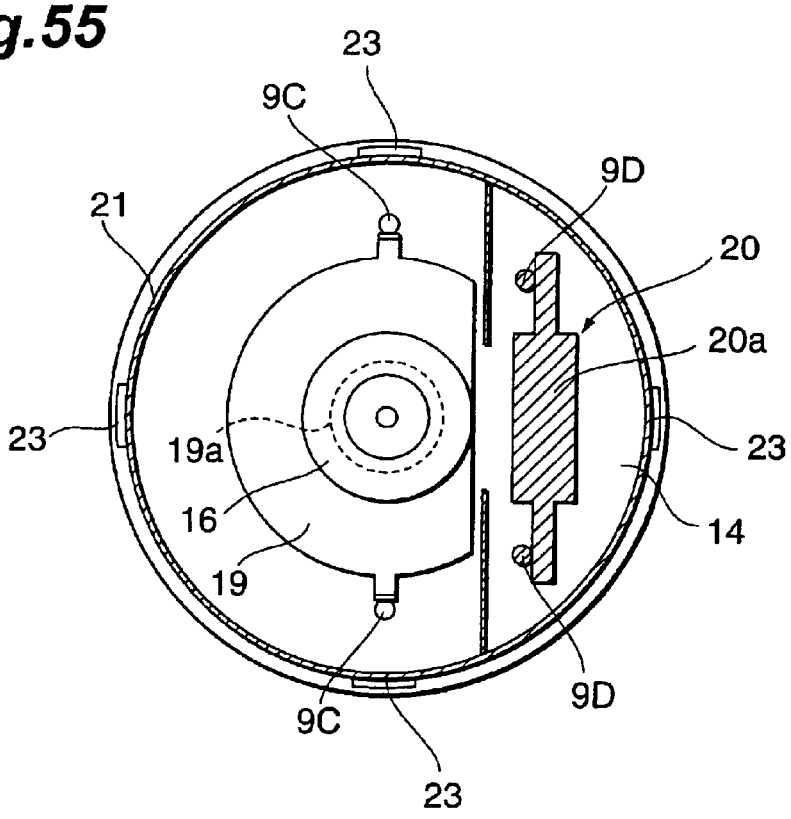
FIG. 55 is a sectional view taken along the line III—III of FIG. 48.

As shown in FIGS. 48 and 55, a cathode part 20 is disposed in the light emitter assembly 6 at a position on the light exit window 4 side deviated from the optical path, whereas both ends of the cathode part 20 are electrically connected to respective leading end parts of cathode part stem pins (second stem pins) 9D raised from the stem 5 so as to penetrate through the support parts 7, 10, 14.

The gas discharge tube 1 of the above-mentioned type is a structure for achieving a higher luminance, and can achieve a higher luminance by increasing the number of discharge path restricting parts while favorably keeping startability without remarkably enhancing the voltage at the time when the lamp begins to operate.

Figure 58:
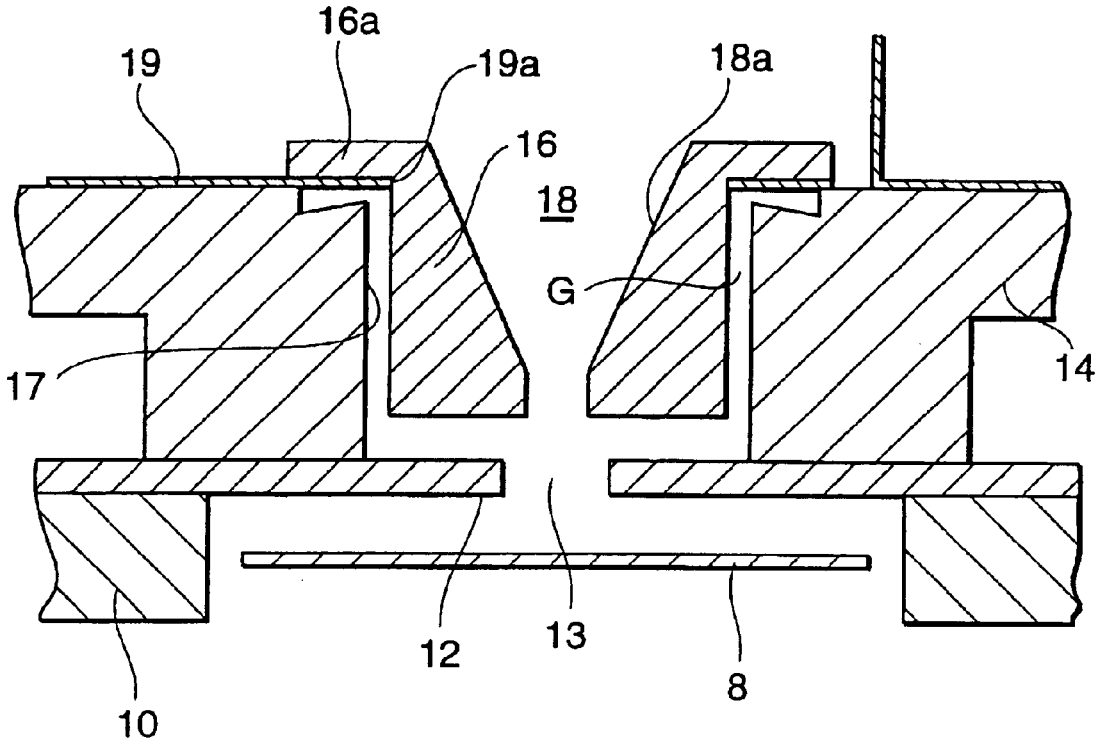
FIG. 58 is a partly enlarged sectional view showing another modified example of the discharge path restricting parts of FIG. 53.

The light quantity can further be increased in another mode of the gas discharge tube 1 in which, as shown in FIG. 58, the second aperture 13 has a diameter of 1 mm, so that the aperture area of the second aperture 13 is greater than that of the first aperture 18 positioned close to the second aperture 13.

Operations of the head-on type deuterium discharge tube 1 are identical to those mentioned above. Specifically, in a period of about 20 seconds before discharge, an external power supply initially supplies a power of about 10 W to the cathode part 20 by way of the stem pins 9D, thereby preheating the coil part 20*a* of the cathode part 20. Then, a voltage of about 160 V is applied between the cathode part 20 and the anode plate 8, so as to prepare for arc discharge.

After the preparation is done, a trigger voltage of about 350 V is applied from an external power supply to the second discharge path restricting plate 12 by way of the stem pins 9B. Here, the first discharge path restricting part 16 keeps its no power supply state. As a consequence, discharge successively occurs between the cathode part 20 and the second discharge path restricting part 12 and between the cathode part 20 and the anode part 8. When stepwise discharge is aggressively produced as such, reliable starting discharge occurs between the cathode part 20 and anode part 8 even when the discharge path is narrowed by the two discharge path restricting parts 12, 16.

When such starting discharge occurs, arc discharge is maintained between the cathode part 20 and the anode part 8, whereby an arc ball is generated within each of the apertures 13, 18 narrowing the discharge path. UV rays taken out of the arc balls are transmitted through the light exit window 4, so as to be released to the outside as light having a very high luminance. An experiment has verified that the deuterium lamp 1 shown in FIG. 48 and thereafter attains a luminance which is nearly three times that of a conventional deuterium lamp having an aperture with a diameter of 1 mm.

(Sixteenth Embodiment)

Figure 59:
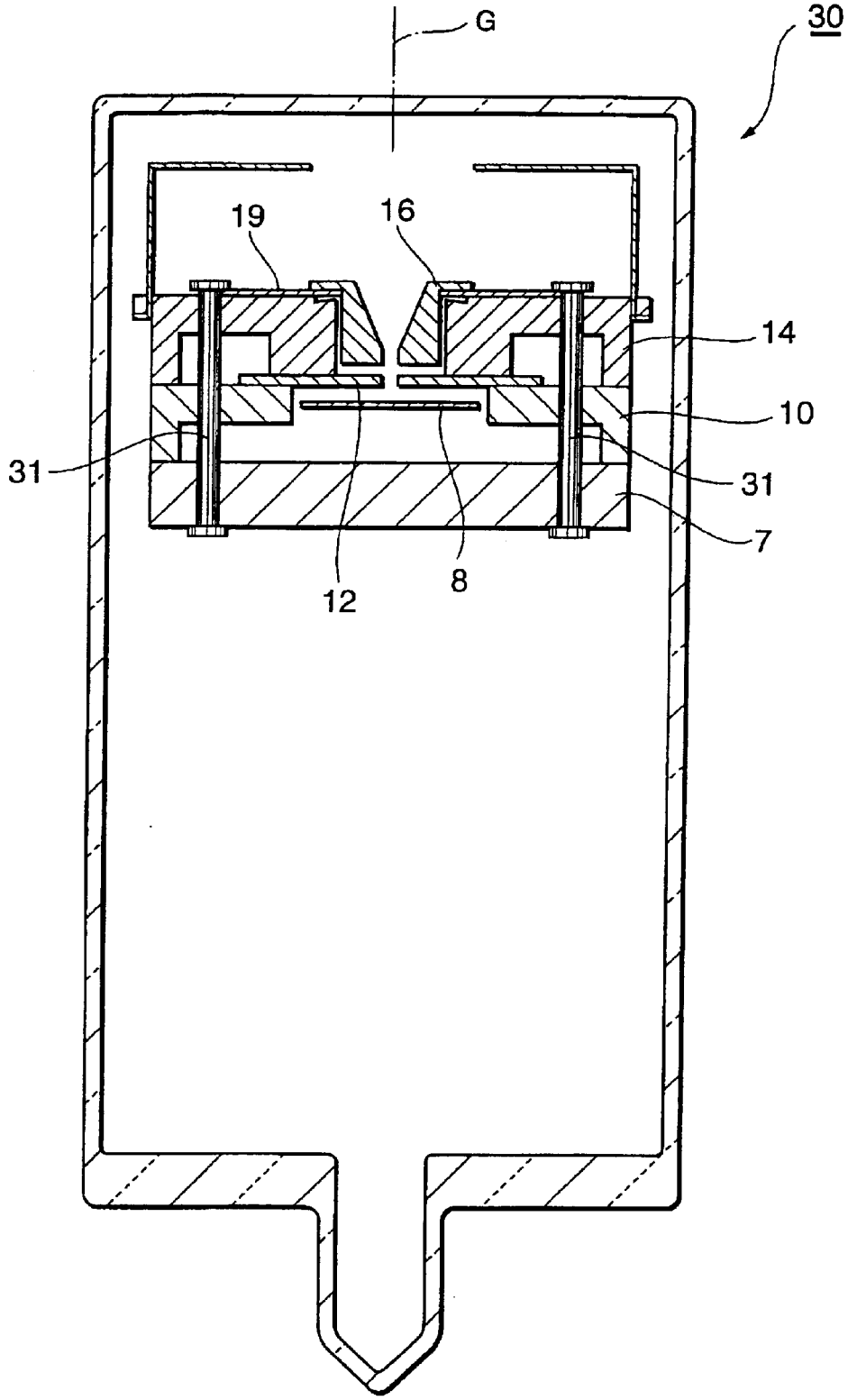
FIG. 59 is a sectional view showing a sixteenth embodiment of the gas discharge tube in accordance with the present invention.

As shown in FIG. 59, in a gas discharge tube 30 of the type shown in FIG. 48 and thereafter, the first support part 7, second support part 10, and third support part 14 are integrated together with rivets 31 made of a metal which are inserted along the tube axis G. This gas discharge tube 30 does not employ the first stem pins 9C, so that the first stem pins 9C do not project from the stem 5, whereby the number of stem pins projecting from the stem 5 is 6. Therefore, whether power is supplied to the first discharge path restricting part 16 or not can easily be determined according to the number of projecting stem pins at the time of replacing the lamp. Decreasing the number of stem pins can enhance the strength against the thermal expansion occurring in fused parts of stem pins during operation of the lamp.

(Seventeenth Embodiment)

Figure 60:
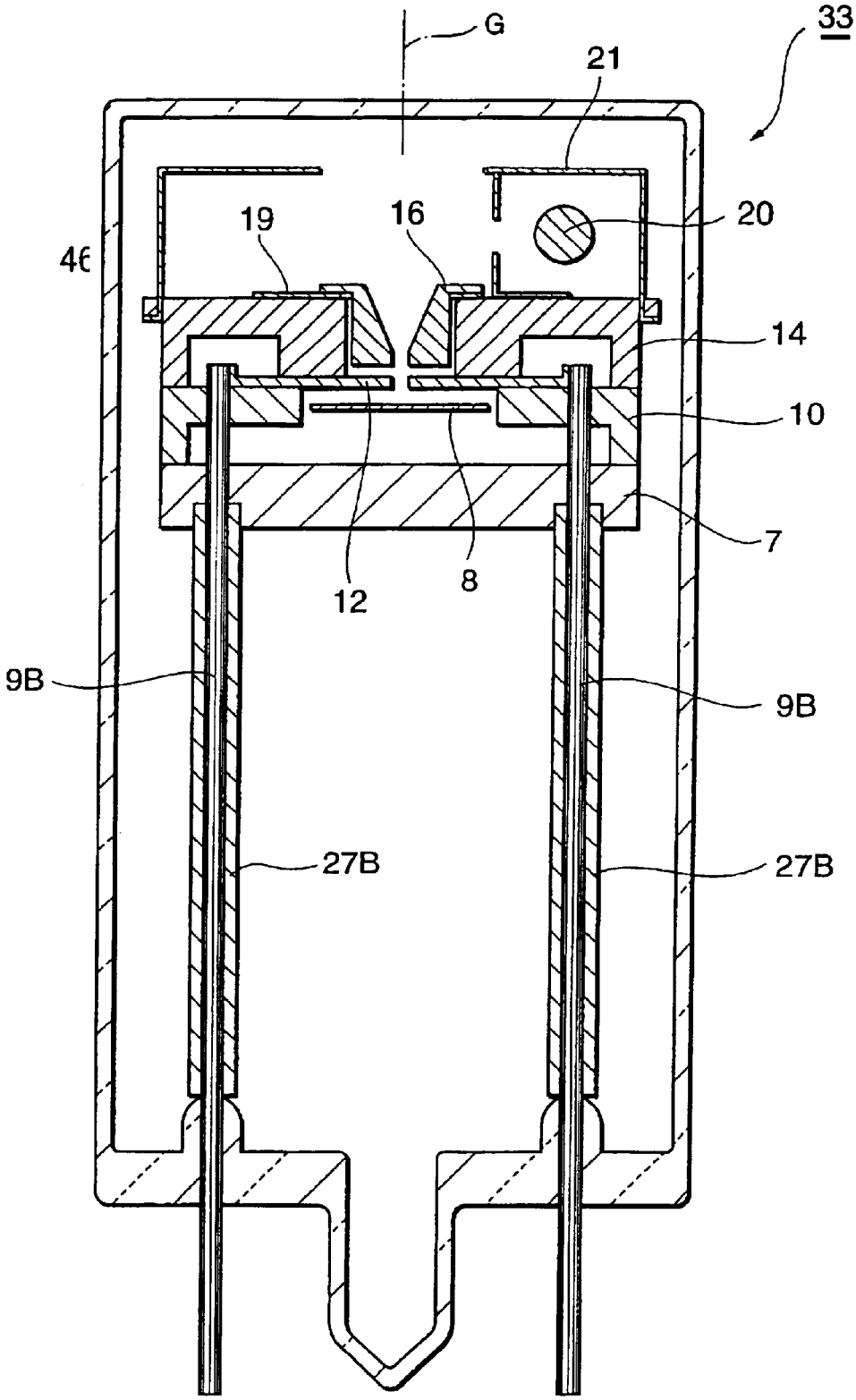
FIG. 60 is a sectional view showing a seventeenth embodiment of the gas discharge tube in accordance with the present invention.
Figure 61:
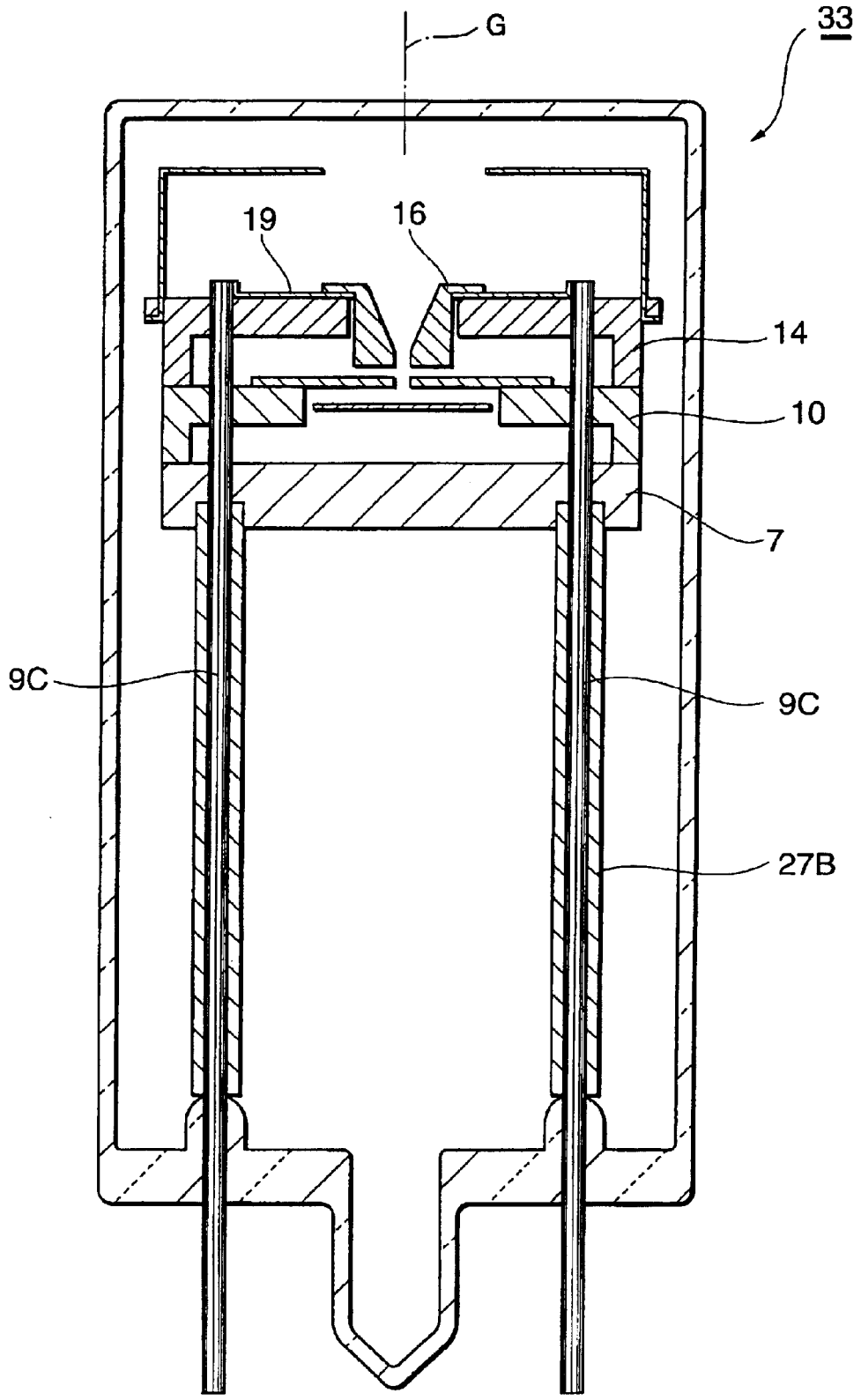
FIG. 61 is a sectional view of the gas discharge tube shown in FIG. 59.

As shown in FIGS. 60 and 61, in a gas discharge tube 33 of the type shown in FIG. 48 and thereafter, the second discharge path restricting plate 12 is mounted on the second support part 10 while being simply welded to the leading ends of the stem pins 9B without being held and secured between the second support part 10 and third support part 14. This can increase heat dissipation from the first discharge path restricting part 16 and second discharge path restricting plate 12, decrease the sputtered products and evaporated products in the first discharge path restricting part 16 and second discharge path restricting plate 12, and stably maintain lamp characteristics for a long period.

(Eighteenth Embodiment)

Figure 62:
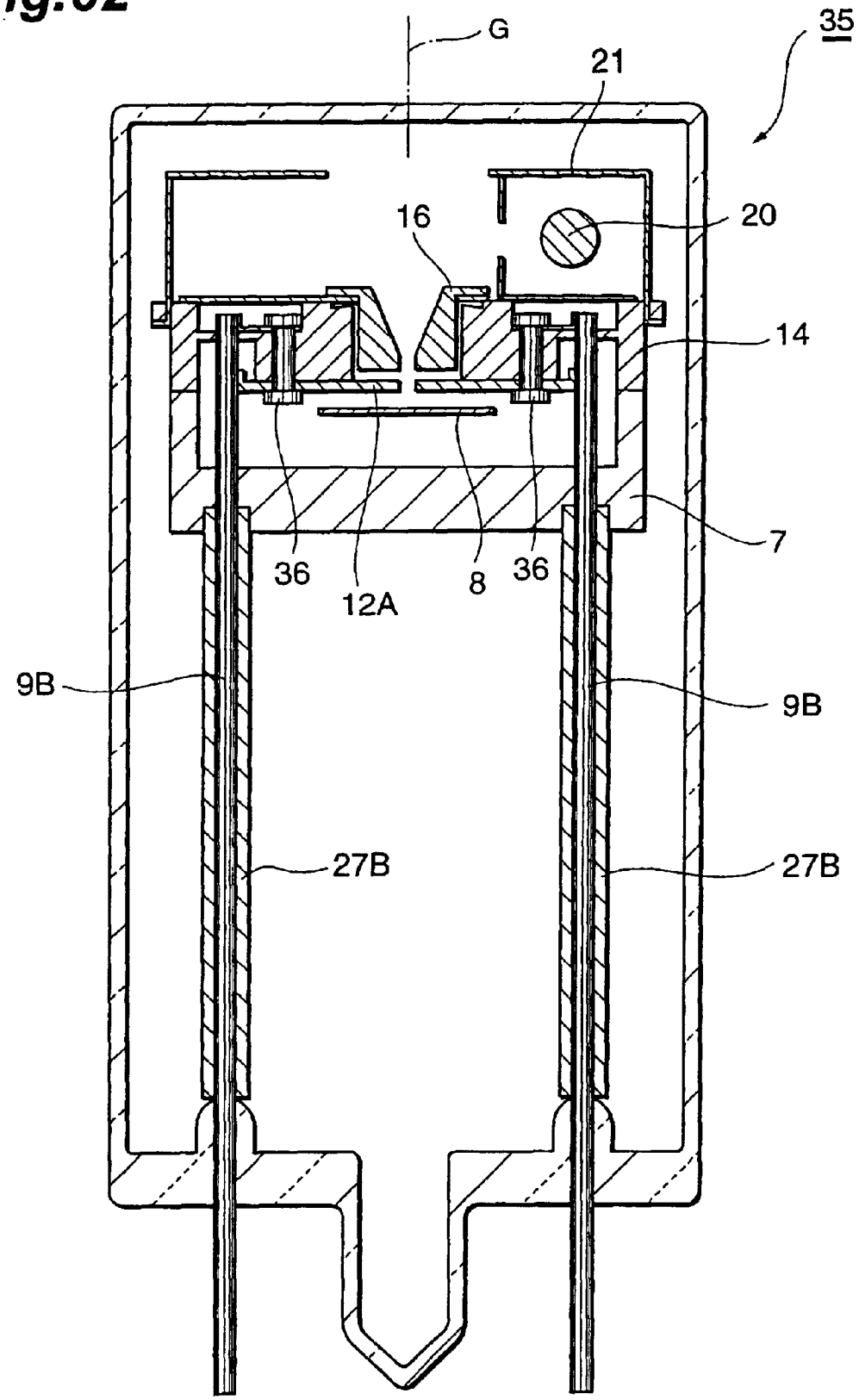
FIG. 62 is a sectional view showing an eighteenth embodiment of the gas discharge tube in accordance with the present invention.
Figure 63:
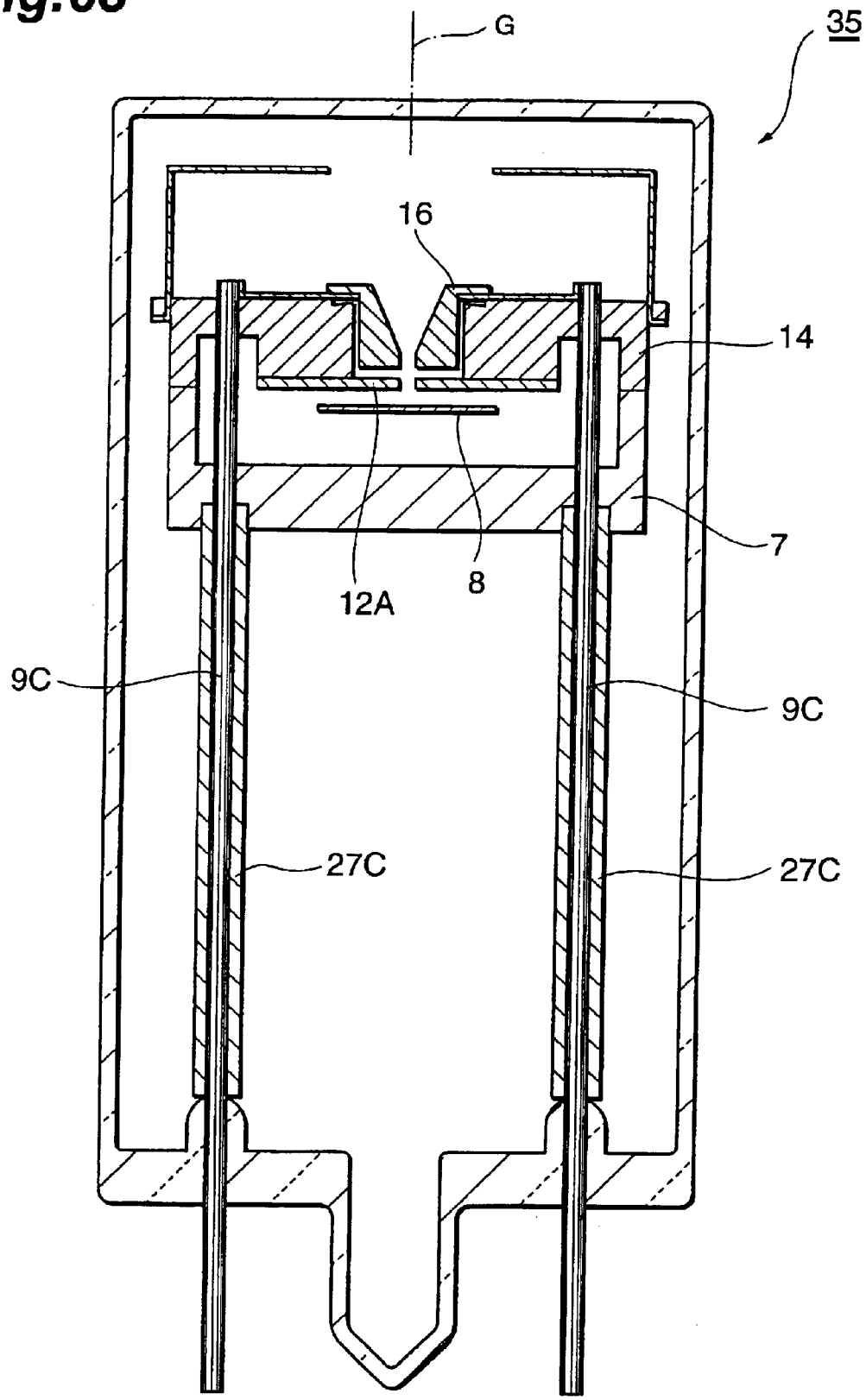
FIG. 63 is a sectional view of the gas discharge tube shown in FIG. 61.

As shown in FIGS. 62 and 63, in a gas discharge tube 35 of the type shown in FIG. 48 and thereafter, a second discharge path restricting plate 12A is arranged in contact with the rear face of an electrically insulating part (third support part) 14, and is secured to the electrically insulating part 14 with rivets 36 made of a metal. This integrates the electrically insulating part 14 and second discharge path restricting plate 12A together. During an assembling operation, the rivets 36 are electrically connected to the leading ends of the stem pins 9B. Such a configuration can eliminate the second support part 10 made of ceramics, whereby the number of support parts can be reduced from 3 to 2. It can also increase heat dissipation from the second discharge path restricting plate 12A and anode plate 8, decrease the sputtered products and evaporated products in the second discharge path restricting plate 12A and anode plate 8, and stably maintain lamp characteristics for a long period.

(Nineteenth Embodiment)

Figure 64:
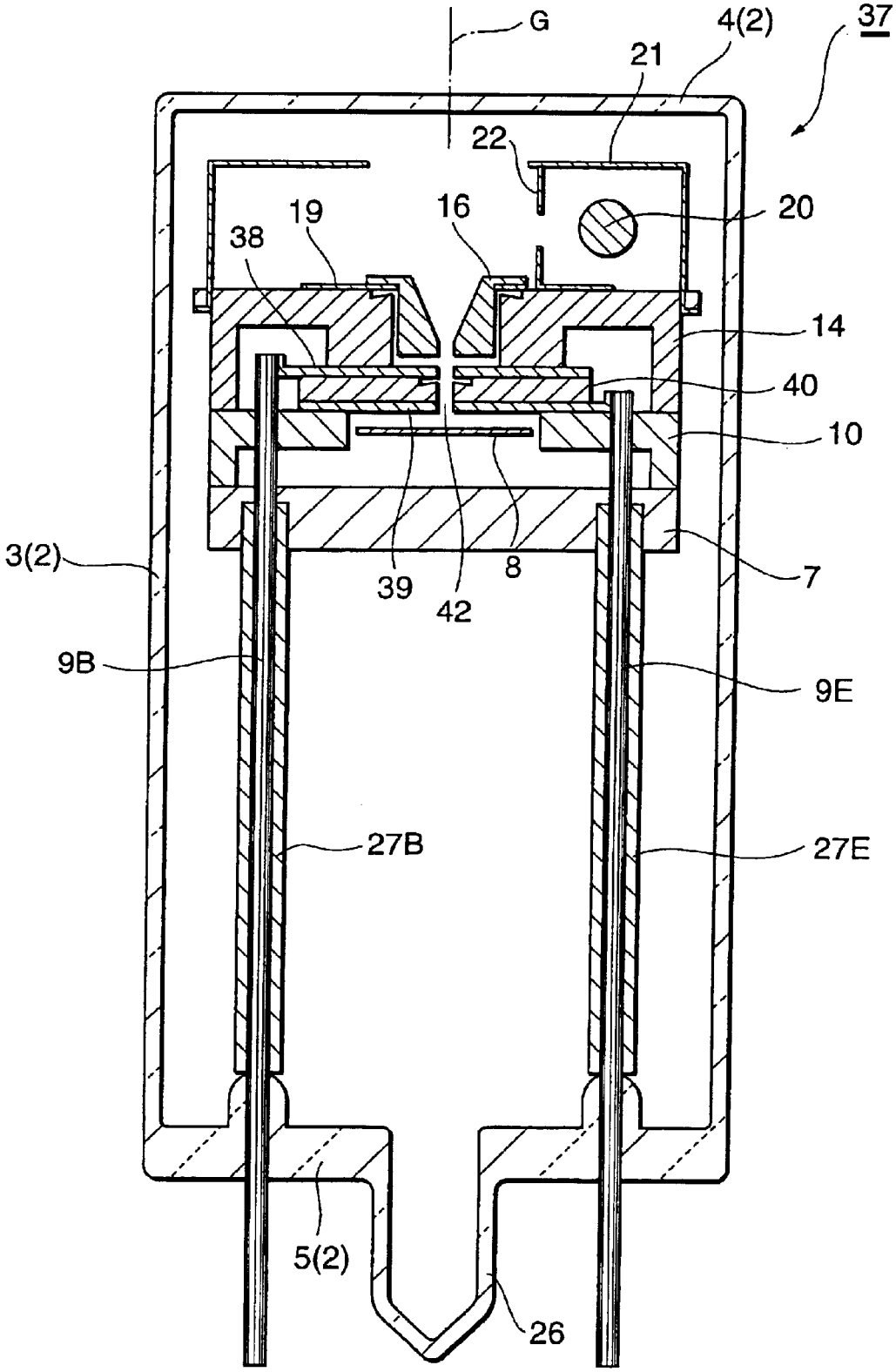
FIG. 64 is a sectional view showing a nineteenth embodiment of the gas discharge tube in accordance with the present invention.
Figure 65:
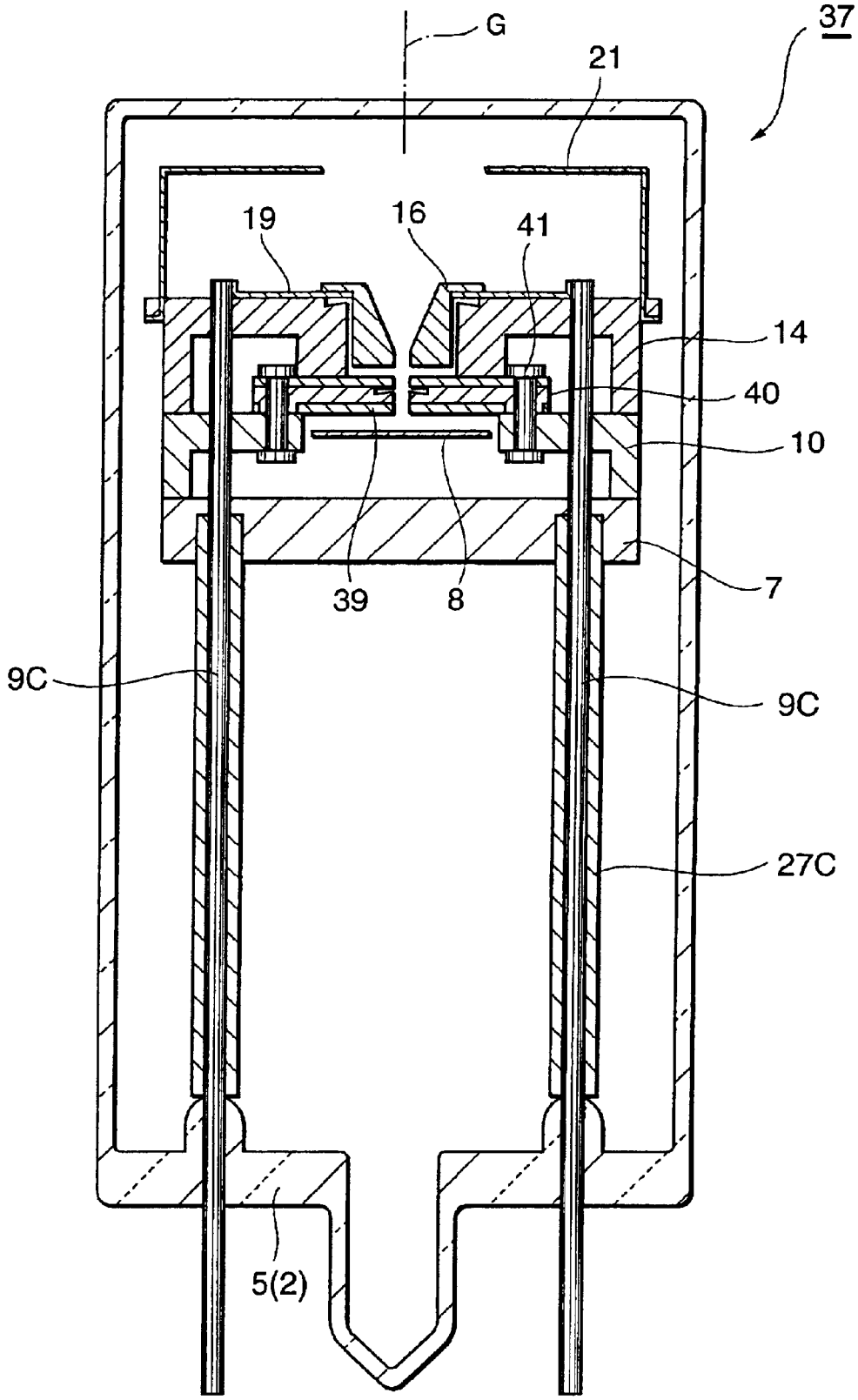
FIG. 65 is a sectional view of the gas discharge tube shown in FIG. 63.
Figure 66:
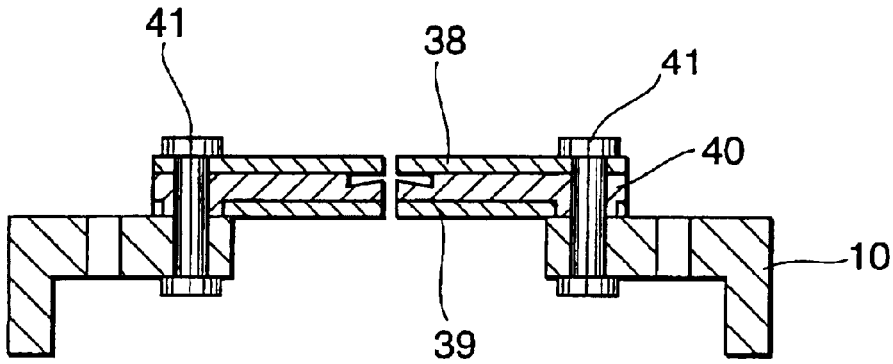
FIG. 66 is a partly enlarged sectional view of the gas discharge tube shown in FIG. 64.

As shown in FIGS. 64, 65, and 66, in a gas discharge tube 37 of the type shown in FIG. 48 and thereafter, a disk-shaped spacer 40 made of ceramics is interposed between a disk-shaped second discharge path restricting part 38 and a disk-shaped third discharge path restricting part 39, so as to electrically insulate them from each other. The spacer 40 is secured to the second support part 10 by rivets 41 made of a metal. The second discharge path restricting part 38, third discharge path restricting part 39, and spacer 40 are held and secured between the second support part and third support part 14.

Figure 67:
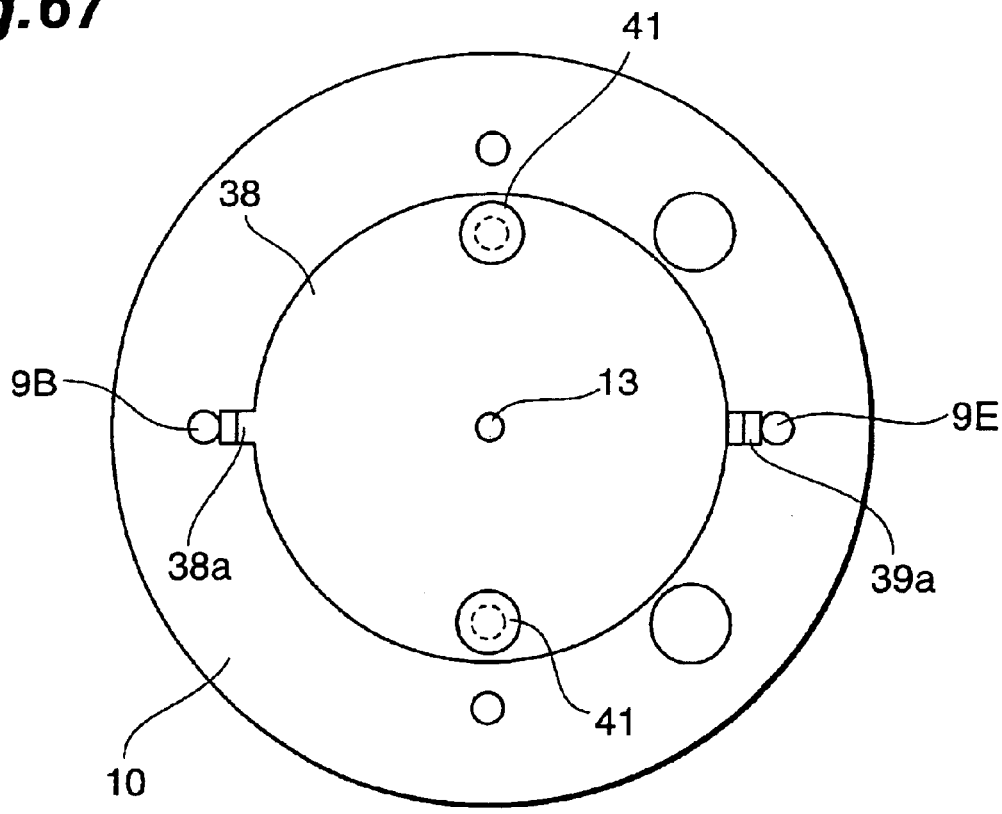
FIG. 67 is a plan view of FIG. 65.

As shown in FIGS. 64 and 67, for applying different potentials to the second discharge path restricting part 38 and third discharge path restricting part 39, respectively, the second discharge path restricting part 38 is electrically connected by way of a lead part 38*a* to the leading end of a fourth stem pin 9B raised from the stem 5. On the other hand, the third discharge path restricting part 39 is electrically connected by way of a lead part 39*a* to a leading end part of a fifth stem pin 9E raised from the stem 5. Here, reference 27E denotes an electrically insulating tube for protecting the stem pin 9E.

A higher voltage is applied to the third discharge path restricting part 39 than to the second discharge path restricting part 38. For example, when a voltage of 140 V is applied to the third discharge path restricting part 39, a voltage of 120 V is applied to the second discharge path restricting part 38. Applying different voltages to the second discharge path restricting part 38 and third discharge path restricting part 39 as such is advantageous when generating an electric field between the second discharge path restricting part 38 and third discharge path restricting part 39, so as to aggressively move electrons from near the second discharge path restricting part 38 to the third discharge path restricting part 39.

A third aperture 42 for narrowing the discharge path is formed at the center of the third discharge path restricting part 39. As a consequence, an arc ball occurs in the third aperture 42 of the third discharge path restricting part 39, thereby achieving a higher luminance. This third aperture 42 may have a diameter identical to or different from that of the second aperture 13 of the second discharge path restricting part 38.

Figure 68:
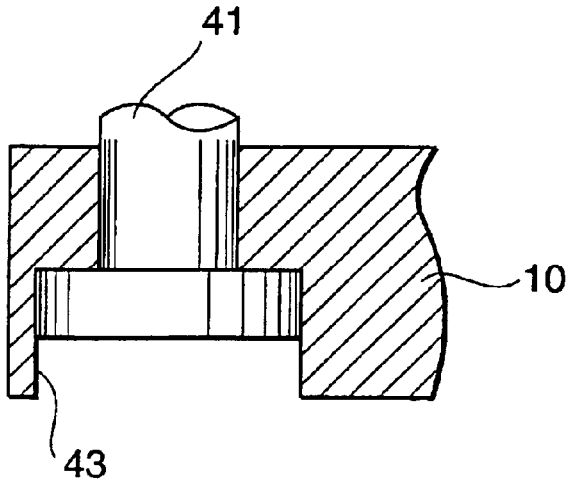
FIG. 68 is a sectional view showing another example of the securing method with a rivet.
Figure 69:
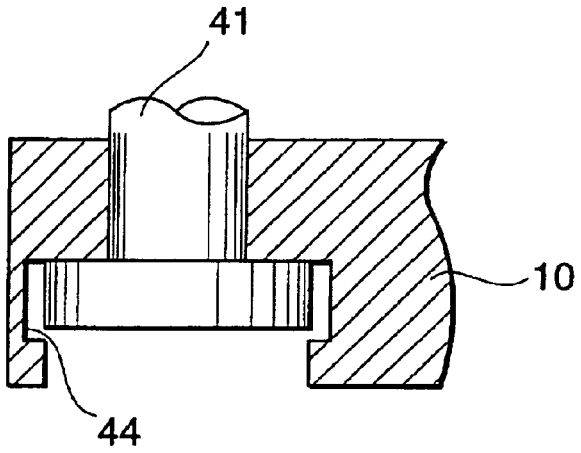
FIG. 69 is a sectional view showing still another example of the securing method with a rivet.
Figure 70:
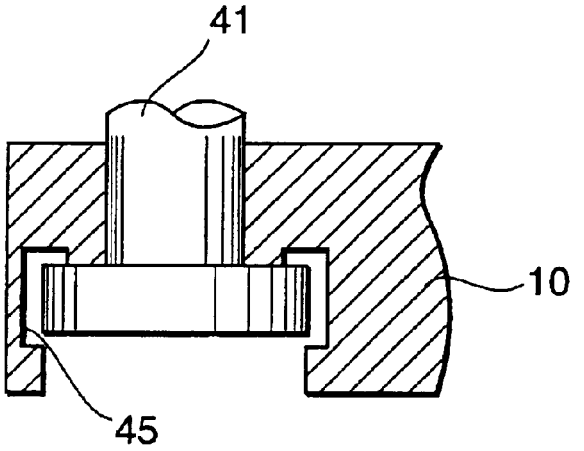
FIG. 70 is a sectional view showing still another example of the securing method with a rivet.

When a rivet 41 attains a high temperature during operation of the lamp, sputtered products and evaporated products are generated from a head part of the rivet 41. Therefore, as shown in FIG. 68, an end part of the rivet 41 is accommodated within a depression 43 formed in the second support part 10, so as to increase the area to which metal evaporated products attach, thereby making it difficult for the second discharge path restricting part 38 and third discharge path restricting part 39 to short-circuit by way of the rivet 41. As shown in FIG. 69, the second support part 10 is formed with a depression 44 for increasing the volume for accommodating the head part of the rivet 41. Also, as shown in FIG. 70, the second support part 10 is formed with a depression 45 for further increasing the volume for accommodating the head part of the rivet 41, whereas the wall face of the depression 45 maximizes the portion separated from the head part.

(Twentieth Embodiment)

Figure 71:
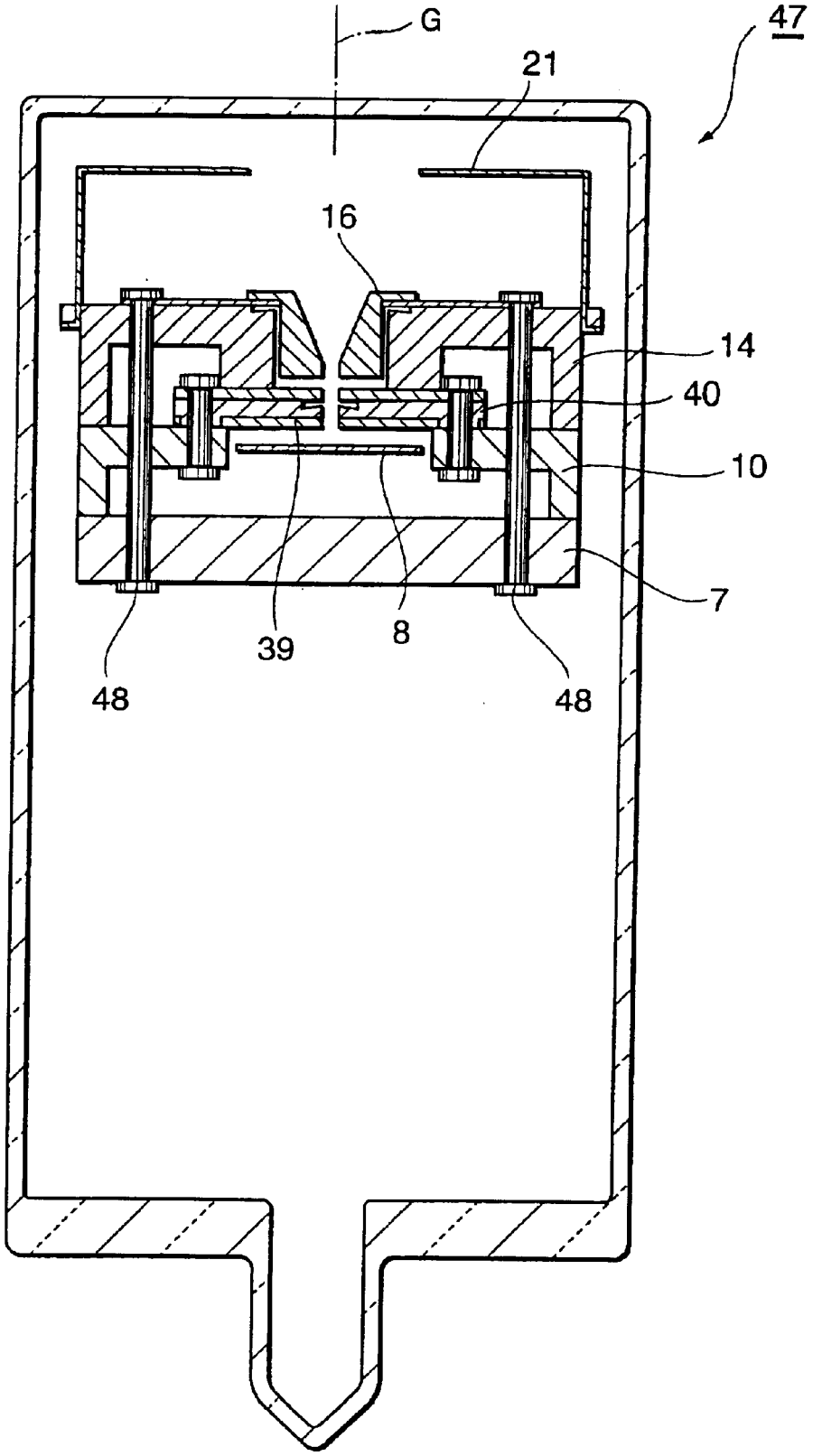
FIG. 71 is a sectional view showing a twentieth embodiment of the gas discharge tube in accordance with the present invention.

As shown in FIG. 71, in a gas discharge tube 47, the first support part 7, second support part 10, and third support part 14 are integrated together by rivets 48 made of a metal which are inserted along the tube axis G. This gas discharge tube 47 does not employ the first stem pins 9C, whereby no first stem pins 9C project from the stem 5. This can reliably prevent power from being supplied to the first discharge path restricting part 16, whereas the decrease in the number of stem pins enhances the strength against the thermal expansion occurring in fused parts of stem pins during operation of the lamp. Here, parts substantially common with those in the configuration of the gas discharge tube 37 shown in FIG. 65 are referred to with numerals identical thereto without repeating their overlapping descriptions.

(Twenty-first Embodiment)

Figure 72:
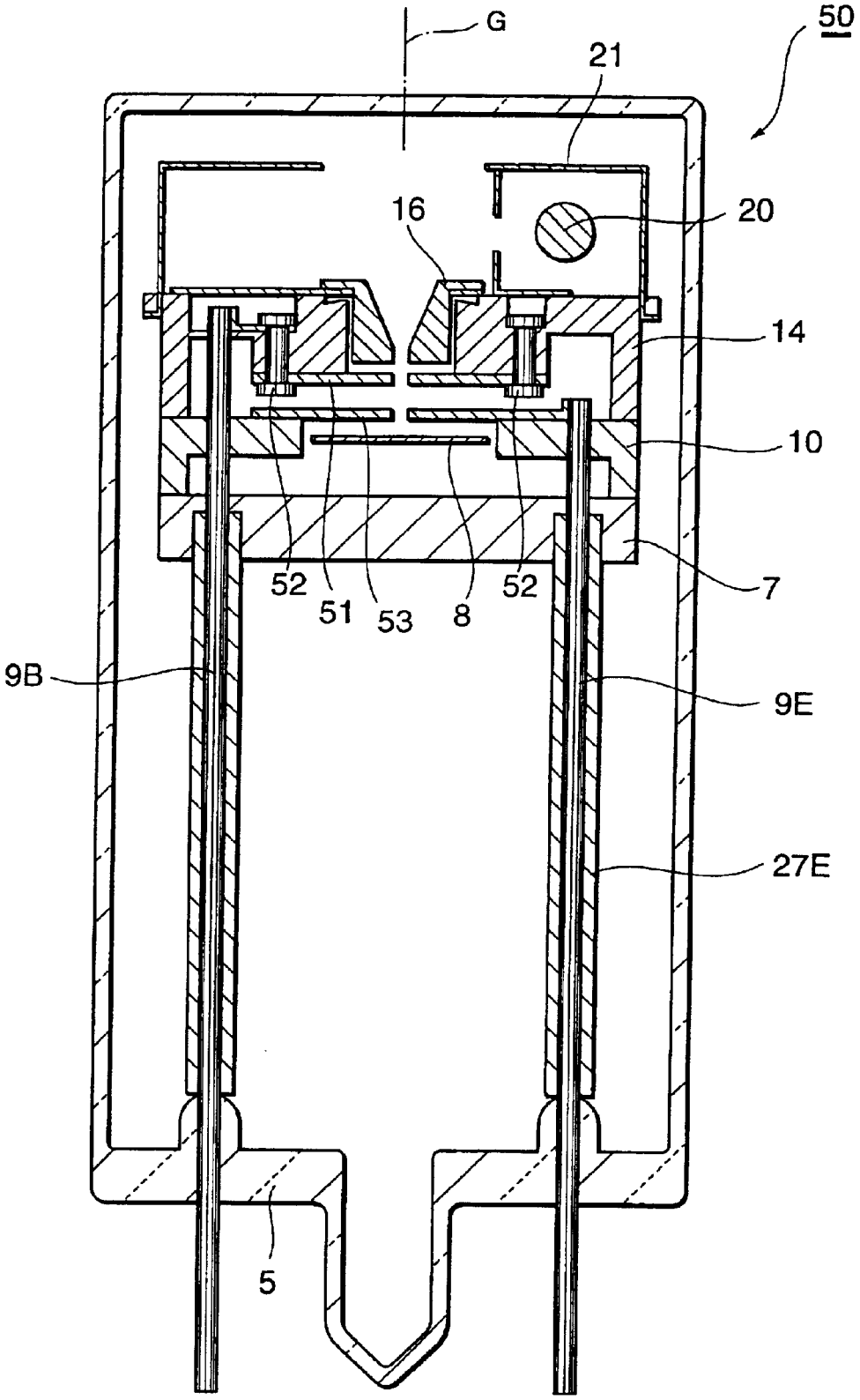
FIG. 72 is a sectional view showing a twenty-first embodiment of the gas discharge tube in accordance with the present invention.
Figure 73:
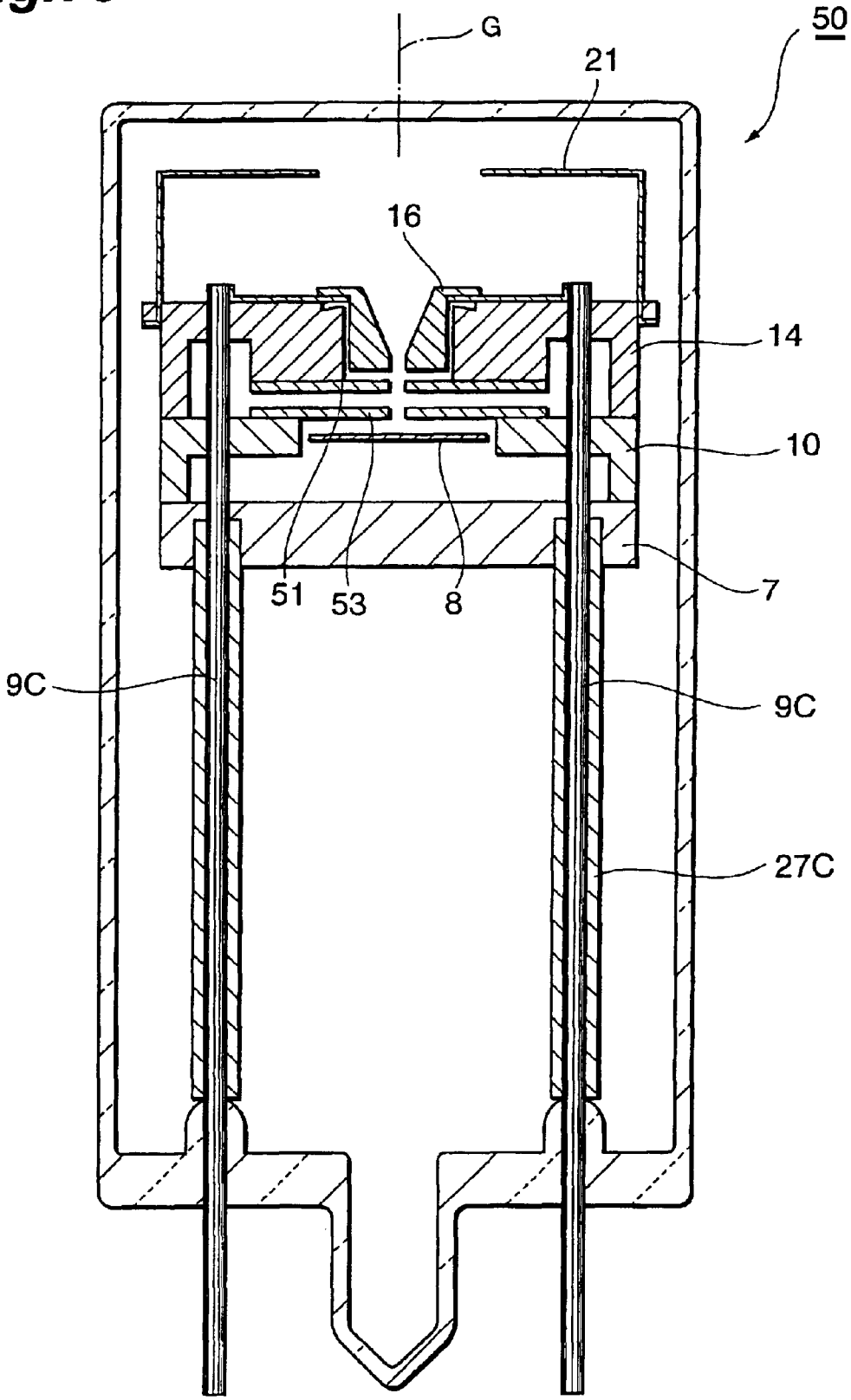
FIG. 73 is a sectional view of the gas discharge tube shown in FIG. 71.

As shown in FIGS. 72 and 73, in a gas discharge tube 50, a second discharge path restricting plate 51 is disposed in contact with the rear face of the electrically insulating part (third support part) 14, and is secured to the electrically insulating part 14 by rivets 52 made of a metal. This integrates the electrically insulating part 14 and second discharge path restricting plate 51 together. Further, a third discharge path restricting part 53 is arranged in contact with the upper face of the second support part 10, whereas the second discharge path restricting part 51 and third discharge path restricting part 53 are separated from each other by a space. The second discharge path restricting part 51 is electrically connected to a fourth stem pin 9B by way of a rivet 52, whereas the third discharge path restricting part 53 is electrically connected to a leading end part of a fifth stem pin 9E raised from the stem 5.

(Twenty-second Embodiment)

Figure 74:
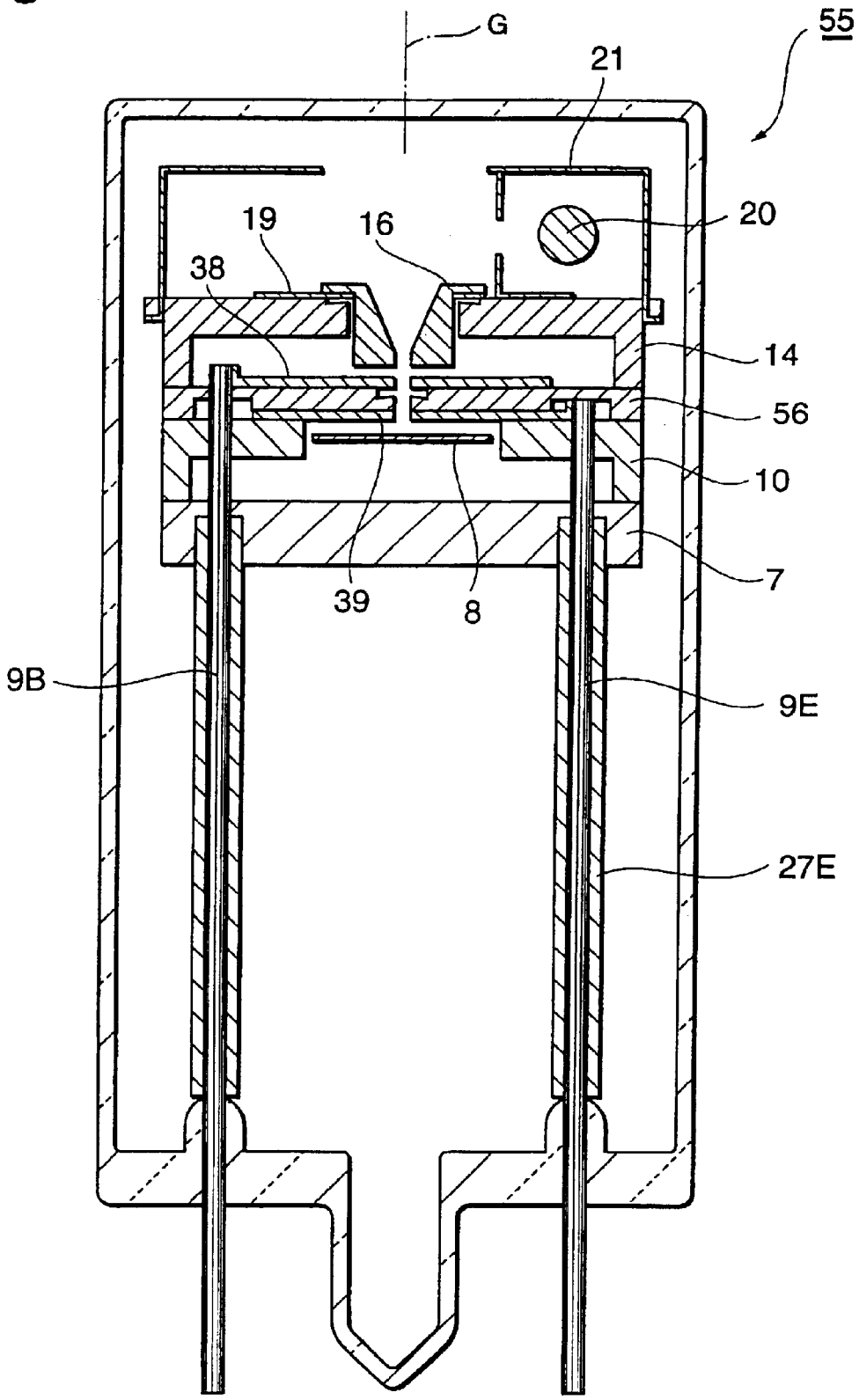
FIG. 74 is a sectional view showing a twenty-second embodiment of the gas discharge tube in accordance with the present invention.
Figure 75:
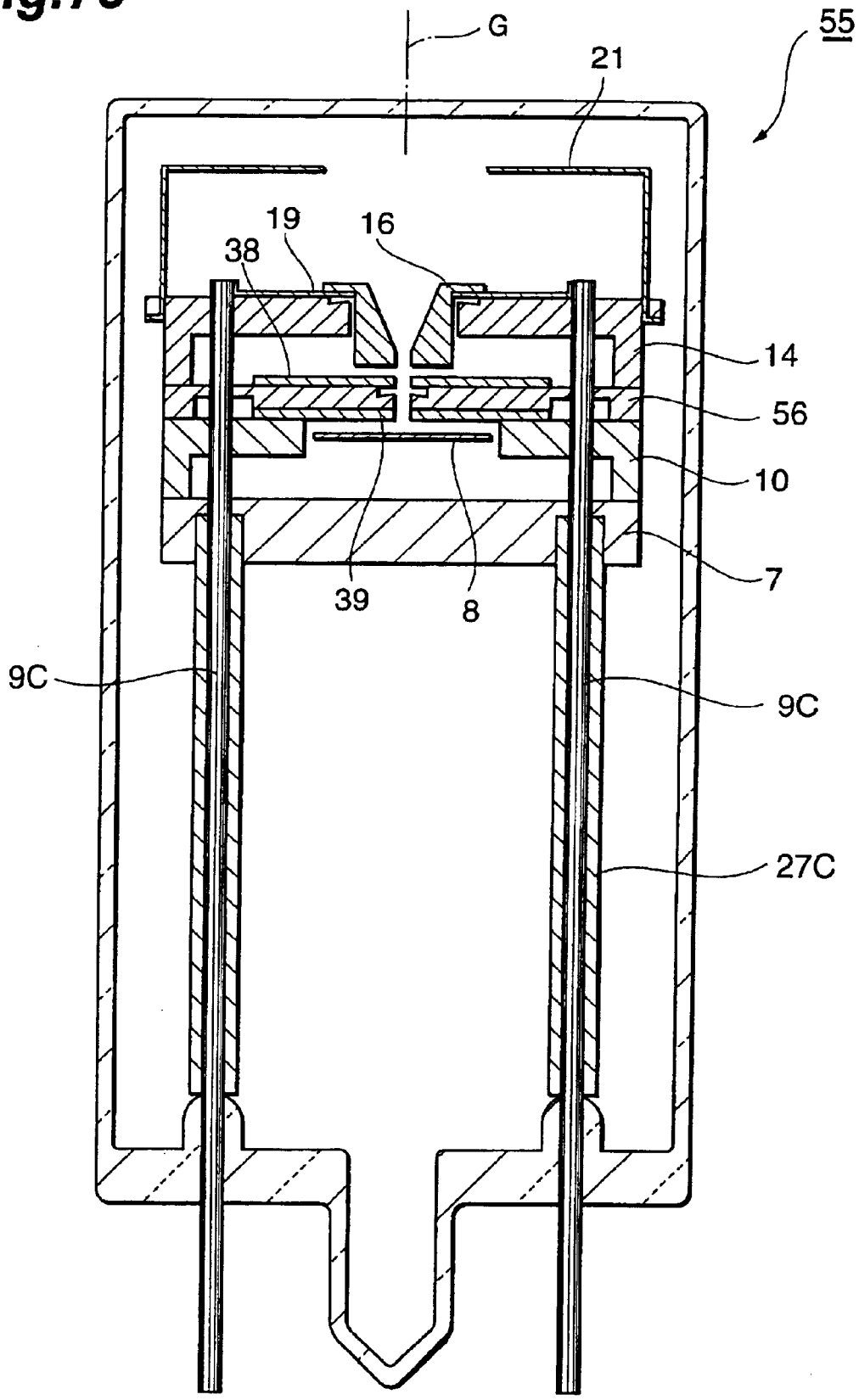
FIG. 75 is a sectional view of the gas discharge tube shown in FIG. 73.

As shown in FIGS. 74 and 75, in a gas discharge tube 55, a disk-shaped spacer 56 made of ceramics is held between the second support part 10 and third support part 14. A second discharge path restricting part 38 is arranged in contact with the upper face of the spacer 56, whereas a third discharge path restricting part 39 is arranged in contact with the rear face and is held and secured between the spacer 56 and the second support part 10. Such a configuration makes it unnecessary to secure the spacer 56 to the second support part 10 with rivets and the like.

(Twenty-third Embodiment)

Figure 76:
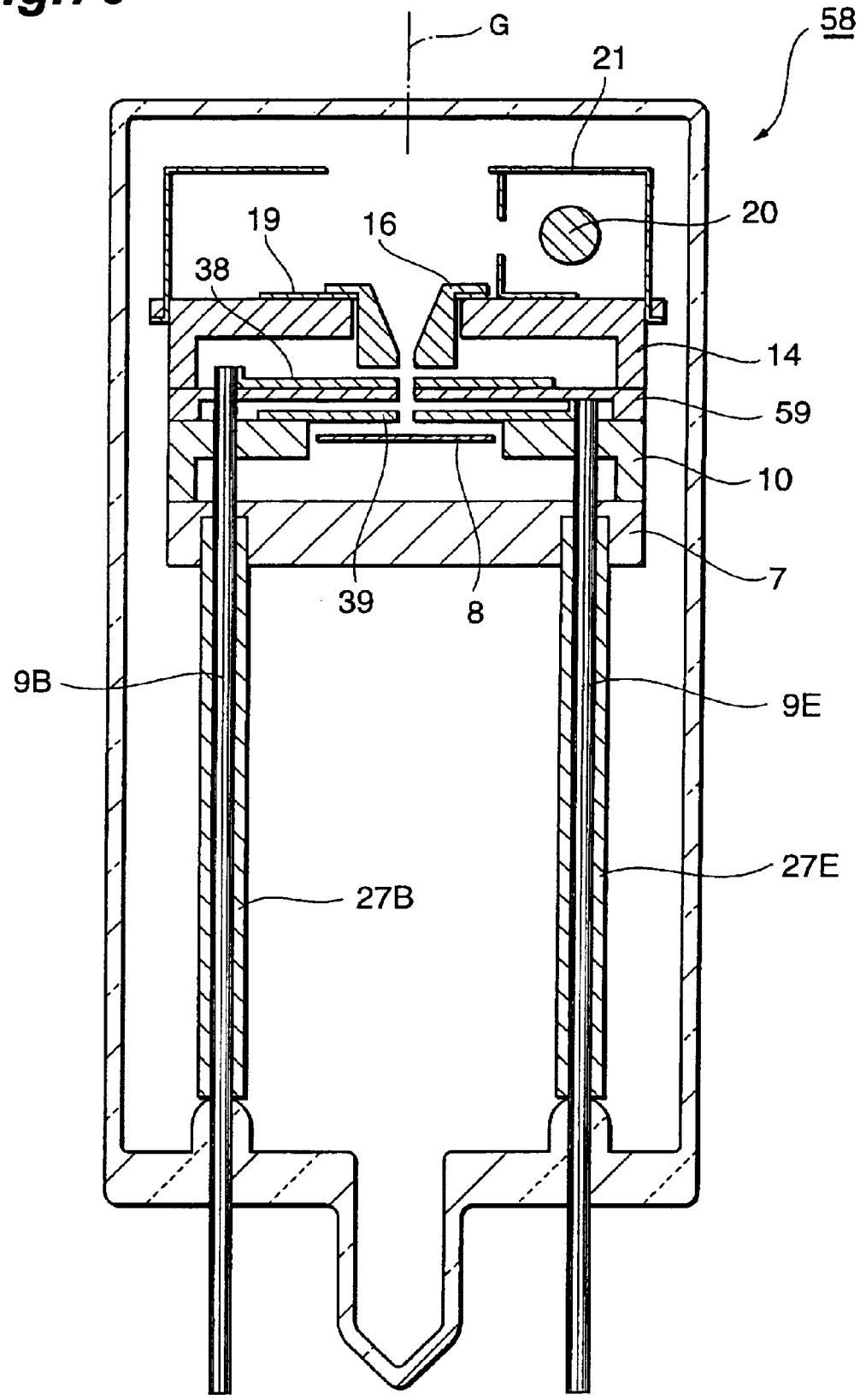
FIG. 76 is a sectional view showing a twenty-third embodiment of the gas discharge tube in accordance with the present invention.
Figure 77:
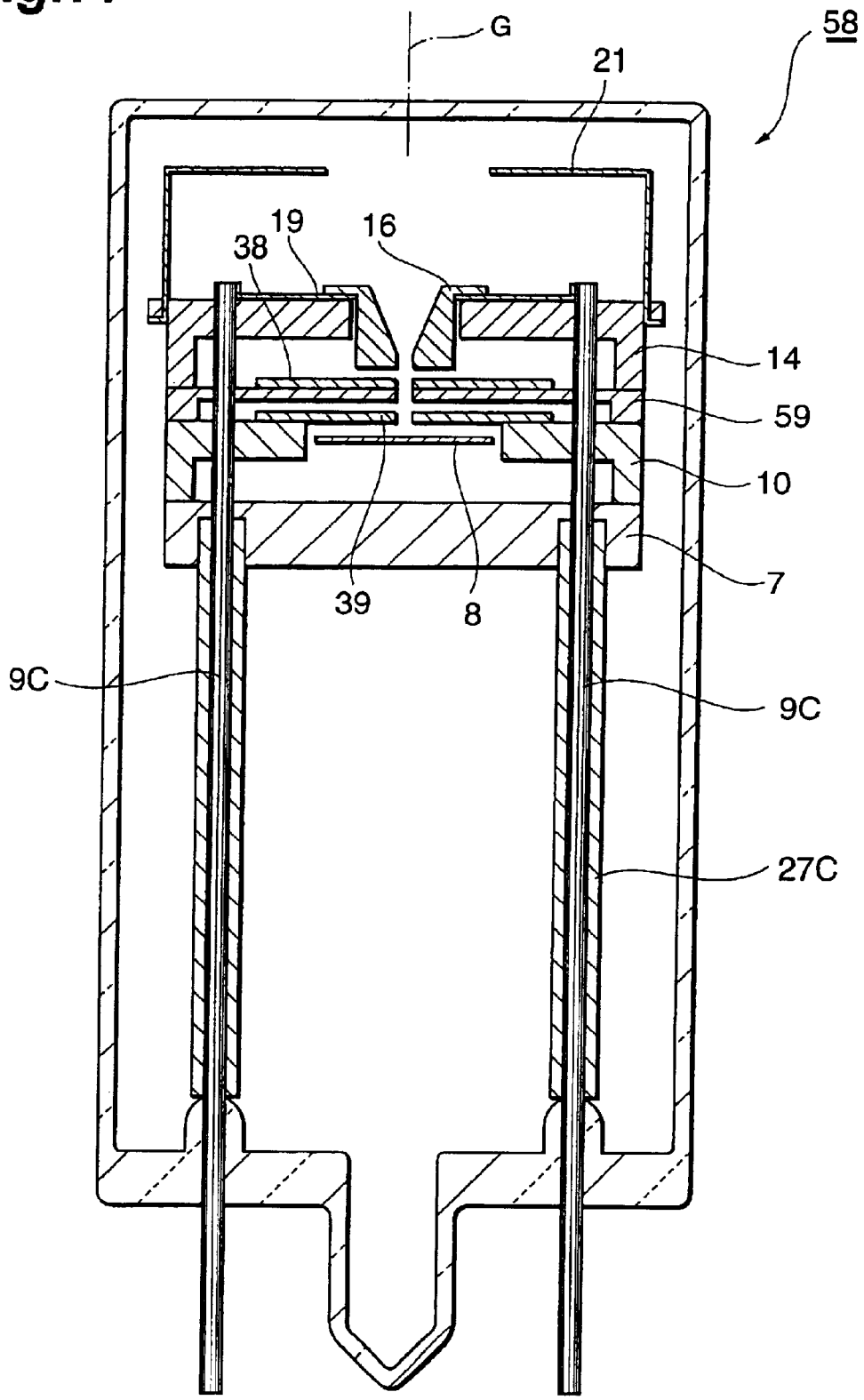
FIG. 77 is a sectional view of the gas discharge tube shown in FIG. 75.

As shown in FIGS. 76 and 77, in a gas discharge tube 58, a disk-shaped spacer 59 made of ceramics is held between the second support part 10 and third support part 14. A second discharge path restricting part 38 is arranged in contact with the upper face of the spacer 59, whereas a third discharge path restricting part 39 is arranged in contact with the upper face of the second support part 10. As a result, the second discharge path restricting part 38 and third discharge path restricting part 39 are separated from each other by way of a space and the spacer 59, thus making it unnecessary to secure the spacer 59 to the second support part 10 with rivets and the like.

(Twenty-fourth Embodiment)

Figure 78:
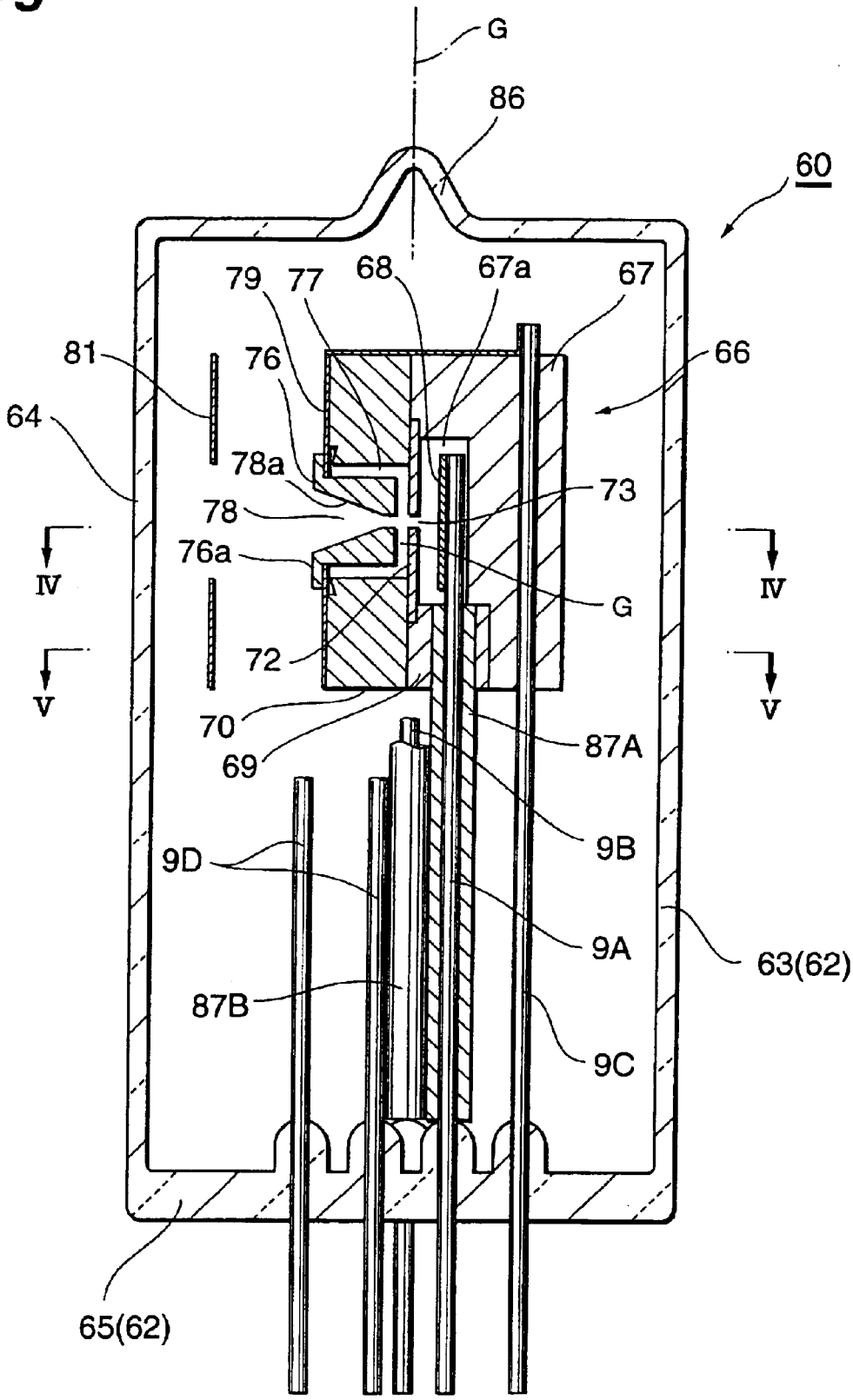
FIG. 78 is a sectional view showing a twenty-fourth embodiment of the gas discharge tube in accordance with the present invention.
Figure 79:
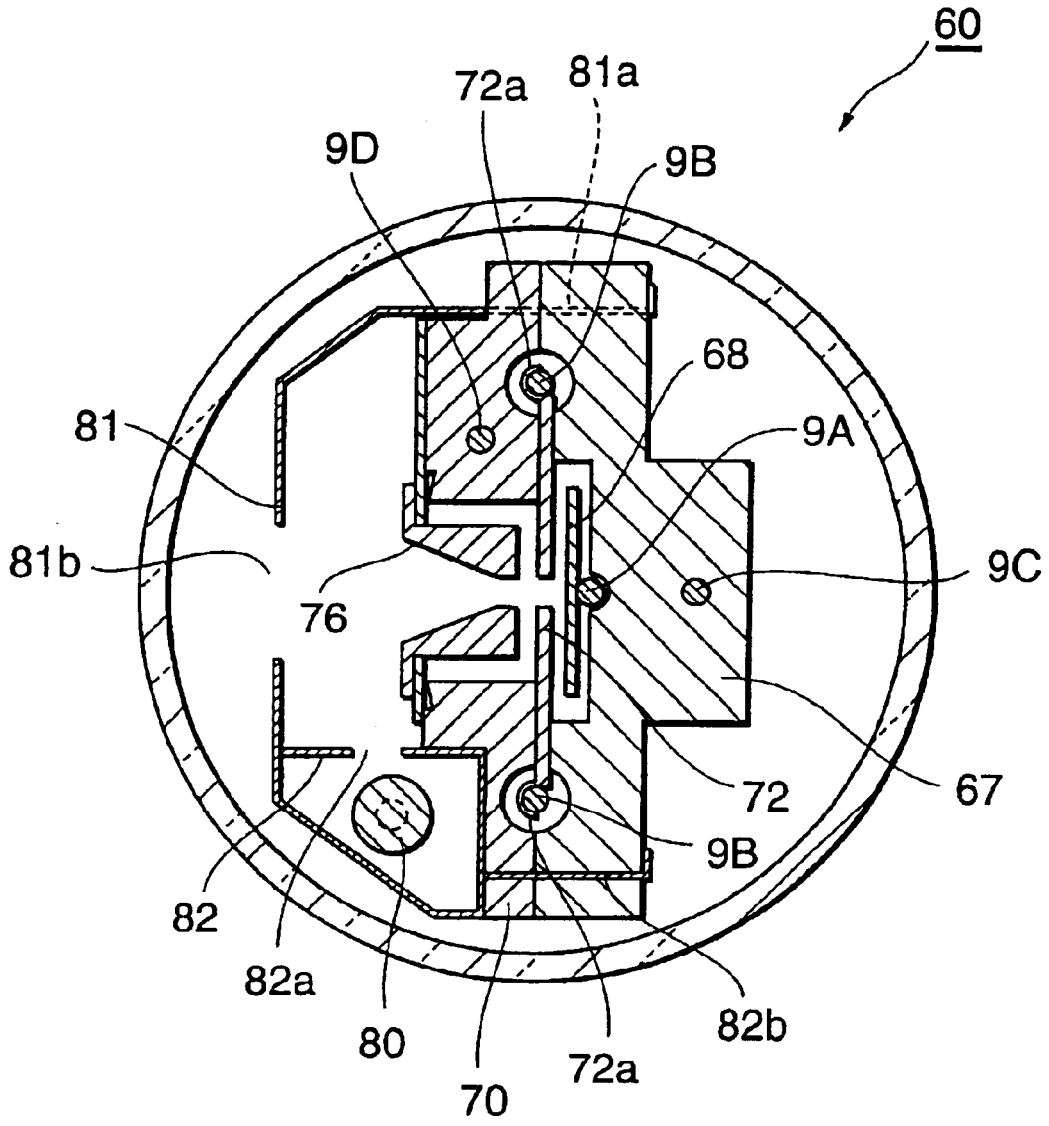
FIG. 79 is a sectional view taken along the line IV—IV of FIG. 77.

A gas discharge tube 60 shown in FIGS. 78 and 79 is a side-on type deuterium lamp 60 having a hermetic envelope 62 made of glass encapsulating a deuterium gas at about several hundred Pa therein. This hermetic envelope 62 comprises a cylindrical side tube 63 having one sealed end side, and a stem 65 for sealing the other end side of the side tube 63, whereas a part of the side tube 63 is utilized as a light exit window 64. Accommodated within the hermetic envelope 62 is a light emitter assembly 66.

The light emitter assembly 66 has an electrically insulating part (first support part) 67 made of electrically insulating ceramics. An anode plate (anode part) 68 is accommodated within a depression 67*a* formed in the front face of the electrically insulating part 67. Electrically connected to the rear face of the anode plate 68 is a leading end part of an anode stem pin (first stem pin) 9A raised from the stem 65 so as to extend along the tube axis G. The first support part 67 is fitted with a loading part 69 made of ceramics through which the first stem pin 9A penetrates.

The light emitter assembly 66 further comprises an electrically insulating part (second support part) 70 made of electrically insulating ceramics. The second support part 70 is secured so as to overlie the first support part 67 in a direction perpendicular to the tube axis G. A planar second discharge path restricting part 72 is held and secured between the front face of the first support part 67 and the rear face of the second support part 70, so that the second discharge path restricting part 72 and the anode plate 68 face each other.

A small hole (second aperture) 73 having a diameter of 0.5 mm for narrowing the discharge path is formed at the center of the second discharge path restricting part 72. Also, the discharge path restricting plate 72 is provided with two lead parts 72*a* on the left and right sides, whereas the lead parts 72*a* are electrically connected to respective leading end parts of discharge path restricting plate stem pins (fourth stem pins) 9B raised from the stem 65.

The second support part 70 is formed with a loading part 77, extending in a direction perpendicular to the tube axis G, for loading a first discharge path restricting part 76made of an electrically conductive metal (e.g., molybdenum, tungsten, or their alloys) from a side thereof. For narrowing the discharge path, the first discharge path restricting part 76 is formed with a first aperture 78 having the same diameter as that of the second aperture 73, whereas the first aperture 78 is positioned on the same tube axis G as the second aperture 73.

The first aperture 78 has a funnel part 78*a*, extending in a direction perpendicular to the tube axis G, for producing a favorable arc ball, whereas the funnel part 78*a* tapers down its diameter from the light exit window 64 toward the anode part 68. Specifically, it is formed with a diameter of 3.2 mm on the light exit window 64 side and with a diameter of about 0.5 mm on the anode part 68 side so as to attain the same aperture area as that of the second aperture 73. Thus, the discharge path is narrowed by the first aperture 78 and second aperture 73 in cooperation.

Figure 80:
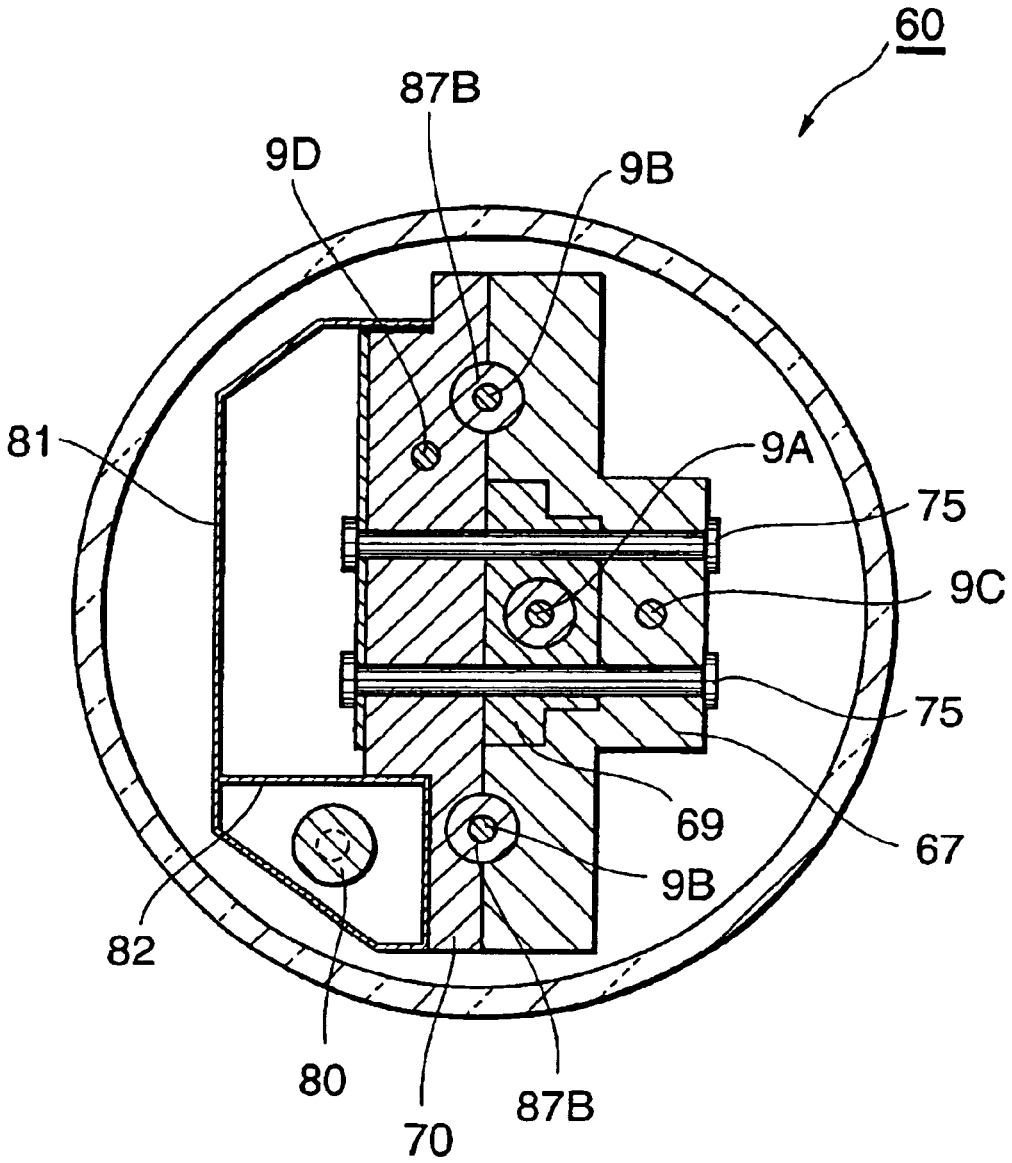
FIG. 80 is a sectional view taken along the line V—V of FIG. 77.

An electrically conductive plate 79 is arranged in contact with the front face of the second support part 70, and is secured with rivets 75 penetrating through the first and second support parts 67, 70 (see FIG. 80). An aperture formed in the electrically conductive plate 79 is aligned with the loading port 77, thus allowing the loading of the first discharge path restricting part 76. The electrically conductive plate 79 extends along the surfaces of first support part 67 and second support part 70 to the rear side, and is electrically connected to a leading end part of a discharge path restricting plate stem pin (third stem pin) 9C raised from the stem 65 so as to penetrate through the first support part 67. A flange part 76*a* provided with the first discharge path restricting part 76 is arranged in contact with the electrically conductive plate 79, and is welded to the electrically conductive plate 79, so as to integrate the electrically conductive plate 79 and the first discharge path restricting part 76 with each other.

Here, the first discharge path restricting part 76 and the second discharge path restricting part 72 are separated from each other with a gap G therebetween for electric insulation. Further, for making this insulation reliable, the first discharge path restricting part 76 and the second support part 70 are separated from each other. This is used for aggressively attaching metal evaporated products, among sputtered products and evaporated products generated from the first discharge path restricting part 76 and second discharge path restricting part 72 at a high temperature during operation of the lamp, to the wall face of the loading port 77. Namely, the first discharge path restricting part 76 and the second support part 70 are separated from each other, so as to increase the area to which evaporated products attach, thereby making it difficult for the first discharge path restricting part 76 and second discharge path restricting part 72 to short-circuit.

Also, the wall face of the funnel part 78*a* is processed into a mirror surface. In this case, the wall face may be finished into a mirror surface by polishing a single material (or alloy) such as tungsten, molybdenum, palladium, nickel, titanium, gold, silver, or platinum; or by using the above-mentioned single material or alloy as a matrix or ceramics as a matrix, and coating the material by plating, vapor deposition processing, or the like. As a consequence, the light emitted by an arc ball can be reflected by the mirror surface of the funnel part 78*a*, so as to be converged toward the light exit window 64, thereby improving the luminance of light.

In the light emitter assembly 66, a cathode part 80 is disposed at a position on the light exit window 64 side deviated from the optical path, whereas both ends of the cathode part 80 are electrically connected by way of undepicted connecting pins to respective leading end parts of cathode part stem pins (second stem pins) 9D raised from the stem 65. The cathode part 80 generates thermoelectrons. Specifically, the cathode part 80 has a coil part made of tungsten, extending along the tube axis G, for generating thermoelectrons.

Further, the cathode part 80 is accommodated within a cap-shaped front cover 81 made of a metal. The front cover 81 is secured when a nail 81*a* provided therewith is inserted into a slit (not depicted) formed in the first support part 67 and then bent. The front cover 81 is formed with a rectangular light transmission port 81*b* at a part facing the light exit window 64.

Further, within the front cover 81, a discharge straightening plate 82 is disposed at a position deviated from the optical path between the cathode part 80 and the first discharge path restricting part 76. An electron release window 82*a* of the discharge straightening plate 82 is formed as a rectangular aperture for transmitting thermoelectrons therethrough. The discharge straightening plate 82 is secured when a nail 82*b* provided therewith is inserted into a slit (not depicted) formed in the first support part 67 and then bent. Thus, the cathode part 80 is surrounded by the front cover 81 and the discharge straightening plate 82, so that the sputtered products or evaporated products emitted from the cathode part 80 do not attach to the light exit window 64.

While the light emitter assembly 66 having such a configuration is disposed within the hermetic envelope 62, an exhaust pipe 86 made of glass is integrally formed with the hermetic envelope 62, since it is necessary for the hermetic envelope 62 to be filled with a deuterium gas at several hundred Pa. In the final assembling step, the discharge pipe 86 is used for evacuating the hermetic envelope 62 of air once and then appropriately filling it with a deuterium gas at a predetermined pressure, and is sealed by fusion thereafter. Though all the stem pins 9A to 9D raised from the stem 65 may be protected by electrically insulating tubes made of ceramics, at least the step pins 9A and 9B are surrounded with tubes 87A and 87B.

The principle of operations of thus configured side-on type deuterium lamp 60 is the same as that of the above-mentioned head-on type deuterium lamp 1 and thus will not be explained. Here, the first stem pin 9C is utilized for holding the light emitter assembly 66 but not for supplying power to the first discharge path restricting part 76. However, the first stem pin 9C may be supplied with power from the outside at the time when the lamp starts operating. In this case, a higher voltage is supplied to the second discharge path restricting plate 72 than to the first discharge path restricting part 76.

For example, when a voltage of 140 V is applied to the second discharge path restricting part 72, a voltage of 120 V is applied to the first discharge path restricting part 76. Applying different voltages to the first discharge path restricting part 76 and second discharge path restricting plate 72 as such is advantageous when generating an electric field between the first discharge path restricting part 76 and second discharge path restricting part 72, so as to aggressively move electrons from near the first discharge path restricting part 76 to the second discharge path restricting part 72.

(Twenty-fifth Embodiment)

Figure 81:
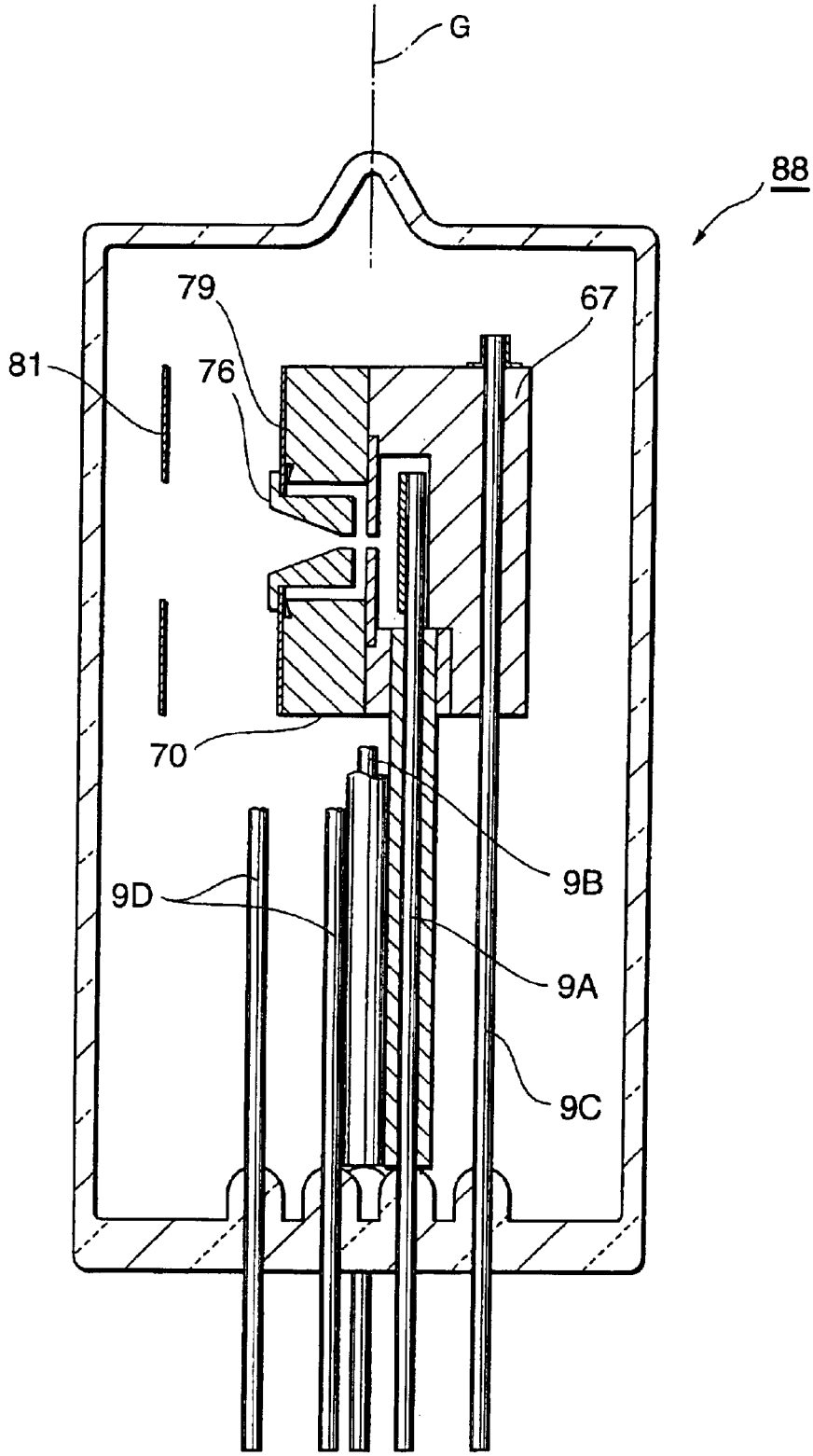
FIG. 81 is a sectional view showing a twenty-fifth embodiment of the gas discharge tube in accordance with the present invention.

As shown in FIG. 81, in a gas discharge tube 88 of the type shown in FIG. 48 and thereafter, which is of side-on type in this example, the electrically conductive plate 79 is unconnected to the first stem pin 9C in order to achieve a state where no power is supplied to the first discharge path restricting part 76. As a consequence, the first discharge path restricting part 76 attains a state electrically unconnected to an external power supply.

(Twenty-sixth Embodiment)

Figure 82:
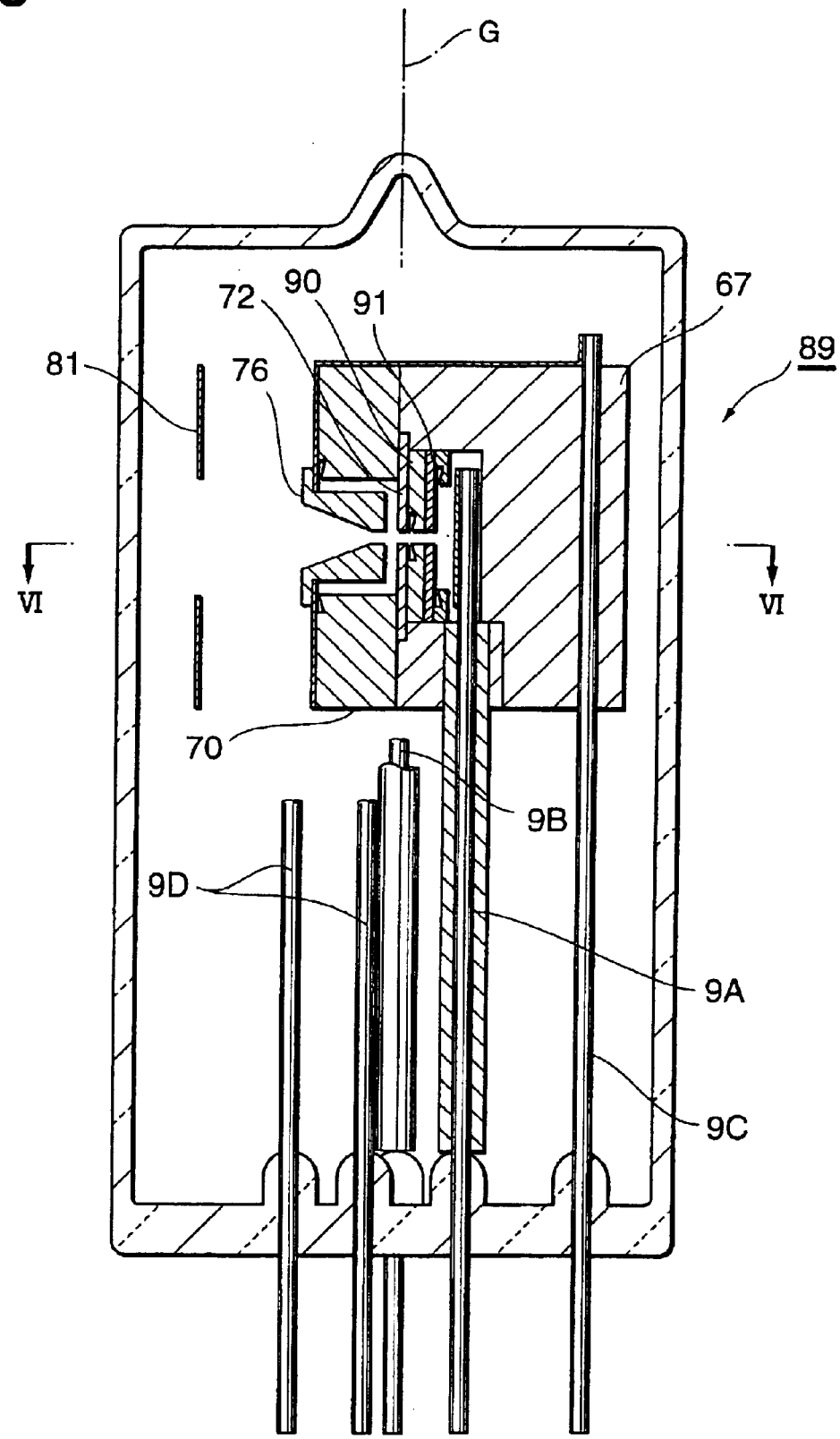
FIG. 82 is a sectional view showing a twenty-sixth embodiment of the gas discharge tube in accordance with the present invention.
Figure 83:
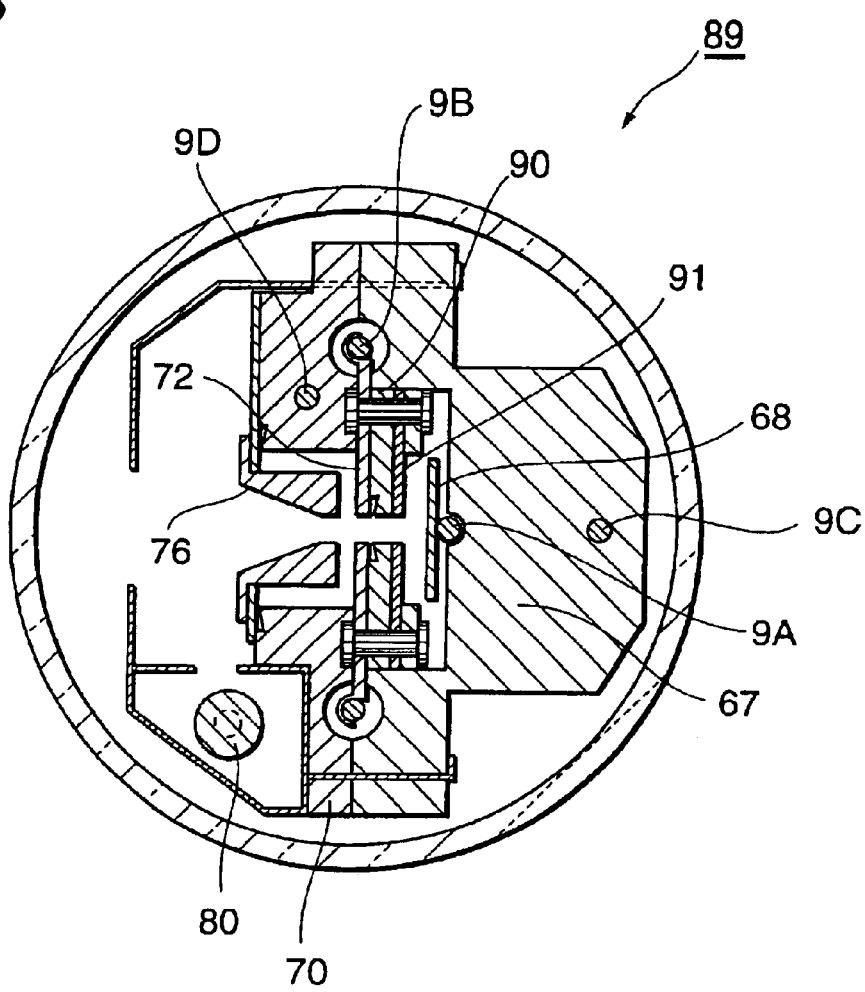
FIG. 83 is a sectional view taken along the line VI—VI of FIG. 81.
Figure 84:
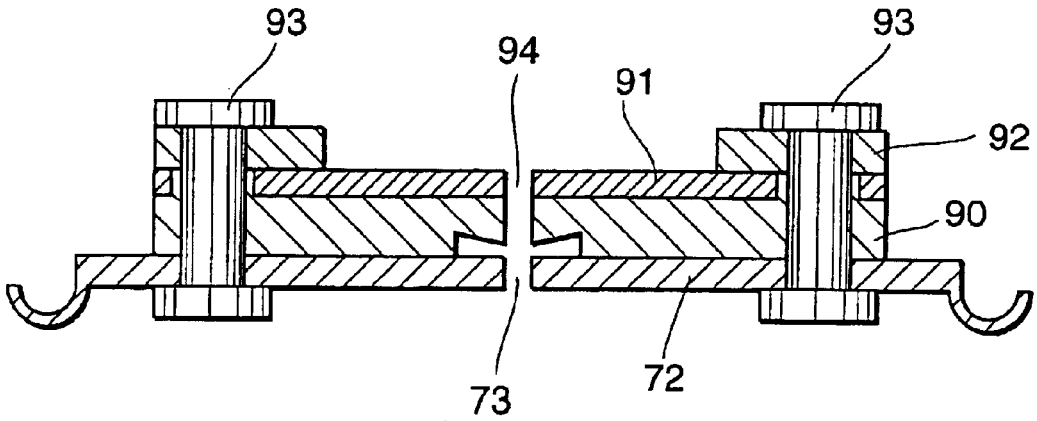
FIG. 84 is a partly enlarged sectional view of the gas discharge tube shown in FIG. 82.

As shown in FIGS. 82, 83, and 84, in a gas discharge tube 89, an electrically insulating spacer 90 made of ceramics is disposed at the rear face of the second discharge path restricting part 72, whereas a third discharge path restricting part 91 is disposed at the rear face of the spacer 90. The third discharge path restricting part 91 is held between the spacer 90 and an electrically insulating plate 92, whereas the second discharge path restricting part 72 and third discharge path restricting part 91 are integrated with each other by rivets 93. The second discharge path restricting part 72 is held and secured between the front face of the first support part 67 and the rear face of the second support part 70.

Further, a third aperture 94 for narrowing the discharge path is formed at the center of the third discharge path restricting part 91. As a consequence, an arc ball occurs within the aperture 94 of the third discharge path restricting part 91, whereby a further higher luminance is achieved. The third aperture 94 may have a diameter identical to or different from that of the second aperture 73 of the second discharge path restricting part 72.

Figure 85:
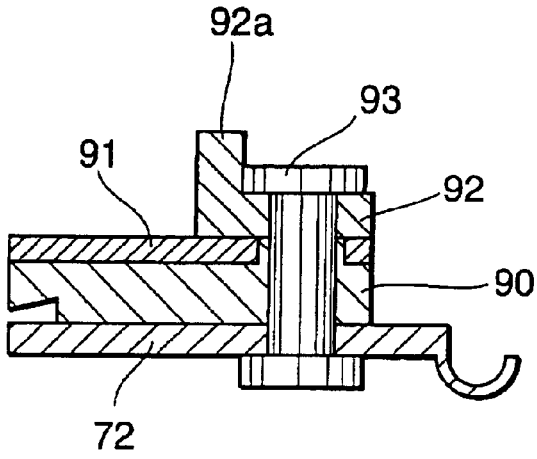
FIG. 85 is a sectional view showing another example of the securing method with a rivet.
Figure 86:
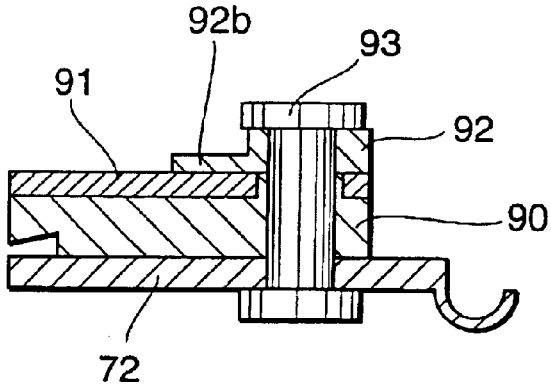
FIG. 86 is a sectional view showing still another example of the securing method with a rivet.
Figure 87:
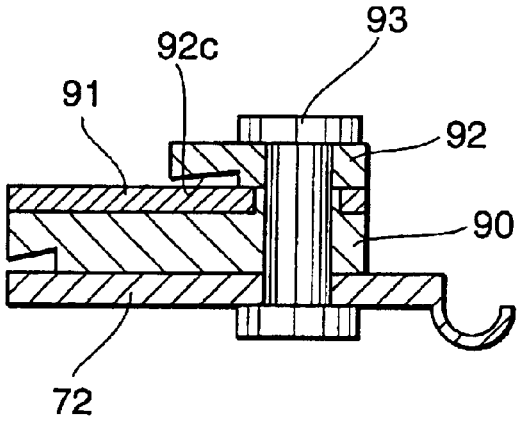
FIG. 87 is a sectional view showing still another example of the securing method with a rivet.

When a rivet 93 attains a high temperature during operation of the lamp, sputtered products are generated from a head part of the rivet 93. Therefore, as shown in FIG. 85, a barrier 92*a* is formed so as to project from the electrically insulating plate 92, thereby making metal evaporated products generated from the rivet 93 hard to attach to the third discharge path restricting part 91, thus making it difficult for the second discharge path restricting part 72 and third discharge path restricting part 91 to short-circuit byway of the rivet 93. Also, as shown in FIG. 86, the surface of the electrically insulating plate 92 is formed with a cutout 92*b*, so as to increase the area to which metal evaporated products attach. Similarly, as shown in FIG. 87, the rear face of the electrically insulating plate 92 is formed with a cutout 92*c*, so as to increase the area to which metal evaporated products attach.

(Twenty-seventh Embodiment)

Figure 88:
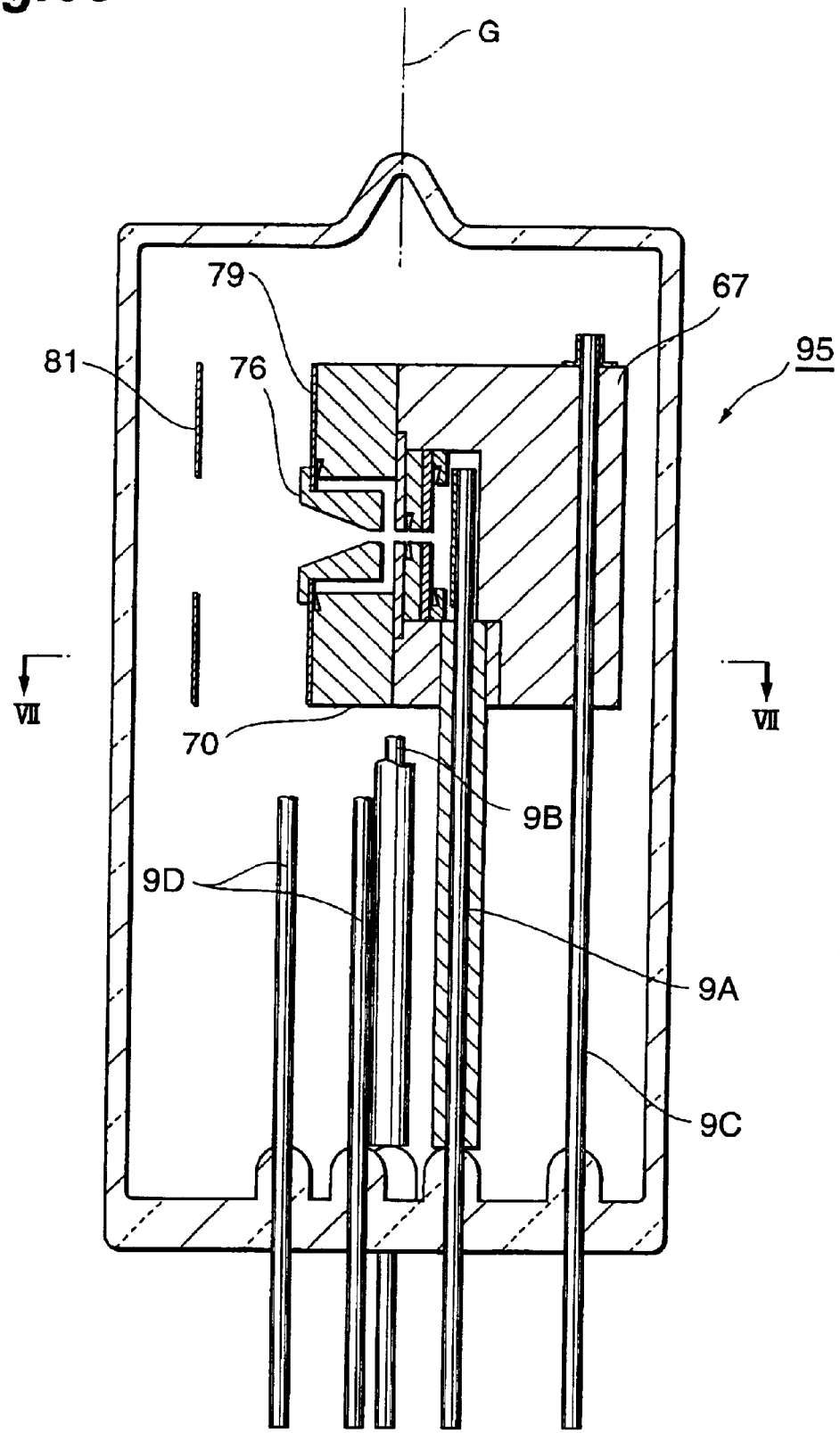
FIG. 88 is a sectional view showing a twenty-seventh embodiment of the gas discharge tube in accordance with the present invention.
Figure 89:
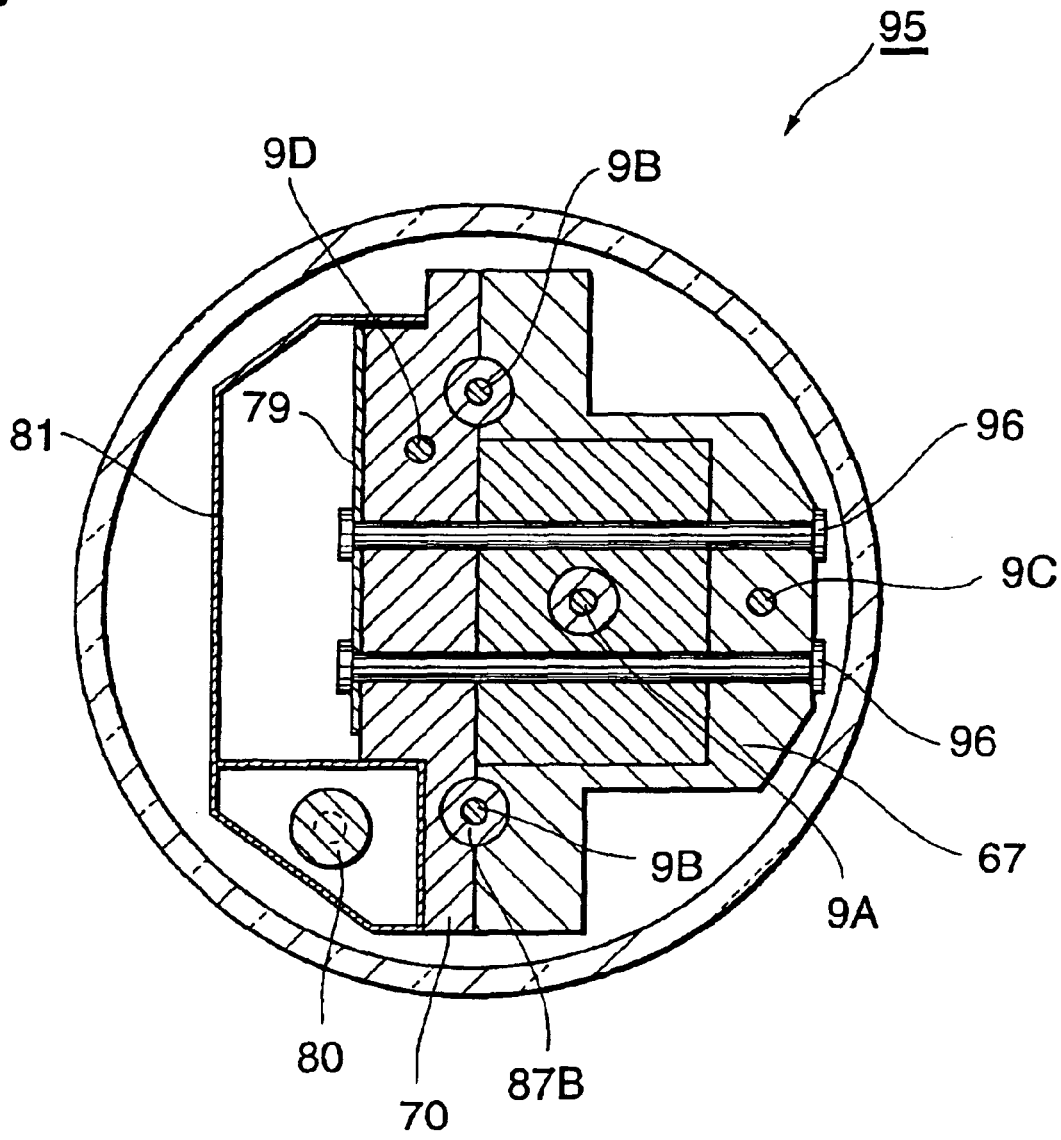
FIG. 89 is a sectional view taken along the line VII—VII of FIG. 87.

As shown in FIGS. 88 and 89, in a gas discharge tube 95, the electrically conductive plate 79 is unconnected to the first stem pin 9C in order to achieve a state where no power is supplied to the first discharge path restricting part 76. As a consequence, the first discharge path restricting part 76 attains a state electrically unconnected to an external power supply. The first support part 67 and second support part 70 are integrated with each other by rivets 96 made of a metal which are inserted in the light emitting direction.

(Twenty-eighth Embodiment)

Figure 90:
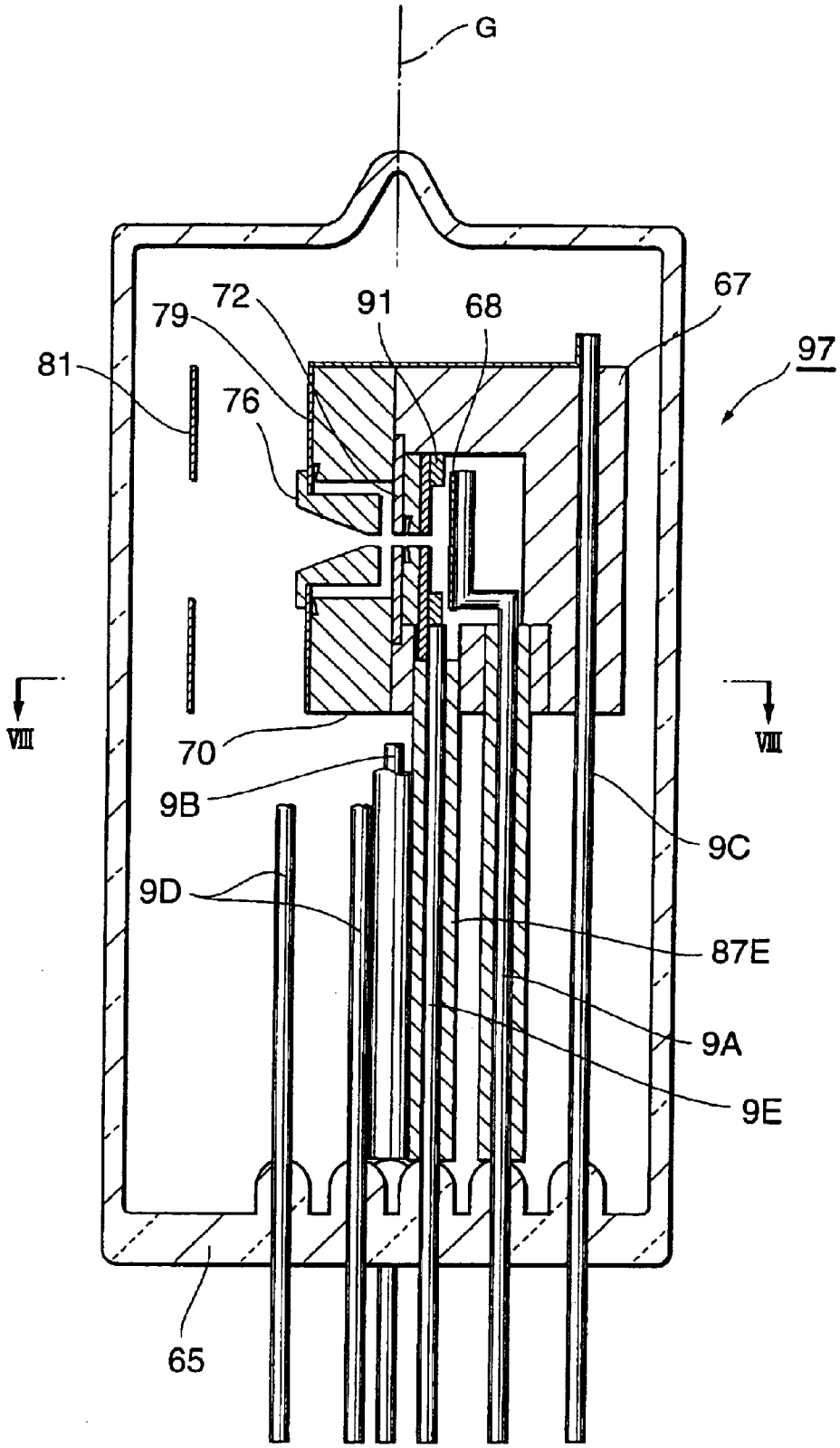
FIG. 90 is a sectional view showing a twenty-eighth embodiment of the gas discharge tube in accordance with the present invention.
Figure 91:
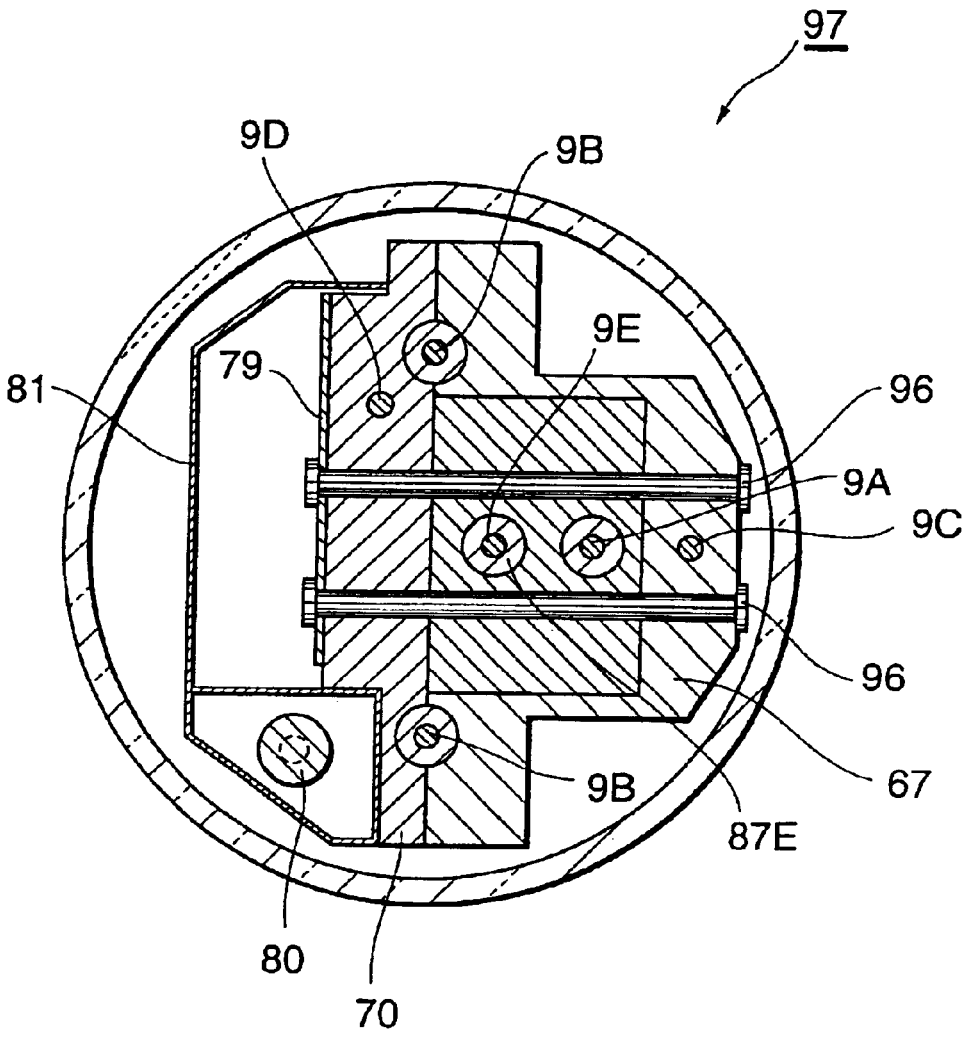
FIG. 91 is a sectional view taken along the line VIII—VIII of FIG. 89.

As shown in FIGS. 90 and 91, in a gas discharge tube 97, the second discharge path restricting part 72 is electrically connected to the leading ends of fourth stem pins 9B raised from a stem 65, in order to apply different potentials to the second discharge path restricting part 72 and third discharge path restricting part 91, respectively. On the other hand, the third discharge path restricting part 91 is electrically connected to a leading end part of a fifth stem pin 9E raised from the stem 65. Here, reference 87E denotes an electrically insulating tube for protecting the stem pin 9E.

The gas discharge tube in accordance with the present invention should not be restricted to the embodiments mentioned above. For example, the above-mentioned third discharge path restricting part 39, 53, 91 maybe constituted by a plurality of sheets.

Because of the foregoing configurations, the above-mentioned gas discharge tube attains the following effects. Namely, in a gas discharge tube which encapsulates a gas within a hermetic envelope, whereas discharge is generated between an anode part and a cathode part which are disposed within the hermetic envelope, so as to emit predetermined light from a light exit window of the hermetic envelope to the outside, the gas discharge tube comprises a first discharge path restricting part, disposed in the middle of a discharge path between the anode part and cathode part, having a first aperture for narrowing the discharge path; a second discharge path restricting part, disposed in the middle of a discharge path between the discharge path restricting part and the anode part, having a second aperture for narrowing the discharge path with an aperture area not smaller than that of the first aperture and electrically connecting with an external power supply; and an electrically insulating part disposed between the first and second discharge path restricting parts, thereby achieving a favorable startability while realizing a higher luminance.

Various circuits for operating the gas discharge tubes shown in FIG. 48 and thereafter are the same as those shown in FIGS. 44 to 47.

Industrial Applicability

The present invention can be utilized for a gas discharge tube.

What is claimed is:

1. A gas discharge tube encapsulating a gas within a hermetic envelope and generating discharge between anode and cathode parts disposed within said hermetic envelope, so as to emit predetermined light from a light exit window of said hermetic envelope to outside, said gas discharge tube comprising:

a first discharge path restricting part, disposed in the middle of a discharge path between said anode and cathode parts, having a first aperture for narrowing said discharge path;

a second discharge path restricting part, disposed in the middle of a discharge path between said first discharge path restricting part and said anode part, having a second aperture for narrowing said discharge path; and a first electrically insulating part disposed between said first and second discharge path restricting parts, wherein a periphery of said second discharge path limiting part is surrounded by an insulator including said first insulating part, said second discharge path restricting part has a peripheral edge facing outwardly and away from said discharge path, and said insulator including said first insulating part comprises an insulator portion, located further from said discharge path than the peripheral edge of said second discharge path restricting part, which circumnavigates the peripheral edge of said second discharge path restricting part.

2. A gas discharge tube according to claim 1, wherein said second discharge path restricting part is electrically connected to an external power supply.

3. A gas discharge tube according to claim 2, wherein said first discharge path restricting part is in a state electrically unconnected to said external power supply.

4. A gas discharge tube according to claim 2, wherein, when said first discharge path restricting part is electrically connected to said external power supply, a higher voltage is applied to said second discharge path restricting part than to said first discharge path restricting part.

5. A gas discharge tube according to claim 2, wherein said first aperture of said discharge path restricting part has a funnel part whose diameter tapers down from said light exit window toward said anode part.

6. A gas discharge tube according to claim 1, wherein said second aperture narrows said discharge path with an aperture area smaller than that of said first aperture.

7. A gas discharge tube according to claim 1, wherein said second aperture narrows said discharge path with an aperture area not smaller than that of said first aperture.

8. A gas discharge tube according to claim 1, wherein said second discharge path restricting part is arranged in contact with a second electrically insulating part.

9. A gas discharge tube according to claim 8, wherein said second discharge path restricting part is held and secured between said first electrically insulating part and said second electrically insulating part.

10. A gas discharge tube according to claim 1, further comprising a third discharge path restricting part, disposed in the middle of said discharge path between said second discharge path restricting part and said anode part, having a third aperture for narrowing said discharge path.

11. A gas discharge tube according to claim 10, wherein a second electrically insulating part is disposed between said second and third discharge path restricting parts.

12. A gas discharge tube according to claim 10, wherein, when said third discharge path restricting part is electrically connected to an external power supply, a higher voltage is applied to said third discharge path restricting part than to said second discharge path restricting part.

13. A gas discharge tube according to claim 10, wherein said third discharge path restricting part is arranged in contact with a third electrically insulating part.

14. A gas discharge tube according to claim 13, wherein said third discharge path restricting part is held and secured between said first electrically insulating part and said third electrically insulating part.

15. The gas discharge tube according to claim 1, wherein the periphery of said second discharge path limiting part is surrounded by said first insulator part with a gap formed between the periphery of said second discharge path limiting part and said first insulator part.

16. The gas discharge tube according to claim 15, wherein a side of said exposed periphery of said second discharge path limiting part is said cathode side.

17. The gas discharge tube according to claim 1, wherein a part of an outer surface of said first discharge path limiting part is opposed to and separates from an inner surface of said first electrical insulation part via a space.

18. The gas discharge tube according to claim 1, wherein a part defining a minimum diameter of a first opening of said first discharge path limiting part is positioned inside an aperture of said first electrical insulation part.

19. A discharge tube comprising:

first and second electrically conductive aperture members disposed within a thermoelectron transmission path between a cathode and an anode; and a first insulator for electrically insulating said electrically conductive aperture members from each other, wherein said second electrically conductive aperture member is arranged nearer said anode than said first electrically conductive aperture member, and wherein an insulator including said first insulator surrounds a periphery of said second electrically conductive aperture member so as to prevent the thermoelectrons that do not pass through the first electrically conductive aperture member from entering said second electrically conductive aperture member, with said second electrically conductive aperture member having a peripheral edge facing outwardly and away from said transmission path, and said insulator including said first insulator comprising an insulator portion, located further from said transmission path than the peripheral edge of said second electrically conductive aperture member, which circumnavigates the peripheral edge of said second electrically conductive aperture member.

20. A gas discharge tube according to claim 19, wherein said insulator that surrounds said second electrically conductive aperture member is comprised of ceramic.

21. A gas discharge tube according to claim 19, further comprising rivets for securing said second electrically conductive aperture member to said insulator.

* * * * *